US010428512B2

(12) United States Patent
Skinner et al.

(10) Patent No.: US 10,428,512 B2
(45) Date of Patent: Oct. 1, 2019

(54) MANHOLE BASE ASSEMBLY WITH INTERNAL LINER AND METHOD OF MANUFACTURING SAME

(71) Applicant: Press-Seal Corporation, Fort Wayne, IN (US)

(72) Inventors: James W. Skinner, Fort Wayne, IN (US); Jimmy D. Gamble, Avilla, IN (US); Robert R. Slocum, Fort Wayne, IN (US); John D. Kaczmarczyk, Angola, IN (US); John M. Kurdziel, Fort Wayne, IN (US)

(73) Assignee: Press-Seal Corporation, Fort Wayne, IN (US)

( * ) Notice: Subject to any disclaimer, the term of this patent is extended or adjusted under 35 U.S.C. 154(b) by 0 days.

(21) Appl. No.: 16/244,708

(22) Filed: Jan. 10, 2019

(65) Prior Publication Data

US 2019/0145091 A1 May 16, 2019

Related U.S. Application Data

(60) Division of application No. 15/605,303, filed on May 25, 2017, now Pat. No. 10,214,893, which is a (Continued)

(51) Int. Cl.
*B28B 7/02* (2006.01)
*E03F 5/02* (2006.01)
(Continued)

(52) U.S. Cl.
CPC ..... *E03F 5/027* (2013.01); *B28B 7/02* (2013.01); *B28B 7/168* (2013.01); (Continued)

(58) Field of Classification Search
CPC ..... E03F 5/027; E02D 29/125; E02D 29/149; B28B 7/02; B28B 7/168; B28B 19/0038; (Continued)

(56) References Cited

U.S. PATENT DOCUMENTS 631,867 A 8/1899 Beaver
879,340 A 2/1908 Wallace
(Continued)

FOREIGN PATENT DOCUMENTS

CA 1079993 A * 6/1980 ..... B28B 23/0043
DE 2 254 818 5/1974
(Continued)

OTHER PUBLICATIONS

International Search Report and Written Opinion dated Feb. 11, 2016 in PCT/US2015/061641.
(Continued)

*Primary Examiner* — Benjamin F Fiorello
(74) *Attorney, Agent, or Firm* — Faegre Baker Daniels LLP

(57) ABSTRACT

A manhole base assembly and a method for making the same employ a non-cylindrical, low-volume concrete base that is fully lined to protect the concrete against chemical and physical attack while in service. This lined concrete manhole base assembly may be readily produced using a modular manhole form assembly which can be configured for a wide variety of geometrical configurations compatible with, e.g., varying pipe angles, elevations and sizes. The form assembly is configurable to provide any desired angle and elevation for the pipe apertures to interface with various underground systems, and can be formed on-site to facilitate compatibility with existing structures. The assembly provides for flexible, modular construction of a wide variety of lined manhole base assemblies at minimal cost, reduced (Continued)

concrete consumption and reduced operational complexity. The modular nature of the production form assembly also facilitates reduced inventory requirements when various manhole base assembly geometries are needed.

9 Claims, 47 Drawing Sheets

Related U.S. Application Data continuation-in-part of application No. 15/440,611, filed on Feb. 23, 2017, now Pat. No. 10,053,850, which is a continuation of application No. 14/947,615, filed on Nov. 20, 2015, now Pat. No. 9,617,722.

(60) Provisional application No. 62/082,391, filed on Nov. 20, 2014.

(51) Int. Cl.

| | |
|---|---|
| ***B28B 19/00*** | (2006.01) |
| ***B28B 23/02*** | (2006.01) |
| ***B28B 23/00*** | (2006.01) |
| ***B28B 7/16*** | (2006.01) |
| ***E02D 29/14*** | (2006.01) |
| ***E02D 29/12*** | (2006.01) |

(52) U.S. Cl.
CPC ..... *B28B 19/0038* (2013.01); *B28B 19/0046* (2013.01); *B28B 23/0043* (2013.01); *B28B 23/024* (2013.01); *E02D 29/125* (2013.01); *E02D 29/149* (2013.01); *E03F 5/021* (2013.01); *E03F 5/025* (2013.01)

(58) Field of Classification Search
CPC ..... B28B 19/0046; B28B 23/0043; B28B 23/024
See application file for complete search history.

(56) References Cited

U.S. PATENT DOCUMENTS

| | | | | |
|---|---|---|---|---|
| 915,698 | A | 3/1909 | Putz | |
| 1,391,336 | A * | 9/1921 | Meiners | E02D 29/12 182/90 |
| 1,582,191 | A | 4/1926 | Snooke | |
| 2,068,648 | A | 1/1937 | Kaplan | |
| 2,775,469 | A | 12/1956 | Brown et al. | |
| 2,973,977 | A | 3/1961 | Stovall | |
| 3,212,519 | A | 10/1965 | Paschen | |
| 3,363,876 | A | 1/1968 | Moore | |
| 3,403,703 | A | 10/1968 | Reimann | |
| 3,562,969 | A | 2/1971 | Little, Jr. | |
| 3,654,952 | A | 4/1972 | Howe et al. | |
| 3,695,153 | A | 10/1972 | Dorris | |
| 3,715,958 | A | 2/1973 | Crawford et al. | |
| 3,745,738 | A * | 7/1973 | Singer | E02D 29/12 264/34 |
| 3,787,078 | A | 1/1974 | Williams | |
| 3,969,847 | A | 7/1976 | Campagna et al. | |
| 4,103,862 | A | 8/1978 | Moore | |
| 4,119,291 | A | 10/1978 | Polito | |
| 4,253,282 | A * | 3/1981 | Swartz | B28B 7/168 137/363 |
| 4,318,880 | A | 3/1982 | McIntosh et al. | |
| 4,346,921 | A | 8/1982 | Gill et al. | |
| 4,429,907 | A | 2/1984 | Timmons | |
| 4,444,221 | A | 4/1984 | LaBenz | |
| 4,461,498 | A | 7/1984 | Kunsman | |
| 4,483,643 | A | 11/1984 | Guggemos | |
| 4,484,724 | A | 11/1984 | Srackangast | |
| 4,566,483 | A | 1/1986 | Ditcher | |
| 4,614,324 | A | 9/1986 | Yamashita et al. | |
| 4,625,940 | A | 12/1986 | Barton | |
| 4,751,799 | A * | 6/1988 | Ditcher | B28B 19/0038 404/25 |
| 4,768,813 | A | 9/1988 | Timmons | |
| 4,867,411 | A | 9/1989 | Dorsey et al. | |
| 4,997,602 | A | 3/1991 | Trimble | |
| 5,032,197 | A | 7/1991 | Trimble | |
| 5,240,346 | A | 8/1993 | Yin | |
| 5,303,518 | A * | 4/1994 | Strickland | E02D 29/124 52/21 |
| 5,323,804 | A | 6/1994 | Lin | |
| 5,366,317 | A | 11/1994 | Solimar | |
| 5,383,311 | A | 1/1995 | Strickland | |
| 5,490,744 | A * | 2/1996 | McNeil | B29C 63/28 138/97 |
| 5,507,590 | A | 4/1996 | Argandona | |
| 5,540,411 | A | 7/1996 | Strickland | |
| 5,553,973 | A | 9/1996 | Duran | |
| 5,584,317 | A | 12/1996 | McIntosh | |
| 5,736,077 | A | 4/1998 | Kamiyama | |
| 5,752,787 | A | 5/1998 | Transgrud | |
| 5,879,501 | A | 3/1999 | Livingston | |
| 3,018,914 | A | 2/2000 | Kamiyama | |
| 6,206,609 | B1 | 3/2001 | Trangsrud | |
| 6,226,928 | B1 | 5/2001 | Trangsrud | |
| 6,234,711 | B1 | 5/2001 | Beaman | |
| 6,309,139 | B1 | 10/2001 | Tran-Quoc-Nam | |
| 6,315,077 | B1 | 11/2001 | Peacock et al. | |
| 6,347,781 | B1 | 2/2002 | Trangsrud | |
| 6,401,759 | B1 | 6/2002 | Kamiyama | |
| 6,968,854 | B2 | 11/2005 | Mokrzycki et al. | |
| 7,108,101 | B1 | 9/2006 | Westhoff | |
| 7,146,689 | B2 | 12/2006 | Neuhaus | |
| 7,896,032 | B2 * | 3/2011 | Kiest, Jr. | F16L 55/165 138/97 |
| 7,947,349 | B2 | 5/2011 | Schlüsselbauer | |
| 8,153,200 | B2 | 4/2012 | Hodgson | |
| 8,262,977 | B2 | 9/2012 | Schlüsselbauer | |
| 9,073,783 | B2 | 7/2015 | Hodgson | |
| 9,109,342 | B1 * | 8/2015 | Srackangast | E02D 29/12 |
| 9,132,614 | B2 | 9/2015 | Hodgson | |
| 9,567,760 | B2 | 2/2017 | Bussio | |
| 9,617,722 | B2 | 4/2017 | Skinner et al. | |
| 9,631,339 | B2 | 4/2017 | Bussio | |
| 2004/0007512 | A1 * | 1/2004 | Petersen | E03F 5/02 210/163 |
| 2004/0040221 | A1 * | 3/2004 | Airheart | E02D 29/12 52/20 |
| 2005/0002735 | A1 | 1/2005 | Peacock | |
| 2005/0006853 | A1 | 1/2005 | Neuhaus | |
| 2006/0208480 | A1 | 9/2006 | Happel et al. | |
| 2006/0219311 | A1 * | 10/2006 | Kiest, Jr. | F16L 55/1651 138/98 |
| 2007/0152440 | A1 | 7/2007 | Keyes | |
| 2007/0215783 | A1 | 9/2007 | Tzaig | |
| 2008/0286572 | A1 | 11/2008 | Hodgson | |
| 2011/0150570 | A1 | 6/2011 | Pickavance et al. | |
| 2012/0009020 | A1 | 1/2012 | Kiest, Jr. | |
| 2012/0037452 | A1 | 2/2012 | Copeland et al. | |
| 2012/0225975 | A1 | 9/2012 | Hodgson | |
| 2013/0130016 | A1 | 5/2013 | Hodgson | |
| 2014/0137508 | A1 | 5/2014 | Bussio | |
| 2014/0309333 | A1 | 10/2014 | Hodgson | |
| 2015/0023735 | A1 | 1/2015 | Eschenbrenner | |
| 2016/0017590 | A1 | 1/2016 | Shook | |
| 2016/0145848 | A1 | 5/2016 | Skinner et al. | |
| 2016/0168818 | A1 | 6/2016 | Harazim et al. | |
| 2017/0167127 | A1 * | 6/2017 | Skinner | E02D 29/125 |
| 2017/0260734 | A1 | 9/2017 | Skinner et al. | |

FOREIGN PATENT DOCUMENTS

| | | |
|---|---|---|
| DE | 2723579 | 11/1978 |
| DE | 3002161 | 7/1980 |
| DE | 36 37 412 | 5/1988 |
| DE | 10 2010 015 360 | 10/2011 |
| DE | 10 2012 220 814 | 5/2014 |
| EP | 0 740 024 | 10/1996 |

(56) References Cited

FOREIGN PATENT DOCUMENTS

| | | | | |
|---|---|---|---|---|
| EP | 1 880 829 | | 1/2008 | |
| FR | 2 701 500 | | 8/1994 | |
| FR | 2 806 430 | | 9/2001 | |
| FR | 2 886 710 | | 12/2006 | |
| FR | 3001241 | A1 * | 7/2014 | ..... B28B 7/168 |
| GB | 2 043 812 | | 10/1980 | |
| JP | 8-333763 | | 12/1996 | |
| JP | 10-140589 | | 5/1998 | |
| JP | 2007277857 | | 10/2007 | |
| KR | 2006-0071501 | | 6/2006 | |
| KR | 10 2007 0036101 | | 2/2007 | |
| WO | 91/18151 | | 11/1991 | |

OTHER PUBLICATIONS

Office Action dated Dec. 14, 2017 in corresponding U.S. Appl. No. 15/605,303.
Office Action dated Dec. 15, 2017 in corresponding U.S. Appl. No. 15/440,611.
EP Office Action Issued in corresponding European Patent Application No. 3221522, dated Aug. 21, 2018.

* cited by examiner

MANHOLE BASE ASSEMBLY WITH INTERNAL LINER AND METHOD OF MANUFACTURING SAME

CROSS-REFERENCE TO RELATED APPLICATIONS

This application is a divisional of U.S. patent application Ser. No. 15/605,303, filed May 25, 2017, which is a continuation-in-part of U.S. patent application Ser. No. 15/440,611 filed on Feb. 23, 2017, now U.S. Pat. No. 10,053,850, which is a continuation of U.S. patent application Ser. No. 14/947,615 filed on Nov. 20, 2015, now U.S. Pat. No. 9,617,722, which claims the benefit under Title 35, U.S.C. § 119(e) of U.S. Provisional Patent Application Ser. No. 62/082,391, filed on Nov. 20, 2014, all entitled MANHOLE BASE ASSEMBLY WITH INTERNAL LINER AND METHOD OF MANUFACTURING SAME. The entire disclosures of all of the aforementioned U.S. patent and U.S. patent applications are hereby expressly incorporated herein by reference.

BACKGROUND

1. Technical Field

The present disclosure relates to underground fluid transfer systems and, in particular, to a manhole base assembly forming a junction between underground pipes and a manhole.

2. Description of the Related Art

Underground pipe systems are used to convey fluids in, e.g., municipal waterworks systems, sewage treatment systems, and the like. In order to provide access to underground piping systems for inspection, maintenance and repair, manholes placed at a street level grade can be opened to reveal manhole risers which descend to a manhole base. The manhole base typically forms a junction between two or more pipes of the underground piping system, as well as the upwardly-extending risers.

Existing manhole base structures are formed as precast cylindrical structures, with additional cylindrical and/or cone shaped risers which may be attached to the manhole base to traverse a vertical distance between the buried manhole base and the street grade above. At street grade, a manhole frame and cover may be used to provide access to the riser structures and manhole base.

In addition to providing access via manholes, manhole bases may be used when a pipeline needs to change direction and/or elevation along its underground run. In this application, the manhole base structure may contain two or more non-coaxial openings for connections to pipes. Seals may be used between the manhole base structure and the adjacent attached pipes to provide fluid-tight seals at the junctions. In order to facilitate flow of fluid between the two pipes through the manhole base structure, interior fluid channels or "inverts" may be provided within the manhole base, extending between the pipe openings.

Existing manhole base structures are cast as relatively large, cylindrical concrete castings. Fluid flow channels may be custom formed using large coring machines to drill holes in the sides of the cast concrete structures at desired locations. Alternatively, the cylindrical concrete castings may be cast using individualized forms for each individual casting configuration. The forms are stripped from the castings after the concrete has set. Because the holes are bored through the cylindrical outer profile of the casting, seals are mounted along the interior perimeter of the holes after the holes are bored. Expansion bands and mechanisms may be used to engage seals in a fluid-tight relationship with the interior surfaces of the bored holes. However, in some cases, such as for very large diameter openings, expansion mechanisms may not be a viable option, particularly due to the cylindrical profile of the outer diameter of the cast manhole base.

Previous efforts have focused on the creation of a manhole base structure which is cast in individualized form sets corresponding to the individual base structure geometry. These individualized form sets provide a non-cylindrical outer surface to the finished casting, and in particular, planar surfaces are provided for the pipe aperture openings into the base structure fluid channel. This arrangement may use pipe seals cast into the concrete material adjacent the pipe aperture, which obviates the need to bore holes in the manhole base after casting, as well as for the use of separate seals and expansion bands typically associated with standard cylindrical manhole base structures as described above. Individualized form sets are not amenable to variable geometry (e.g., elevation and angle) of the pipe apertures, and therefore separate forms are used for each desired geometrical arrangement of the base structure. Thus, individualized form sets associated with such non-cylindrical manhole structures are expensive, numerous to inventory, and not compatible with pre-existing casting equipment.

What is needed is an improvement over the foregoing.

SUMMARY

The present disclosure provides a manhole base assembly and a method for making the same in which a non-cylindrical, low-volume concrete base is fully lined to protect the concrete against chemical and physical attack while in service. This lined concrete manhole base assembly may be readily produced using a modular manhole form assembly which can be configured for a wide variety of geometrical configurations compatible with, e.g., varying pipe angles, elevations and sizes. The form assembly is configurable to provide any desired angle and elevation for the pipe apertures to interface with various underground systems, and can be formed on-site to facilitate compatibility with existing structures. The assembly provides for flexible, modular construction of a wide variety of lined manhole base assemblies at minimal cost, reduced concrete consumption and reduced operational complexity. The modular nature of the production form assembly also facilitates reduced inventory requirements when various manhole base assembly geometries are needed.

In one form thereof, the present disclosure provides a liner for use in casting within a cast manhole structure having a cast base, the liner including: an entry aperture defining an entry aperture diameter; a first side wall having a first pipe aperture sized and positioned to be aligned with a first side opening of the cast base; a second side wall having a second pipe aperture sized and positioned to be aligned with a second side opening of the cast base; and a liner top wall disposed radially outwardly of said entry aperture diameter and extending between said entry aperture and said first side wall; a flow channel extending between said first and second pipe apertures and in fluid communication with the entry aperture; and a liner lid received in the entry aperture. The liner lid includes a first lid portion sealingly engaged with a sidewall of the entry aperture, and a second lid portion coupled to the first lid portion and moveable between a closed configuration in which the second lid portion is sealingly engaged with the entry aperture and an open configuration in which the second lid portion is disengaged from the entry aperture.

In another form thereof, the present disclosure provides a pre-casting assembly for production of a manhole base assembly having a cast base, the pre-casting assembly including a liner having an entry aperture defining an entry aperture diameter; a first side wall having a first pipe aperture sized and positioned to be aligned with a first side opening of the cast base; a second side wall having a second pipe aperture sized and positioned to be aligned with a second side opening of the cast base; a liner top wall disposed radially outwardly of said entry aperture diameter and extending between said entry aperture and said first side wall; and a flow channel extending between said first and second pipe apertures and in fluid communication with the entry aperture. The assembly further includes: a plurality of aperture supports sized to fit in the first pipe aperture and the second pipe aperture respectively; a first forming plate secured to one of the plurality of aperture supports and adjacent to the first pipe aperture, the first forming plate having a back edge and an opposing front edge; a second forming plate secured to another one of the plurality of aperture supports and adjacent to the second pipe aperture, the second forming plate having a back edge and an opposing front edge; a back wall extending partially around the liner from the back edge of the first forming plate to the back edge of the second forming plate; and a front wall extending partially around the liner from the front edge of the first forming plate to the front edge of the second forming plate. The first forming plate, the second forming plate, the back wall, the front wall and the liner form a concrete forming cavity, the liner received in the concrete forming cavity with the entry aperture forming an open upper end of the pre-casting assembly.

In yet another form thereof, the present disclosure provides a pre-casting assembly for production of a manhole base assembly having a cast base, the pre-casting assembly including a liner having: an entry aperture defining an entry aperture diameter; a first side wall having a first pipe aperture sized and positioned to be aligned with a first side opening of the cast base; a second side wall having a second pipe aperture sized and positioned to be aligned with a second side opening of the cast base; a liner top wall disposed radially outwardly of said entry aperture diameter and extending between said entry aperture and said first side wall; and a flow channel extending between said first and second pipe apertures and in fluid communication with the entry aperture. The assembly further includes: a plurality of aperture supports sized to fit in the first pipe aperture and the second pipe aperture respectively; a first forming plate secured to one of the plurality of aperture supports and adjacent to the first pipe aperture, the first forming plate having a back edge and an opposing front edge; a second forming plate secured to another one of the plurality of aperture supports and adjacent to the second pipe aperture, the second forming plate having a back edge and an opposing front edge; a back wall extending partially around the liner from the back edge of the first forming plate to the back edge of the second forming plate; and a front wall extending partially around the liner from the front edge of the first forming plate to the front edge of the second forming plate. The first forming plate, the second forming plate, the back wall, the front wall and the liner form a concrete forming cavity, the liner received in the concrete forming cavity with the entry aperture opening downwardly toward an underlying support surface.

Any combination of the aforementioned features may be utilized in accordance with the present disclosure.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings. These above-mentioned and other features of the invention may be used in any combination or permutation.

Corresponding reference characters indicate corresponding parts throughout the several views. The exemplifications set out herein illustrates are exemplary embodiments of the invention, and such exemplifications are not to be construed as limiting the scope of the invention in any manner.

DETAILED DESCRIPTION

1. Introduction

Figure 1:
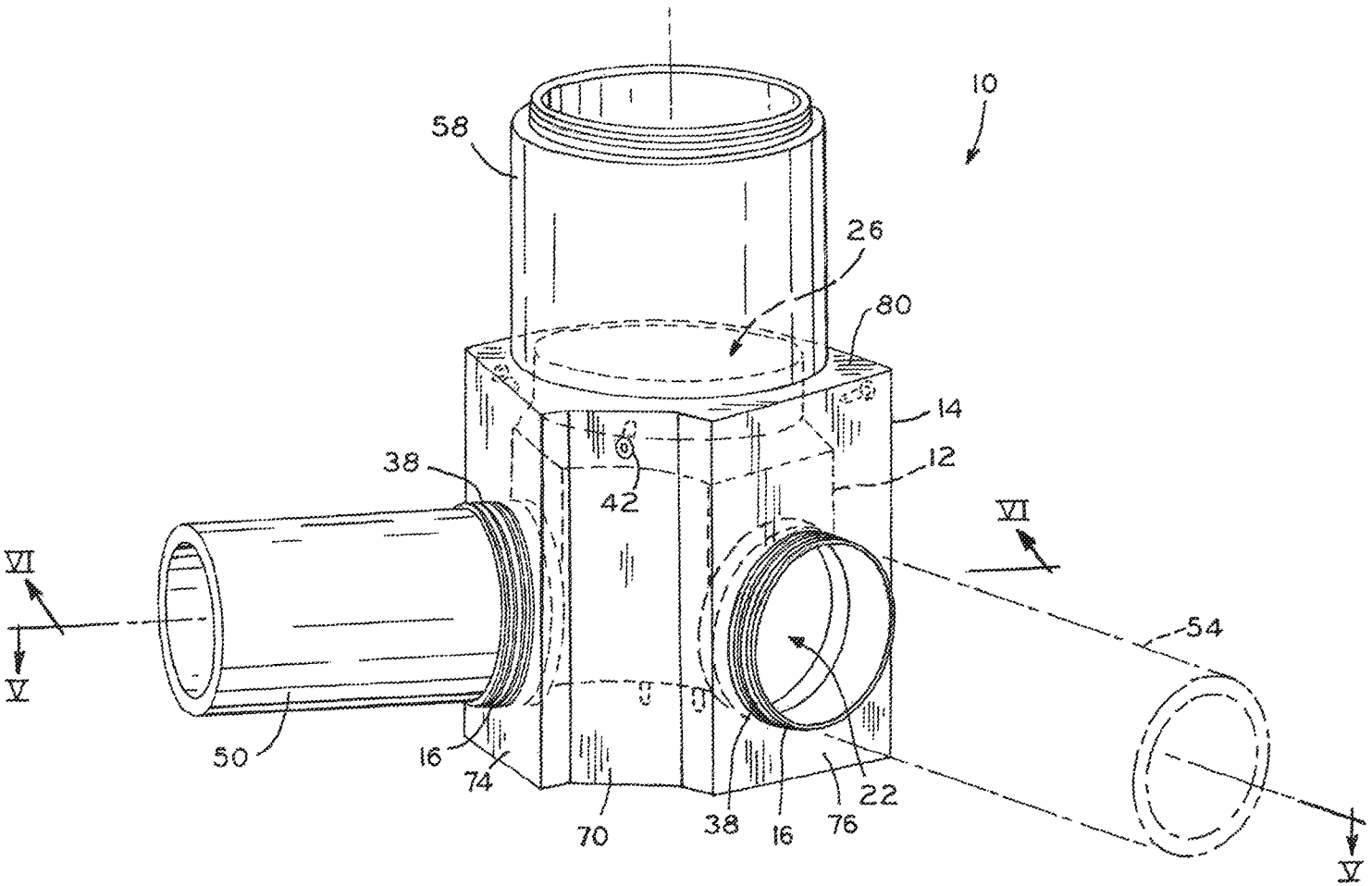
FIG. 1 is a perspective view of a manhole base assembly in accordance with the present disclosure, showing connections to manhole and piping structures.

The present disclosure provides a durable, compact and relatively lightweight manhole base assembly 10, shown in FIG. 1, which includes a liner 12 at least partially surrounded by concrete base 14, with gaskets 16 cast into the concrete material of concrete base 14 to form fluid-tight and long lasting junctions between manhole base assembly 10 and first and second underground pipes 50, 54. Manhole base assembly 10 is designed for use in a subterranean fluid conveyance system, such as municipal sanitary sewers and waterworks accessible by a grade-level manhole. To this end, manhole base assembly 10 is designed to receive one or more risers 58 at a top surface of concrete base 14 in order to provide a fluid-tight pathway from a grade-level manhole access opening (not shown) to entry aperture 26 of liner 12. In other embodiments, such as when concrete base 14 is large in size, for example, risers 58 may not be needed. Various details and structures of manhole base assembly 10 are illustrated in, e.g., FIGS. 1-10 and 42-45A, and described in further detail below.

Figure 11:
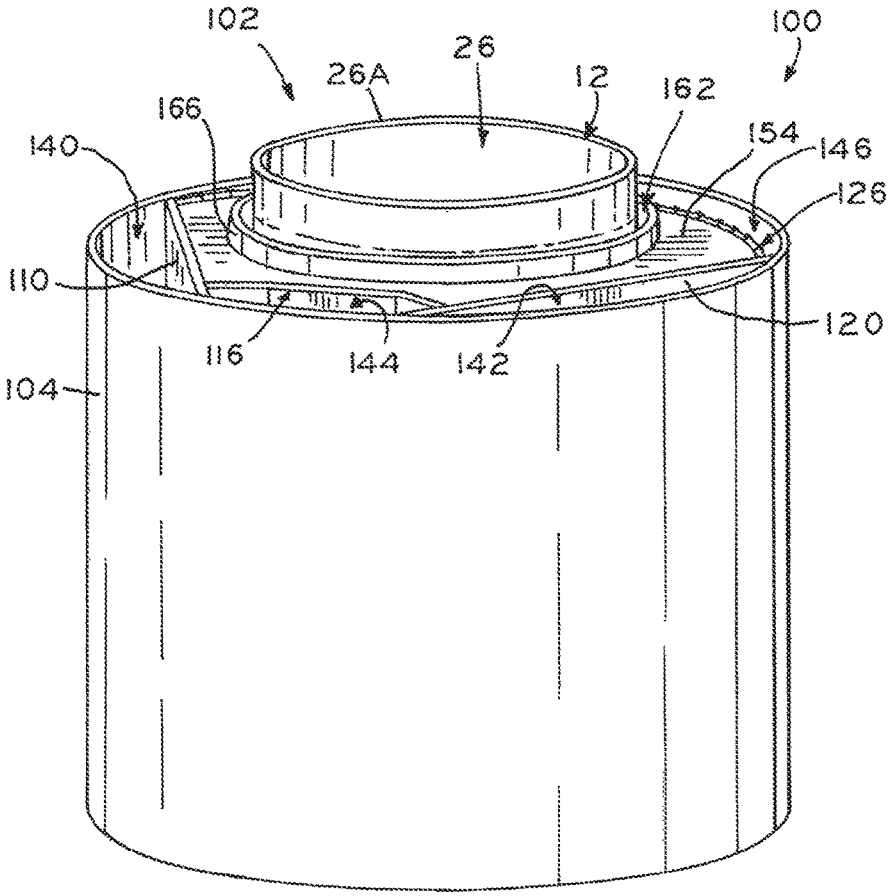
FIG. 11 is a perspective view of a manhole form assembly for production of the manhole base assembly shown in FIG. 1.

The present disclosure also provides manhole form assembly 100, shown in FIG. 11, and an associated method for the production of manhole base assembly 10. Generally speaking, manhole form assembly 100 includes pre-casting assembly 102 which may be assembled and, optionally, lowered into casting jacket 104. In an exemplary embodiment, pre-casting assembly 102 is sized to fit within an industry-standard cylindrical casting jacket 104 in order to facilitate production of manhole base assembly 10 using existing infrastructure already in service for the production of standard cylindrical manhole base assemblies. Of course, it is contemplated that pre-casting assembly 102 could also be used in conjunction with a casting jacket 104 having various sizes and profiles, including non-cylindrical profiles, and that pre-casting assembly 102 can be used as a stand-alone casting structure independent of casting jacket 104. Various structures and details of manhole form assembly 100 are illustrated in FIGS. 11-23, and are further described below.

Various features of manhole base assembly 10 and associated structures and methods for making the same, including manhole form assembly 100 and liner form assembly 200, are described below. The embodiments disclosed below are not intended to be exhaustive or limit the invention to the precise forms disclosed in the following detailed description. Rather, the embodiment is chosen and described so that others skilled in the art may utilize its teachings. Moreover, it is appreciated that a manhole base assembly made in accordance with the present disclosure may include or be produced by any one of the following features or any combination of the following features, and may exclude any number of the following features as required or desired for a particular application.

2. Manhole Base Assembly

Figure 3:
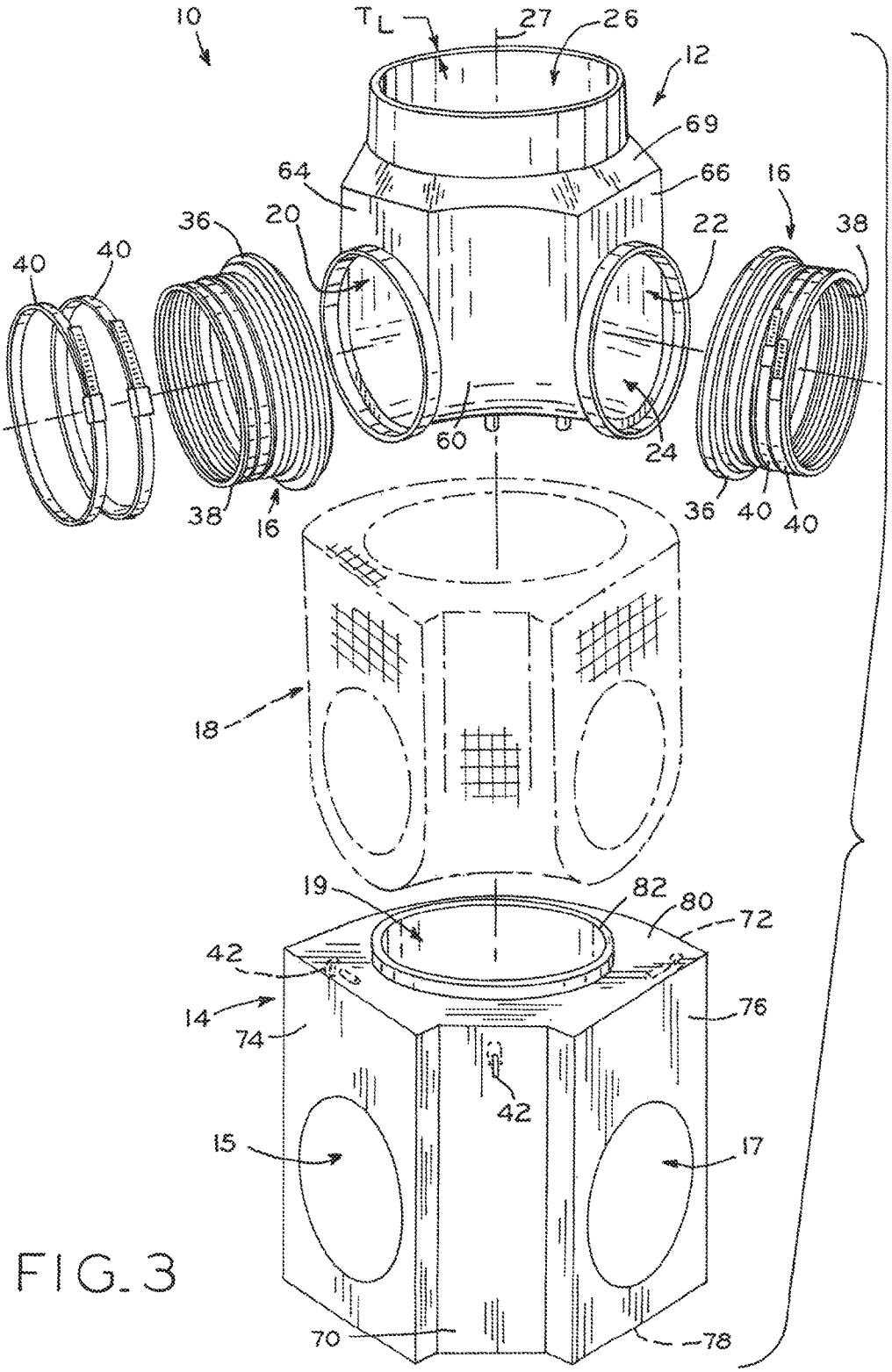
FIG. 3 is a perspective, exploded view of the manhole base assembly shown in FIG. 1.

FIG. 3 illustrates a perspective exploded view of manhole base assembly 10, with constituent parts illustrated separately. Manhole base assembly 10 includes liner 12, concrete base 14, a plurality of gaskets 16 with associated sealing bands 40, and optionally a cage or mesh of reinforcement rods 18 which serve to reinforce concrete base 14 and aid in fixation of liner 12 within concrete base 14. The exploded view of FIG. 3 is provided for purposes of illustration, it being appreciated that manhole base assembly 10 is not assembled or disassembled in the manner illustrated by FIG. 3. Rather, as described in further detail below, reinforcement rods 18 (such as reinforcement assembly 266, FIG. 39) are assembled around an outer surface of liner 12, and concrete base 14 is then cast around liner 12 and rods 18 to permanently join the structures together. In addition, anchoring portions 36 of gaskets 16 are cast into the material of concrete base 14, while connecting/sealing portions 38 of gaskets 16 extend outwardly from their respective anchoring portions 36 to seal against an outer surface of respective pipes 50, 54 as shown in FIG. 1, via sealing bands 40, which may be external take-down clamps, for example.

Liner 12 may be a monolithic polymer or plastic component uniform in cross section and made from a suitable polymeric material such as polyethylene, high density polyethylene (HDPE), acrylonitrile butadiene styrene (ABS) plastics, and other thermoset engineered resins. In another embodiment, liner 12 may be a composite polymer or plastic component including a smooth inner surface layer, such as a polymer inner layer chosen for resistance to hydrogen sulfide, bonded to a strong outer structural layer, such as fiberglass. Such a liner 12 may be formed from fiberglass sprayed over a removable core, such as liner form assembly 200 as described in detail below. In another embodiment, liner 12 is a molded component, such as an injection or rotationally molded component which may have a substantially uniform thickness $T_L$ throughout its profile. Generally speaking, the thickness $T_L$ for a given liner material is set to provide sufficient strength to withstand the expected loads encountered during the concrete casting process (described further below) and/or during service in a piping system, with an appropriate margin of safety.

In one exemplary embodiment, liner 12 is formed from high-strength polymer or fiberglass material having thickness $T_L$ between ⅛ inch and ½ inch depending on the overall size of manhole base 10, it being understood that an increase in size is associated with an increase in expected load during production and service of manhole base assembly 10. Exemplary high-strength polymer materials are available from Mirteq, Inc. of Fort Wayne, Ind. and described in, e.g., U.S. Pat. No. 8,153,200 and U.S. Patent Application Publication Nos. 2012/0225975, 2013/0130016 and 2014/0309333. In some instances, such high-strength polymer materials may be used as a coating or covering over a substrate formed from another polymer.

In another exemplary embodiment, liner 12 is formed from fiberglass and has thickness $T_L$ between ¼ inch and ¾ inch, again depending on the overall size of manhole base 10. Another exemplary material for liner 12 may include polyvinyl chloride (PVC) having thickness $T_L$ of about ¼ inch, which may be molded or vacuum formed into the illustrated configuration. Still other exemplary materials for liner 12 include polyethylene, high density polyethylene (HDPE), acrylonitrile butadiene styrene (ABS) plastics, and other thermoset engineered resins. In certain exemplary embodiments, the material of liner 12 may be chosen based on compatibility with the material of pipes 50 and/or 54. For example, where pipes 50 and/or 54 are formed from a polymer material such as HDPE, PVC or polypropylene, the material for liner 12 may be chosen to provide corresponding service characteristics such as longevity, fluid flow performance characteristics, resistance to chemical attack, etc.

Liner 12 may also be formed from multiple constituent components which are molded or otherwise formed separately and then joined to one another to form the final liner 12. In one embodiment, for example, the aperture portion 26A of liner 12 is formed from an appropriately-sized rectangular strip or sheet which is folded into a cylindrical shape (see, e.g., FIG. 20). The remainder of liner 12 can be molded. The cylindrical entry aperture portion can then be welded or otherwise affixed to the remainder to form liner 12. Particularly in the case of relatively larger manhole base assemblies 10, such a two-piece structure facilitates transport of liner 12 to a location at or near service site (e.g., by enabling the use of a standard enclosed van rather than a dedicated and/or oversize flatbed truck). The final assembly of liner 12 and forming of concrete base 14, as further described below, may then be carried out at the destination to minimize travel of the large finished assembly 10. As further described in detail below with respect to formation of liner 12 of liner form assembly 200, such a multi-piece arrangement may also be used to form an inner layer of liner 12 prior to formation of a monolithic outer layer.

Liner 12 includes first pipe aperture 20 and second pipe aperture 22 defining a flow channel 24 passing through liner 12 between apertures 20 and 22. Entry aperture 26 is disposed at the top portion of liner 12, above first and second pipe apertures 20 and 22, and descends into the cavity of liner 12 in fluid communication with flow channel 24. As best seen in FIG. 3, concrete base 14 includes corresponding first and second pipe openings 15, 17 positioned below upper opening 19 after formation around liner 12. Openings 15, 17, 19 align with apertures 20, 22, 26 respectively. That is, side opening 15 defines an axis that is coincident with the axis defined by pipe aperture 20, i.e., flow axis 52 (FIG. 4) forms the central axis for both opening 15 and aperture 20. Similarly, the axis of pipe opening 17 is coincident with aperture 22 and flow axis 56, and upper opening is coincident with entry aperture 26 and flow longitudinal axis 27.

Figure 4:
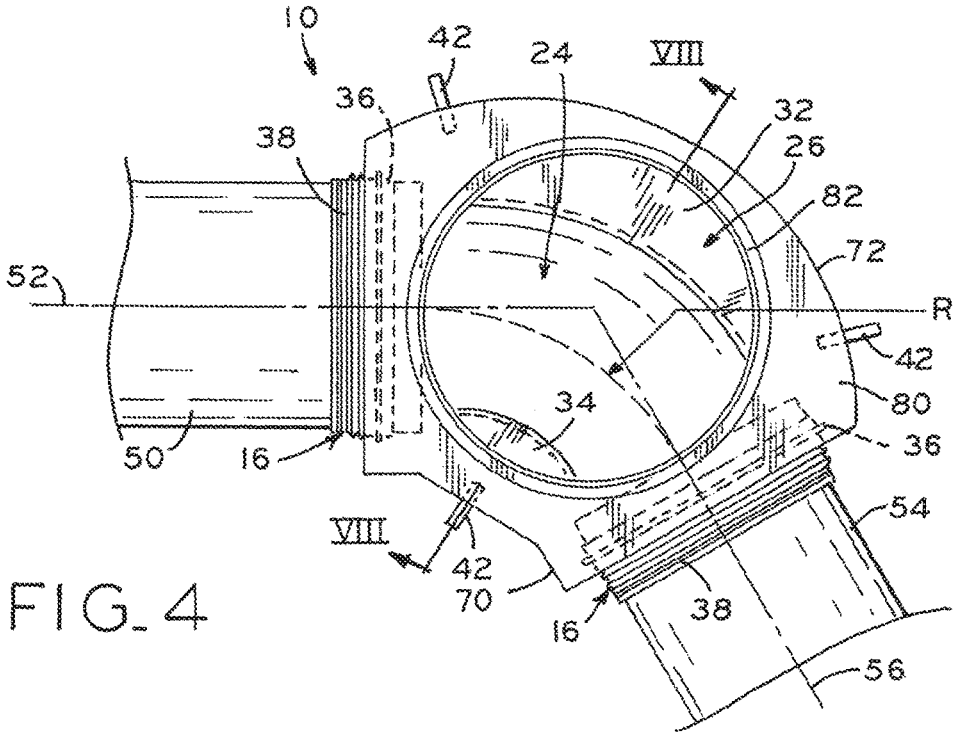
FIG. 4 is a top plan view of the manhole base assembly shown in FIG. 1.
Figure 5:
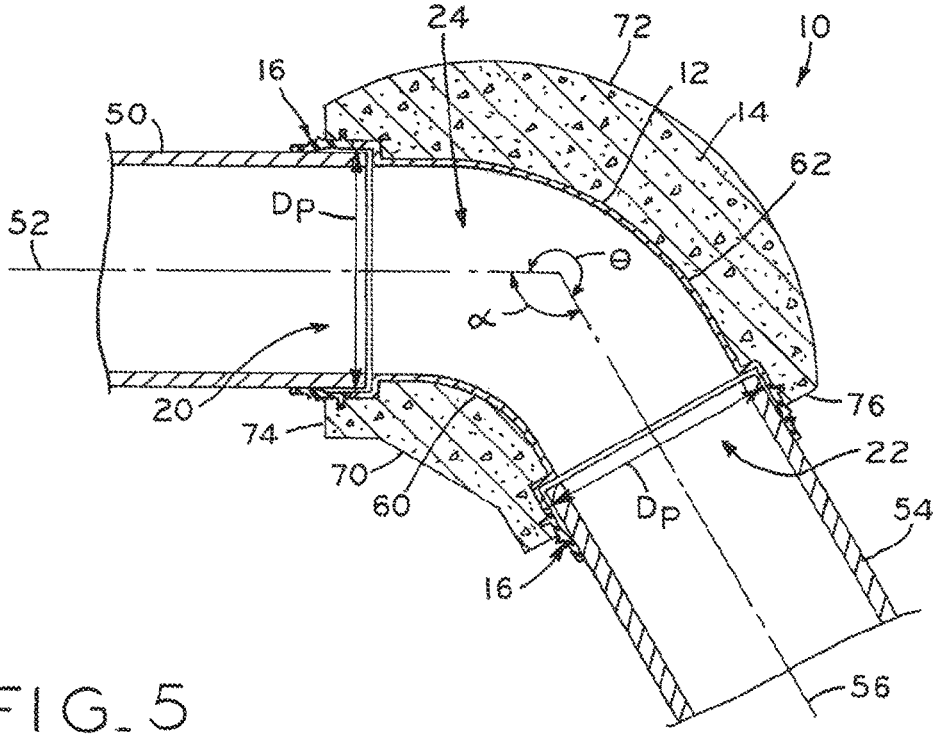
FIG. 5 is a top plan, section view of the manhole base assembly shown in FIG. 1, taken along the line V-V of FIG. 1.

Turning to FIG. 5, first and second pipe apertures 20 and 22 define first and second pipe flow axes 52 and 56, respectively. In the illustrated embodiment, axes 52, 56 define obtuse angle $\alpha$ as viewed from above, i.e., through entry aperture 26 (FIG. 4), while a corresponding reflex angle $\theta$ explementary to obtuse angle $\alpha$ is formed at the other side of axes 52, 56. In the illustrated embodiment, angle $\alpha$ is approximately 120° and reflex angle $\theta$ is approximately 240°. However, it is contemplated that liner 12, concrete base 14 and their associated structures may be formed with any angle $\alpha$, including any acute or obtuse angle. For purposes of the present disclosure, angle $\alpha$ is considered to open towards front walls 60, 70 of liner 12 and concrete base 14, respectively and, conversely, reflex angle $\theta$ opens or points towards back walls 62, 72 of liner 12 and base 14. In addition to the illustrated arrangement, angle $\alpha$ may be a straight angle (i.e., 180°) and angle $\theta$ may therefore also be a straight angle. Such a straight-angle configuration may be used, e.g., as a box culvert for passage of water under a roadway or railway, and may or may not include entry aperture 26.

In addition, in some configurations, more than two pipe apertures may be provided, such that three or more angles are formed by three or more corresponding longitudinal flow axes through the various apertures. For simplicity and conciseness the 120° arrangement illustrated in the present figures will be the sole arrangement described further below. The radius of curvature R defined by flow channel 24, which is the radius of the central flow path through the channel 24 as shown in FIG. 4, gradually makes the transition between pipe flow axes 52 and 56. An appropriate nominal value for radius R of flow channel 24 may be ascertained using fluid mechanics analysis, with the diameter of pipe apertures 20, 22, expectations of flow rate through channel 24 during service, and the nominal value of angle $\theta$ among the variables contributing to the appropriateness of a particular nominal value for radius R. In some exemplary embodiments, the radius is at least equal to the radius of apertures 20, 22, and may be about equal to the diameter of apertures 20, 22.

Turning back to FIG. 3, liner 12 includes a pair of substantially planar and vertical side walls 64, 66 through which pipe apertures 20, 22 pass, respectively. These planar side walls 64, 66 facilitate the provision of the cylindrical, ring-shaped aperture portions 20A and 22A, which extend perpendicularly away from side walls 64, 66 respectively as illustrated. The planarity of side walls 64, 66 in turn facilitate the creation of substantially planar side walls 74, 76 when concrete base 14 is formed around liner 12. In an exemplary embodiment, side walls 64, 66 and side walls 74, 76 each define a respective plane which is substantially parallel to longitudinal axis 27 of entry aperture 26, such that side walls 64, 66 and 74, 76 each extend substantially vertically when an installed, service configuration.

Side walls 64, 66 are positioned radially outward from the outer diameter of entry aperture portion 26A, as illustrated in FIG. 3. Top wall 69 is provided to span the gap between the outer periphery of entry aperture portion 26A and side walls 64, 66, thereby enclosing the resulting lateral space therebetween. As described in further detail below, the planarity and vertical orientation of side walls 74, 76 of base 14 facilitates the use of cast-in gaskets 16 for durable fluid-tight sealing between manhole base assembly 10 and pipes 50, 54 (FIG. 1).

Figure 6:
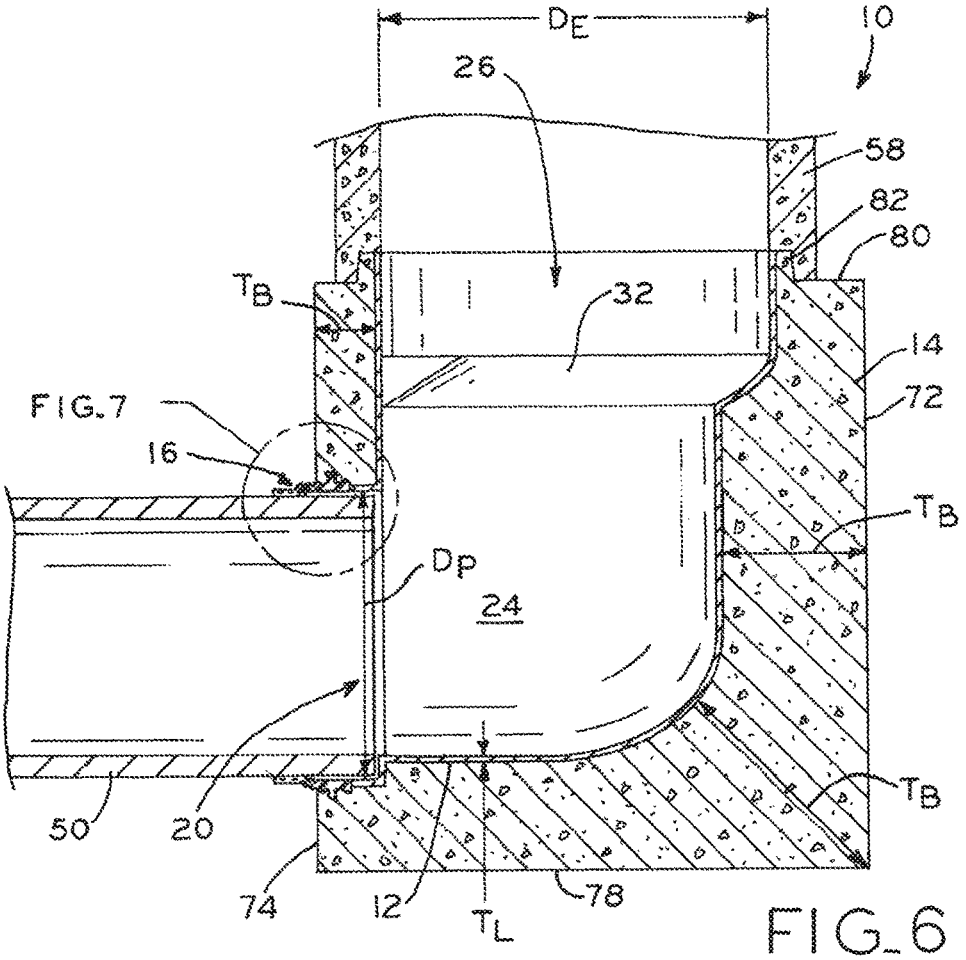
FIG. 6 is an elevation, cross-section view of the manhole base assembly shown in FIG. 1, taken along the line VI-VI of FIG. 1.
Figure 8:
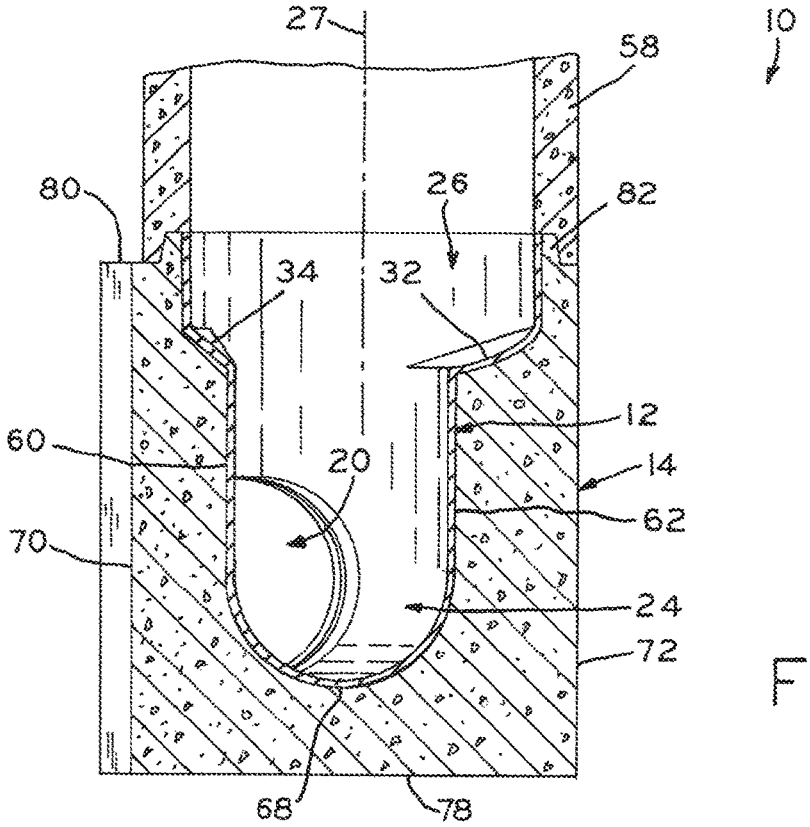
FIG. 8 is an elevation, cross-section view of the manhole base assembly shown in FIG. 1, taken along the line VIII-VIII of FIG. 4.
Figure 9:
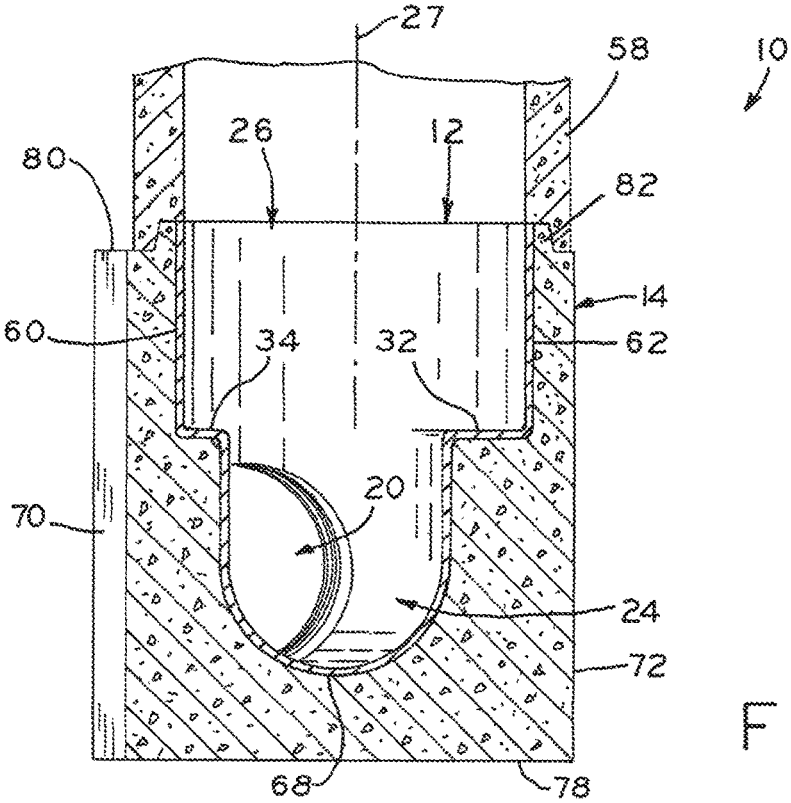
FIG. 9 is another elevation, cross-section view of the manhole base assembly shown in FIG. 8, showing an alternative liner configuration.

Liner 12 also includes a generally tubular, substantially cylindrical entry aperture portion 26A defining longitudinal axis 27, as illustrated in FIG. 3. Entry aperture portion 26A has a diameter $D_E$ (FIG. 6) defining a cross-sectional area equal to or greater than the cross-sectional area of flow path 24 defined by diameter $D_P$ of pipe apertures 20, 22 (FIGS. 5 and 6). To accommodate for this size difference, the otherwise substantially vertical wall 60 of liner 12 tapers forwardly as shown in FIG. 8 (i.e., away from axis 27 and toward front wall 70) to meet entry aperture portion 26A. This forward taper forms a front benching structure 34 inside aperture 26, as shown in FIG. 4. Similarly, as shown in FIG. 8, the substantially vertical back wall 62 transitions to a rearward taper (i.e., away from axis 27 and toward back wall 72) to meet entry aperture portion 26A. The rearward taper of back wall 62 forms rear bench 32, as best seen in FIGS. 4 and 8. Rear and front benches 32, 34 may provide a substantially horizontal surface which provides purchase as a worker enters manhole base assembly 10, e.g., for installation, maintenance or repair tasks. In one exemplary embodiment shown in FIG. 9, rear bench 32 may be substantially horizontal in order to provide a standing or seating surface for a worker inside manhole base assembly 10, while front bench 34 may also be substantially horizontal to provide a standing or work surface. Owing to their location in the flow path of entry aperture 26, the "substantially horizontal" benches 32, 34 may have a slight inward angle to prevent accumulation of liquids or solids thereupon, such as a slope between 1 and 5 degrees towards flow path 24. Of course, any other suitable sloping or otherwise non-flat surface arrangement may be used as required or desired for a particular application.

As discussed herein, benching structures 32 and 34 may be monolithically formed together with the other portions of liner 12 as a single unit. In the above-described alternative embodiments with entry aperture portion 26A and the remainder of liner 12 formed as separate components, benching structures 32 and 34 may also be formed as separate structures. In particular, each bench 32, 34 may be formed as a sheet or plank which is interposed between the cylindrical entry aperture portion 26A and the remainder of liner 12, then affixed to both structures by, e.g., welding. In some embodiments, the sheet used for benching structures 32, 34 may protrude outwardly past the cylindrical outer surface of entry aperture 26A and into the surrounding concrete base 14 in order to provide additional fixation of liner 12 to base 14.

In an exemplary embodiment, diameter $D_E$ of entry aperture portion 26A is designed to be only slightly larger than diameter $D_P$ of first and second pipe apertures 20, 22. As described in detail below, the size differential between diameters $D_E$ and $D_P$ can be expressed by the ratio $D_E$:$D_P$. This ratio is maintained at a nominal value greater than 1 in order to allow passage of structures through entry aperture portion 26A and into pipe apertures 20, 22, such as pipe aperture plugs, vacuum testing plugs or other maintenance equipment as may be needed. However, maintaining the $D_E$:$D_P$ ratio close to 1 also minimizes the overall size of liner 12, as well as facilitating reduced concrete use in the finished manhole base assembly 10.

For example, in one particular exemplary embodiment, diameter $D_E$ of entry aperture portion 26A may be set at a maximum of 6 inches larger than diameter $D_P$ of pipe apertures 20, 22. Across a typical range of aperture sizes, such as between 24 and 60 inches for diameter $D_P$ and between 30 and 66 inches for diameter $D_E$, this size constraint results in the $D_E$:$D_P$ ratio ranging between 1.1 and 1.25. This ratio is sufficiently close to 1 to ensure that the overall footprint and concrete usage for manhole base assembly 10 is kept to a minimum, thereby increasing its overall production efficiency and field adaptability. In a typical field installation, for example, diameter $D_P$ of pipe apertures 20, 22 may be determined by the parameters of the larger system interfacing with manhole base assembly 10, e.g., minimum flow requirements of a sewage system. In such applications, industry standard pipe diameters $D_P$ may be as little as 24 inches, 30 inches or 36 inches and as large as 42 inches, 48 inches or 60 inches, or may be within any range defined by any pair of the foregoing values. By setting diameter $D_E$ at 6 inches larger than diameter $D_P$, diameter $D_E$ is as little as 30 inches, 36 inches or 42 inches and as large as 48 inches, 54 inches or 66 inches, or may be within any range defined by any pair of the foregoing values. Because diameter $D_E$ is only slightly larger than diameter $D_P$, the overall footprint and material usage needed for manhole base assembly 10 may be substantially lower than existing designs for a given pipe aperture diameter $D_P$, while still meeting or exceeding the fluid flow rates and fluid flow characteristics required for a particular application.

Figure 2:
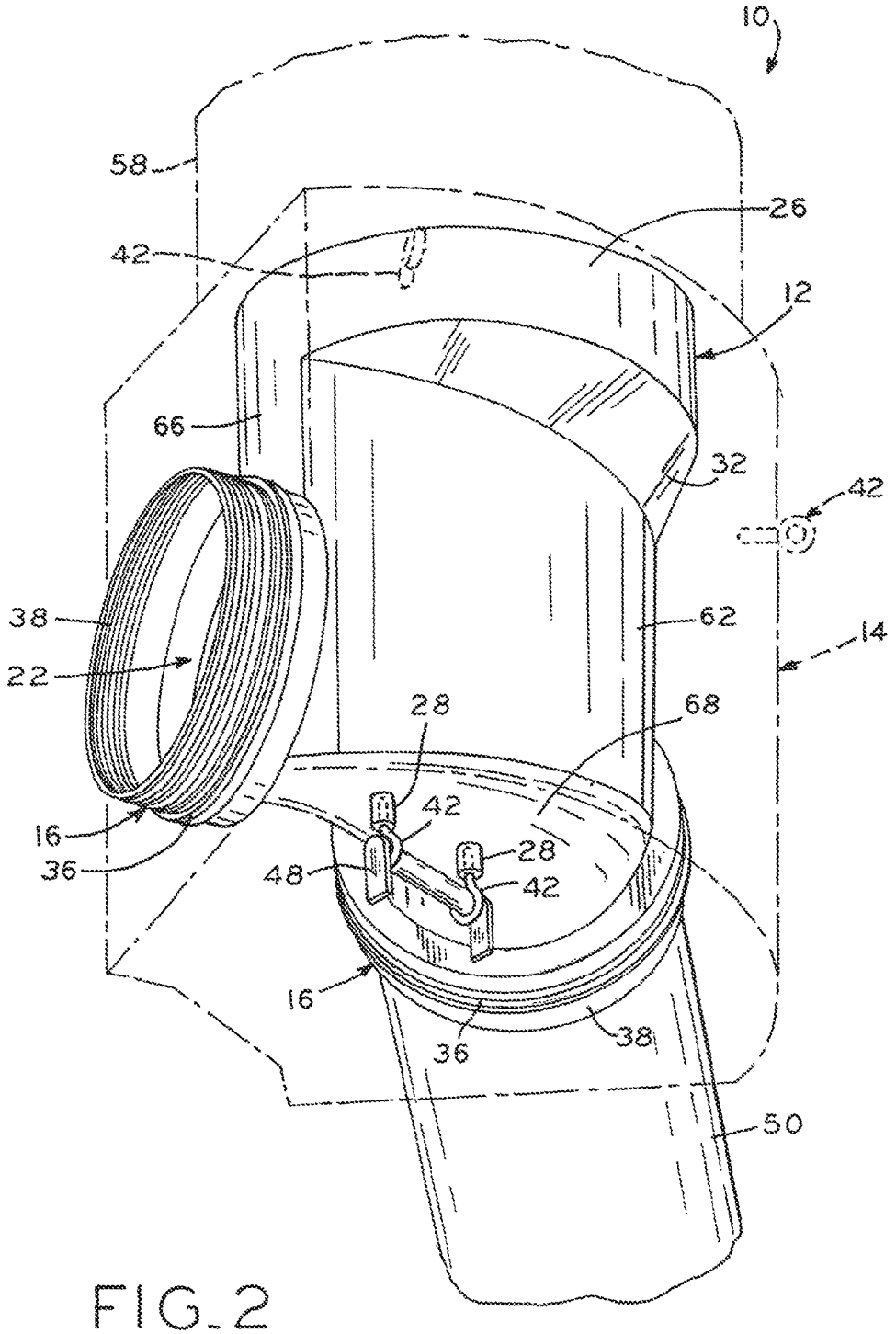
FIG. 2 is a bottom perspective view of the manhole base assembly shown in FIG. 1.
Figure 10:
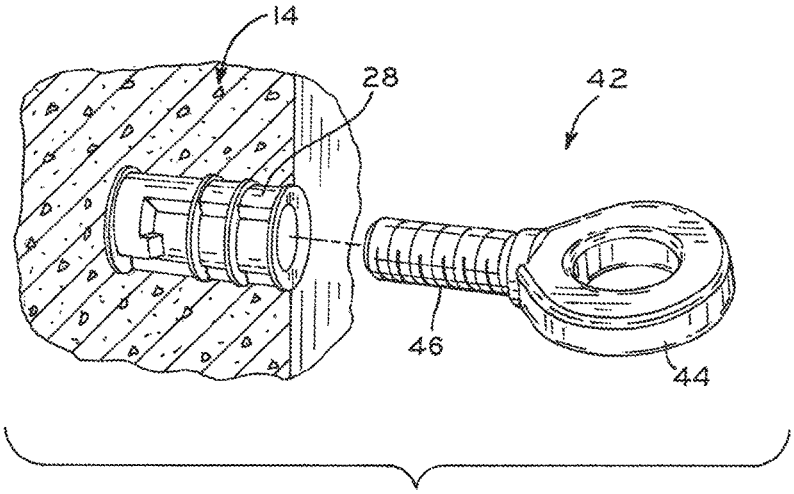
FIG. 10 is a perspective, exploded view illustrating an exemplary cast-in anchor point and anchor used in the manhole base assembly of FIG. 1.

Turning now to FIG. 2, anchor points 28 may be monolithically formed at bottom wall 68 of liner 12 as an integral part of liner 12. Anchor points 28 may be internally threaded to threadably receive anchors 42, as illustrated in FIGS. 2 and 10. As described in further detail below, anchor bar 48 may be fixed to anchors 42 in order to constrain movement of liner 12 during the production of manhole base assembly 10. Alternatively, other buoyancy mitigation structures may be used, such as anchors 340 and liner hold-down bar assembly 342 shown in FIGS. 21B-21D and described in detail below.

Turning again to FIG. 3, concrete base 14 has a non-cylindrical overall outer profile. For purposes of the present disclosure, the "overall outer profile" refers to the entire periphery of base 14 as viewed from above, i.e., as shown in FIGS. 4 and 5. Although a portion of the outer profile may be rounded or cylindrical, such as the rounded back wall 72 and/or an optionally rounded front wall 70 (produced by the pre-casting assembly 102 of FIG. 21, discussed below), other parts of the periphery including side walls 74 and 76 are non-cylindrical and, in the illustrated embodiment, substantially planar.

Referring to FIGS. 1 and 4, top wall 80 extends radially outwardly from entry aperture 26 in a similar fashion to the radial outward extension of top wall 69 of liner 12 as described herein. In an exemplary embodiment, top wall 80 is substantially planar as shown in FIG. 1, and more particularly is substantially perpendicular to longitudinal axis 27 of entry aperture portion 26A (FIG. 3). This arrangement allows a "column" of soil or other earth filler material to rest upon concrete base 14 when manhole assembly 10 is installed underground, further enhancing its stability and acting to inhibit any translation or other shifting of manhole assembly 10 while in service.

Advantageously, this non-cylindrical overall outer profile cooperates with the corresponding profile of liner 12 to provide a low variability among the various thicknesses $T_B$ of base 14, as illustrated in FIG. 6. For purposes of the present disclosure, a plurality of discrete base thicknesses $T_B$ can be measured at any point throughout the volume of base 14, and are each defined the shortest distance from a chosen point on the interior of base 14 (i.e., the portion of base 14 occupied by liner 12) to the adjacent exterior surface of base 14 (i.e., the opposing surface on one of the front, back, side, bottom or top walls 70, 72, 74, 76, 78 and 80). FIG. 6 illustrates three such thicknesses $T_B$ taken at various points in the cross-section of base 14.

If all thicknesses $T_B$ are taken in the aggregate throughout the volume of base 14, an average thickness of base 14 may be calculated. In an exemplary embodiment which minimizes the use of excess concrete for base 14 by implementing the illustrated non-cylindrical overall profile, any discrete thickness $T_B$ can be expected to vary from the average base thickness by no more than 100%. Stated another way, a thickness $T_B$ taken at any point in the volume of base 14 is less than double but more than half of the average thickness. In this way, base 14 defines an overall thickness with low variability throughout its volume.

At this point it should be noted that, in some embodiments, base 14 may include certain external features which are not part of the relevant volume of the non-cylindrical overall outer profile. For example, as illustrated in FIG. 3, concrete base 14 includes an upper annular riser ring 82 extending axially upwardly from top wall 80. As shown in FIG. 6, riser ring 82 provides a mating surface for a lower axial end of riser 58, and is not part of the overall volume defined by the non-cylindrical overall outer profile of base 14. Accordingly, base thickness $T_B$ is not calculated for riser ring 82 or any other such external features.

As shown in FIG. 3 and mentioned above, manhole base assembly 10 may include reinforcement rods 18 which, for purposes of the present disclosure, may be formed as a prefabricated or woven mesh or cage of material disposed at the outer surface of liner 12 and encased in concrete base 14. Reinforcement rods 18 are fixed to liner 12, such as by mechanical attachment to anchor points 28 (e.g., via anchor bar 48 as shown in FIG. 2), attachment to liner 12 by wrapping or jacketing liner 12 with rods 18, and/or adhesive attachment to one or more of walls 60, 62, 64, 66, 68, 69. In one embodiment, a series of spacers may be fixed to liner 12 at regular intervals, and rods 18 may be fastened to the spacers. Another series of spacers may be fixed to various surfaces of the manhole form assembly 100 (FIG. 11), with these additional spacers also fastened to rods 18. Such spacers may be fastened by welding or wire tying, for example. An exemplary embodiment showing the use and implementation of reinforcement rods 18, in the form of interconnected rebar struts 267, is shown in FIGS. 38-41 and described in detail below.

When concrete is poured into pre-casting assembly 102 to form manhole base assembly 10, as shown in FIG. 11 and further described below, reinforcement rods 18 become cast into the material of concrete base 14 so that liner 12 and base 14 are integrally joined to one another via reinforcement rods 18. Spacers, if used, maintain the desired spatial relationship of rods 18, liner 12 and adjacent surfaces of pre-casting assembly 102 (FIG. 11) during the pour operation.

In an exemplary embodiment, reinforcement rods 18 are made of rebar formed into a steel cage which at least partially surrounds liner 12, leaving openings for entry aperture 26 and pipe apertures 20, 22 as shown in FIG. 3. In other embodiments, rods 18 are a welded wire fabric material which may be cut into sections for various portions of the outer surface of liner 12, and these various sections can be tied together via steel wire ties. The type and amount of material used for rods 18 may be varied according to a particular application, and may be set to satisfy a particular requirement for an amount of steel reinforcement per unit volume of concrete used in concrete base 14.

Figure 38:
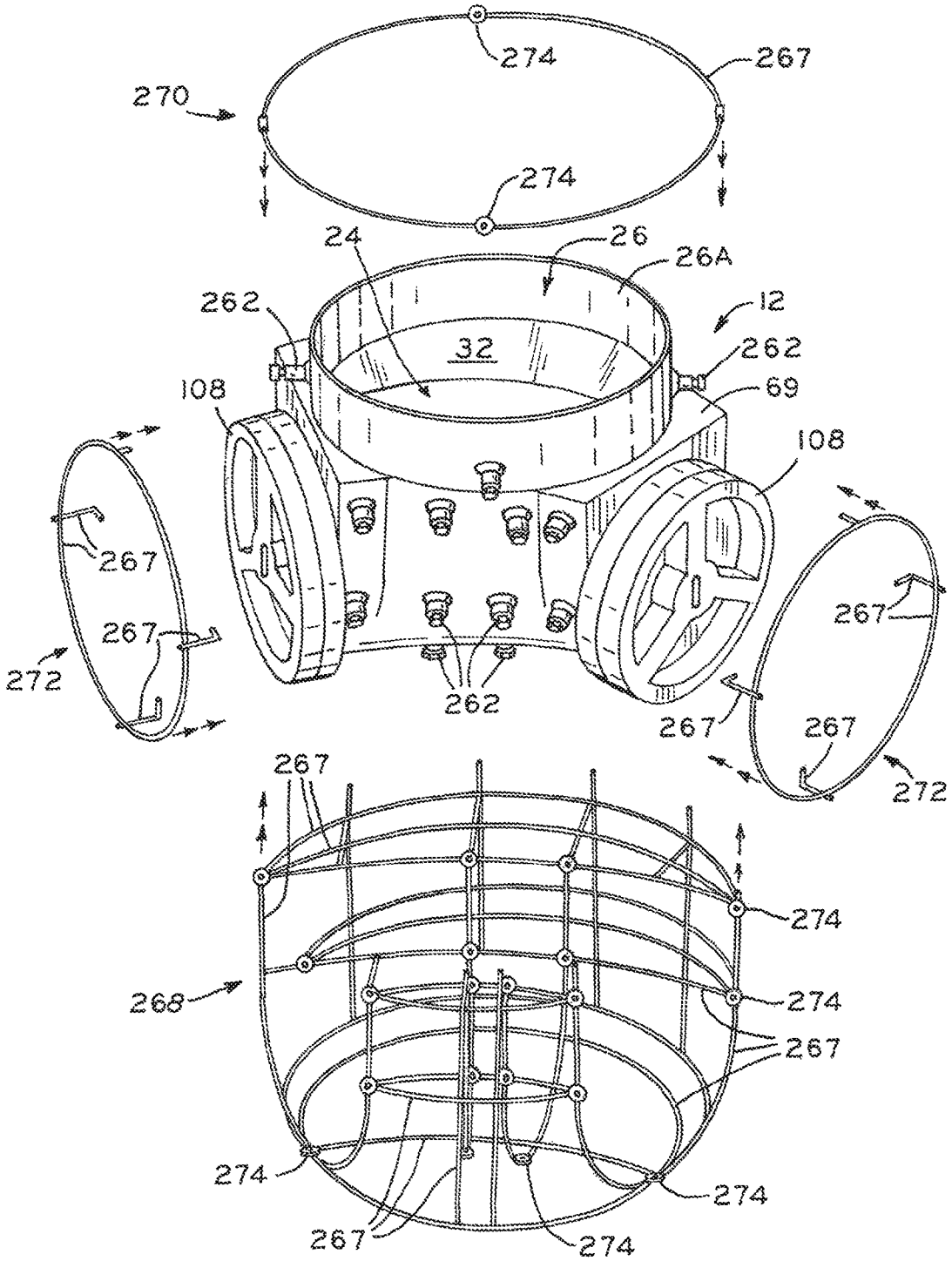
FIG. 38 is a perspective, exploded view of a liner made in accordance with the present disclosure and various rebar subassemblies of a rebar reinforcement assembly.

In an exemplary embodiment shown in FIGS. 38-40, reinforcement rods 18 take the form of reinforcement assembly 266 (FIGS. 39 and 40) affixed to liner 12 via a plurality of liner/rebar anchors 262 which are fixed to liner 12 during the fiberglass formation process, as described further below. As best seen in FIG. 38, reinforcement assembly 266 includes bottom rebar subassembly 268 having a plurality of individual rebar struts 267 interconnected to one another (e.g., by welding) and having a plurality of anchor washers 274 affixed thereto either along the extent of an individual strut 267 or at a junction between two or more struts 267.

Figure 36:
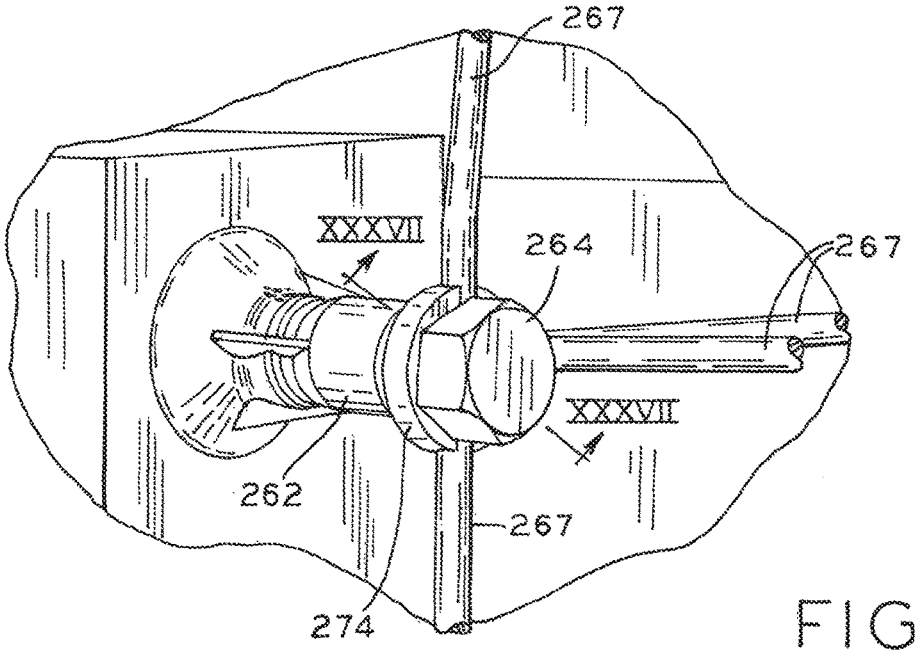
FIG. 36 is an enlarged, perspective view of a portion of FIG. 39, illustrating an anchor connecting a rebar cage to the liner.
Figure 37:
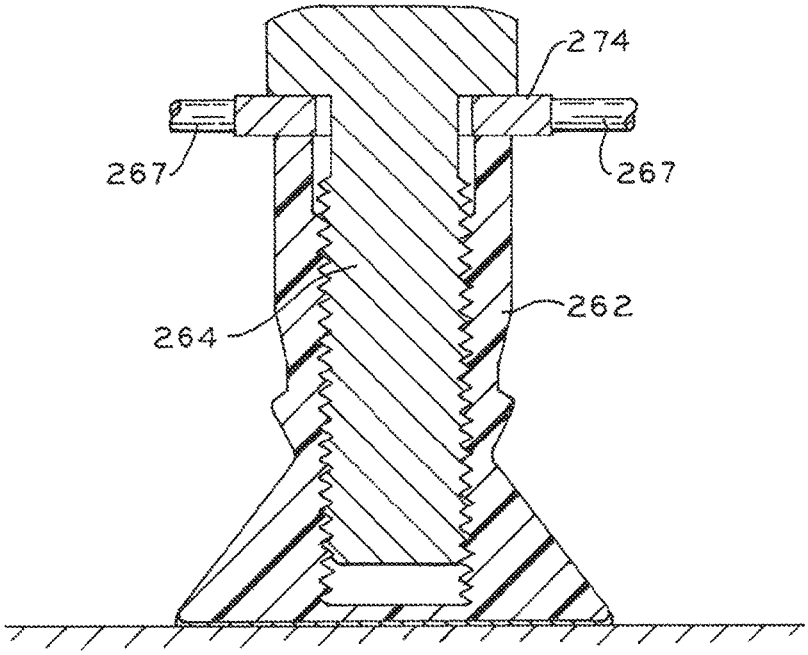
FIG. 37 is an elevation, cross section view of the anchor shown in FIG. 36 and associated components, taken along the line XXXVII-XXXVII of FIG. 36.
Figure 39:
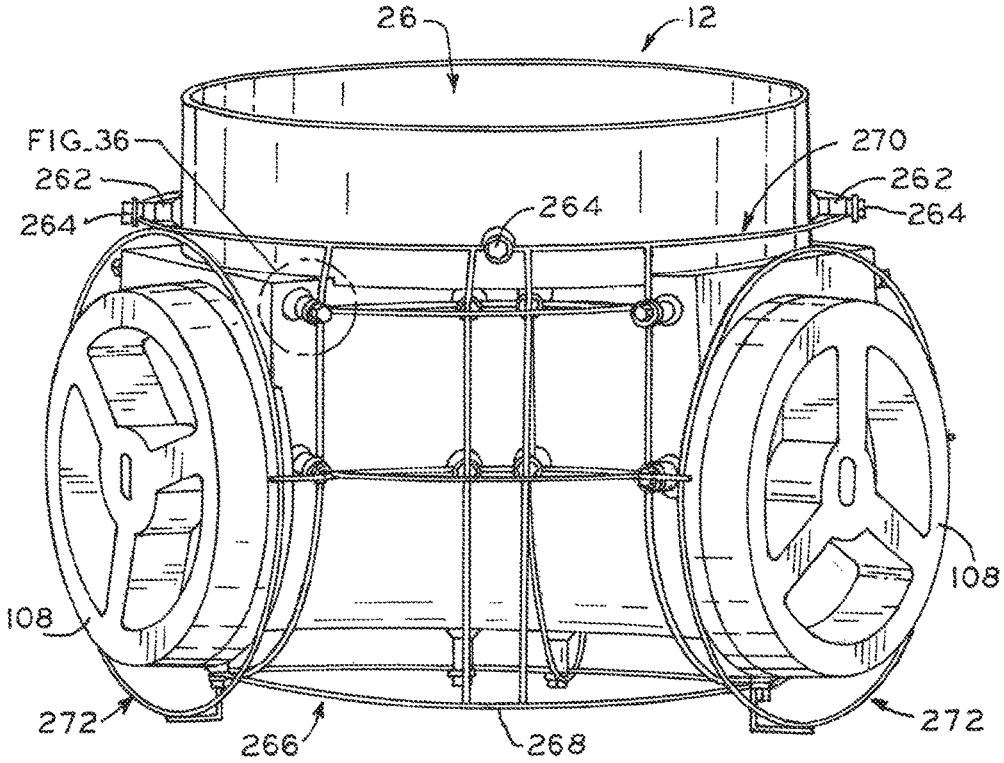
FIG. 39 is a perspective view of the liner and reinforcement assembly of FIG. 38, with the various rebar of assemblies installed and connected.
Figure 40:
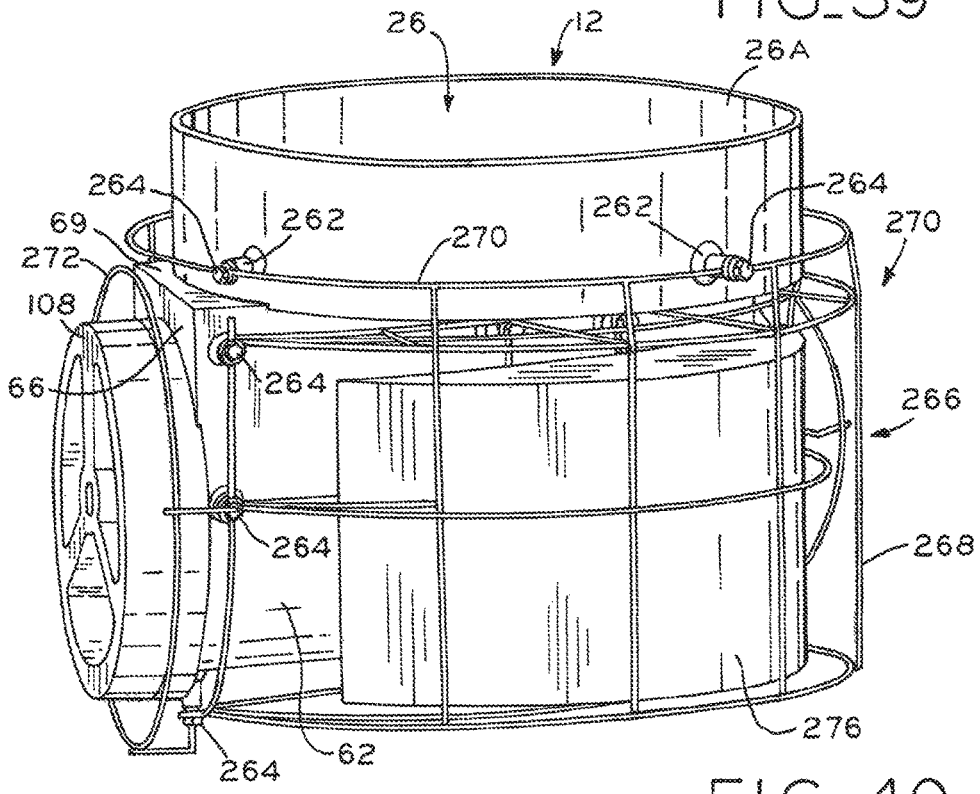
FIG. 40 is another perspective view of a rear portion of the liner and reinforcement assembly shown in FIG. 39, illustrating a concrete displacement wedge interposed between the liner and reinforcement assembly.

In its finished condition shown in FIG. 38, bottom rebar assembly 268 forms a generally cup-shaped structure into which liner 12 may be received as shown in FIGS. 39 and 40. When so received, anchor washers 274 align with respective liner/rebar anchors 262 fixed to liner 12, such that anchor bolts 264 may be passed through each washer 274 and threadably engaged with anchor 262, as shown in FIGS. 36 and 37. In the illustrated embodiment, bolt 264 is used to securely abut washer 274 to the axial outer surface of anchor 262. Bolt 264 is securely tightened without bottoming against the end of the blind bore formed within anchor 262, which ensures the abutting connection between washer 274 and anchor 262 remains firm without compromising the integrity of the glassed-in connection between anchor 262 and liner 12 as described herein. In an exemplary embodiment, anchor 262 is made from a nylon material and includes a nominal threaded bore sized to receive a correspondingly threaded bolt 264. Thread forms may be, for example, ½-inch threads, 1-inch threads, or any thread size as required or desired for a particular application.

With bottom rebar assembly 268 fixed to liner 12, entry aperture rebar assembly 270 may be lowered over entry aperture portion 26A and affixed to bottom rebar subassembly 268 (e.g., by welding) and to liner 12 by bolting to anchor 262 via washers 274. Similarly, pipe aperture rebar subassemblies 272 may be passed over aperture supports 108 and secured to bottom rebar subassembly 268 and/or entry aperture rebar subassembly 270 (e.g., by welding). In the illustrated embodiment of FIG. 38, aperture subassemblies 270, 272 include a strut 267 formed into a circle, and may further include connector struts 267 for assembly to liner 12 and welding to the larger reinforcement assembly 266.

Figure 41:
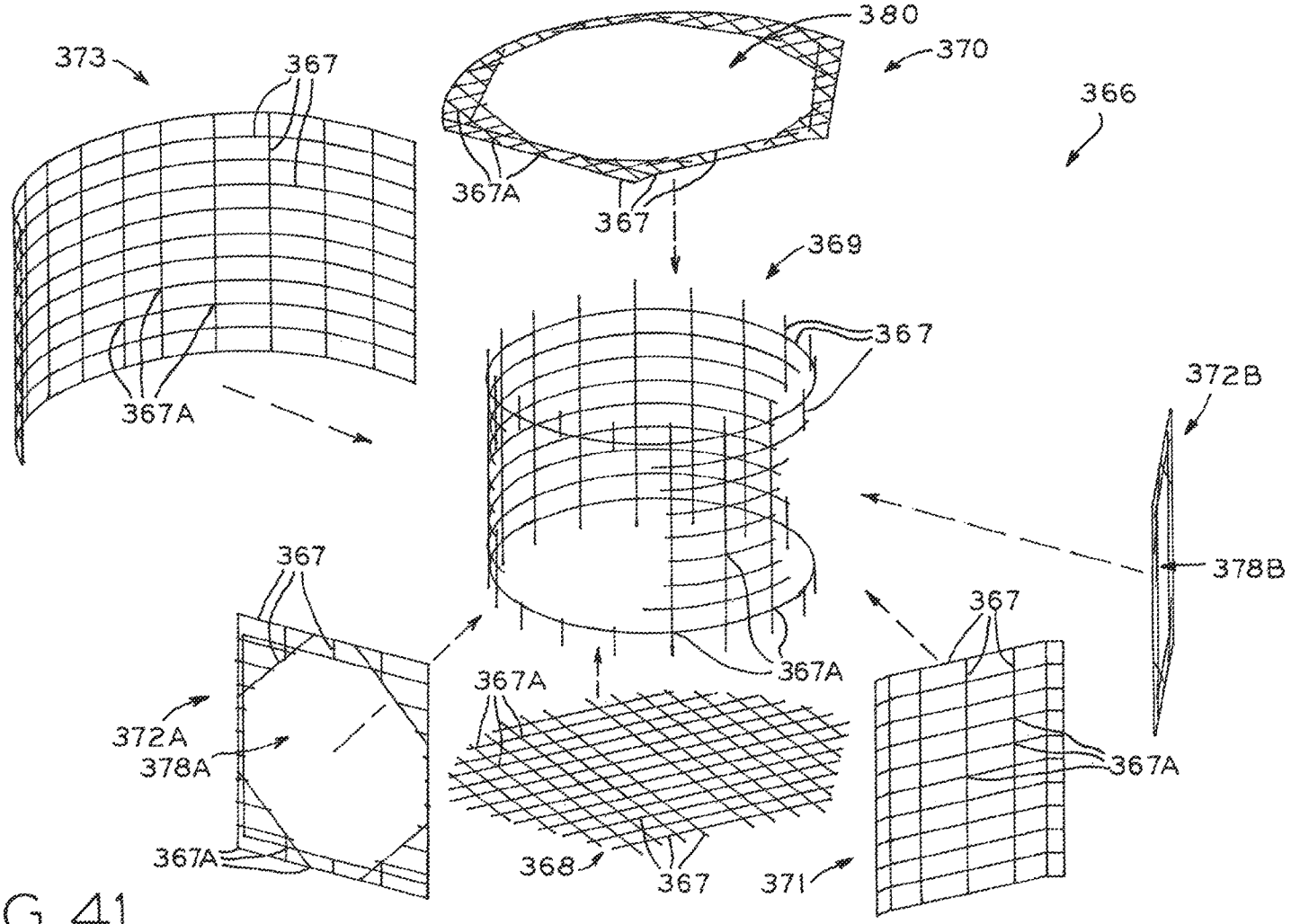
FIG. 41 is a perspective view of another reinforcement assembly made in accordance with the present disclosure, illustrating various reinforcement subassemblies.

FIG. 41 shows another embodiment of reinforcement rods 18, in the form of reinforcement assembly 366. Reinforcement assembly 366 is in principle similar to reinforcement assembly 266 described above, and corresponding structures and features of reinforcement assembly 366 have corresponding reference numerals to reinforcement assembly 266, except with 100 added thereto. However, reinforcement assembly 366 is made of a series of wire welded mesh subassembly panels 368, 370, 371, 372A, 372B, 373 and a cylindrical cage subassembly 369 which can be mated to corresponding surfaces of liner 12 prior to being affixed to one another and liner 12.

In particular, reinforcement assembly 366 includes bottom panel 368, sidewall panels 372A and 372B, front panel 371, back panel 373 and top panel 370, each of which is sized and configured to be installed to liner 12 adjacent bottom, side, front, back and top walls 68, 64, 66, 60, 62 and 69 of liner 12 respectively. Reinforcement assembly 366 further includes a cylindrical cage 369 sized to be received over liner 12 and within the outer periphery collectively defined by panels 368, 370, 371, 372A, 372B, 373. Cage 369 and panels 368, 370, 371, 372A, 372B, 373 may each be fixed to liner 12 via anchors 262, in similar fashion to subassemblies 268, 270, 272 described above, e.g., anchor washers 274 may be welded to wires, rods or rebar struts 367 at appropriate locations to interface with anchors 262. Panels 368, 370, 371, 372A, 372B, 373 and cage 369 are also fixed to one another at their respective junctions, such as via welding or wire ties.

In the illustrated embodiment, panels 368, 370, 371, 372A, 372B, 373 and central cage 369 are each formed as a mesh of wires or rods 367 extending horizontally and vertically and woven or otherwise engaged at regular crossing points 367A to create a network of gaps of a predetermined size. Respective abutting wires 367 may be welded at each such crossing point 367A. The gaps have a horizontal/lateral extent defined by the spacing between neighboring vertical wires 367, and a vertical extent defined by the spacing between neighboring pairs of horizontal wires 367, as illustrated in FIG. 41. The horizontal and vertical extent of the gaps, and therefore the "density" of the wire mesh, may be varied depending on the size of manhole assembly 10, the expected duty thereof, and relevant industry standards including ASTM C478 (pertaining to precast reinforced concrete manhole sections) and ASTM C76 (pertaining to reinforced concrete culverts, storm drains, and sewer pipes). In addition, because a straight (i.e. planar) run of wires 367 is inherently less strong than an outwardly curved run of wires 367, the density of wires 367 may be increased in the substantially planar panels of reinforcement assembly 366 (i.e., sidewall panels 372A, 372B, front panel 371, bottom panel 368 and top panel 370) as compared to the outwardly curved back panel 373. In some cases features may pass through a panel, such as pipe apertures 20, 22 passing through apertures 378A, 378B in sidewall panels 372A, 372B respectively, as well entry aperture 26 passing through apertures 380 of top panel 370. Where such features interrupt the meshed network of wires 367, additional reinforcement in the form of additional wires 367 or rebar may be provided around the periphery of the aperture as shown in FIG. 41.

Turning to FIG. 40, concrete displacement wedge 276 is shown disposed between a rear surface of liner 12 and a corresponding rear surface of reinforcement assembly 266. As described above, liner 12 includes rear bench 32 (FIG. 38) which extends laterally outwardly from flow channel 24 in a rearward direction to a junction with entry aperture 26A. The presence of rear bench 32 creates a void underneath bench 32 and adjacent back wall 62 of liner 12. In order to further reduce the amount of concrete needed to form manhole base assembly 10, concrete displacement wedge 276 may be provided with a "crescent moon" profile which substantially matches the corresponding profile of rear bench 32, and may be positioned underneath bench 32 and adjacent back wall 62 to fill in space which otherwise would be formed of solid concrete. Moreover, because the rear portion of bottom rebar subassembly 268 still extends radially outwardly from entry aperture portion 26A as shown in FIG. 40, sufficient concrete thickness will be provided in manhole base assembly 10 at the rear portion of liner 12 even in the absence of the concrete displaced by concrete displacement wedge 276.

In an exemplary embodiment, wedge 276 may be made of styrofoam material which can be formed into any desired shape or size as required for a particular application. Alternatively, wedge 276 may be made from an inflatable structure having seams and/or internal baffles to impart the desired shape and size.

Figure 7:
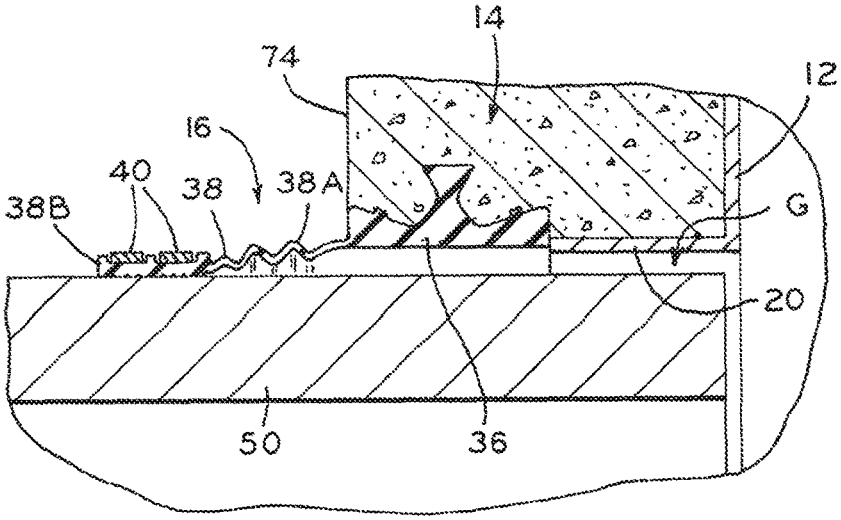
FIG. 7 is an enlarged elevation, cross-section view of a portion of the manhole base assembly shown in FIG. 6.

Upon formation of concrete base 14, gaskets 16 are partially cast into the material of concrete base 14. Turning to FIG. 7, gasket 16 is illustrated in detail in its cast-in and sealed configuration. Gasket 16 includes anchoring section 36, which is disposed adjacent to and abutting the annular end surface of aperture portion 20A and cast into the material of concrete base 14. As illustrated, anchoring section 36 defines a flared T-shaped profile which facilitates firm fixation of anchoring portion in the concrete material. Exemplary gaskets 16 are Cast-A-Seal™ gaskets, available from Press-Seal Gasket Corporation of Fort Wayne, Ind., USA.

Extending axially outwardly from the outer surface of anchoring section 36 is sealing section 38, which includes an accordion-type bellows 38A for flexibility and a sealing band coupling portion 38B with a pair of recesses sized to receive sealing bands 40. This arrangement allows for pipe 50 to be undersized with respect to aperture 20, defining gap G therebetween when pipe 50 is received within pipe aperture 20 as illustrated in FIG. 7. The flexibility of the bellows section 38A and the adjustability of sealing section 38B and sealing bands 40 allow gap G to exist while ensuring a fluid tight seal between manhole base assembly 10 and pipe 50. Also, gap G and bellows section 38A of seal 16 allow angular movement of pipe 50 with respect to base 14 within a prescribed angular range from the nominal position of pipe 50, such as due to soil shifts, for example. In one embodiment, sealing bands 40 are traditional pipe clamp or hose clamp structures which utilize a captured helically-threaded barrel engaging a series of slots, such that rotation of the barrel constricts or expands the diameter of the band 40.

Figure 6A:
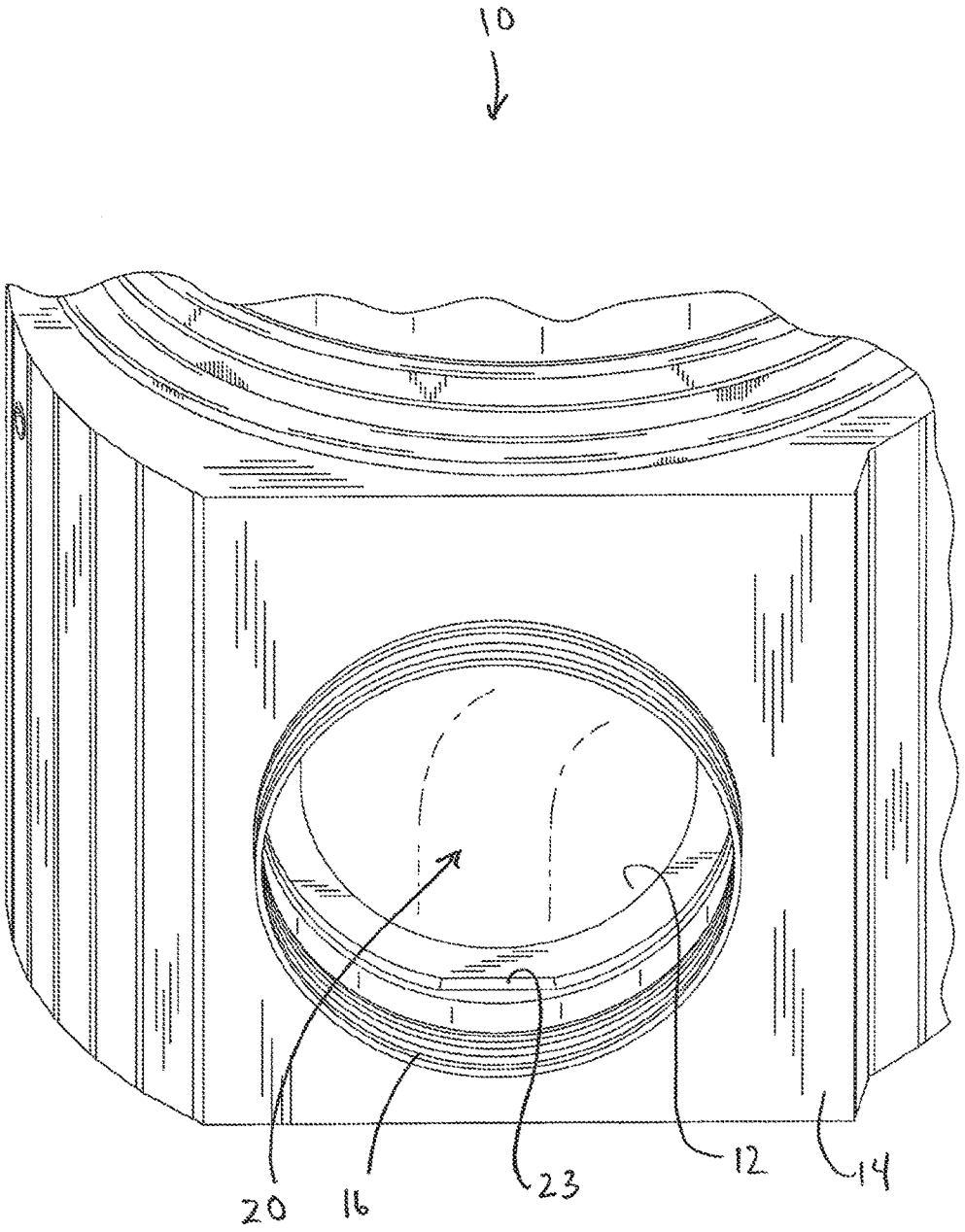
FIG. 6A is a perspective view of the manhole base assembly shown in FIG. 1, illustrating a pipe alignment flat at the bottom of a pipe aperture.

As shown in FIG. 6A, pipe aperture 20 may include flat portion 23 interrupting its otherwise circular profile at the bottom or "6 o'clock" position of aperture 20 and adjacent gasket 16. In an exemplary embodiment, flat portion 23 is sized and positioned to account for the difference in radius between aperture 20 and pipe 50. For example, if aperture 20 has a radius of 20 inches (inside diameter 40 inches) and pipe 50 has a radius of 19 inches (outside diameter 38 inches), flat portion 23 can be radially offset inward from the circular profile by one inch. In this way, flat portion 23 operates to ensure a substantially coaxial alignment between pipe 50 with aperture 20. Flat portion 23 may have any size and configuration sufficient to ensure that when pipe 50 is received within aperture 20 (FIG. 6), it is prevented from lowering (e.g., due to its weight) into a substantially non-coaxial relationship with entry aperture 20. Generally speaking, larger pipes and apertures will result in a larger nominal size and radial offset of flat portion 23.

In the illustrative embodiment of FIG. 6A, flat portion 23 is integrally formed as part of the material of liner 12, which simplifies the installation of pipe 50 while ensuring retaining the proper vertical spacing therebetween. This, in turn, protects gasket 16 from undesirable stresses and ensures the proper sealing arrangement between gasket 16 and pipe 50. A similar flat portion may be provided at the bottom of pipe aperture 22, as well as any other pipe apertures that may be provided in a manhole base assembly in accordance with the present disclosure.

In alternative embodiments, gaskets 16 may not be cast in to the material of concrete base 14, but simply disposed between the inner surfaces of aperture portions 20A, 22A and the adjacent outer surfaces of pipes 50, 54 respectively with an interference fit in order to form a fluid-tight seal. One exemplary seal useable in this way is the Kwik Seal manhole connector available from Press-Seal Gasket Corporation of Fort Wayne, Ind. In yet another alternative, gaskets 16 may be secured to the inner surface of pipe aperture portions 20A, 22A without being cast in to the concrete material. Exemplary expansion-band type products useable for sealing the inner surface in this manner include the PSX: Direct Drive and PSX: Nylo-Drive products, available from Press-Seal Gasket Corporation of Fort Wayne, Ind.

FIG. 4 illustrates the location of anchors 42 disposed about a periphery of entry aperture 26. As shown, one anchor 42 is generally centered at front wall 70, while other anchors 42 are spaced apart around the arcuate periphery of back wall 72. As illustrated in FIG. 1, further anchors 42 are also disposed at an upper portion from front or back walls 70, 72, near top wall 80. As shown in FIG. 10, anchors 42 include connecting portion 46, shown as a threaded rod, and anchoring portion 44, shown as an eyelet. Connecting portion 44 is received within anchor point 28, which is a commercially available threaded anchor cast into the material of concrete base 14 as shown in FIG. 10 and described in further detail below. With anchors 42 secured to respective anchor points 28 at the illustrative locations in concrete base 14 (FIG. 1), respective connecting portions 44 may be used to attach ropes or chains to concrete base 14 to aid in moving, positioning and configuring manhole base assembly 10 into a service position and configuration.

Figure 10A:
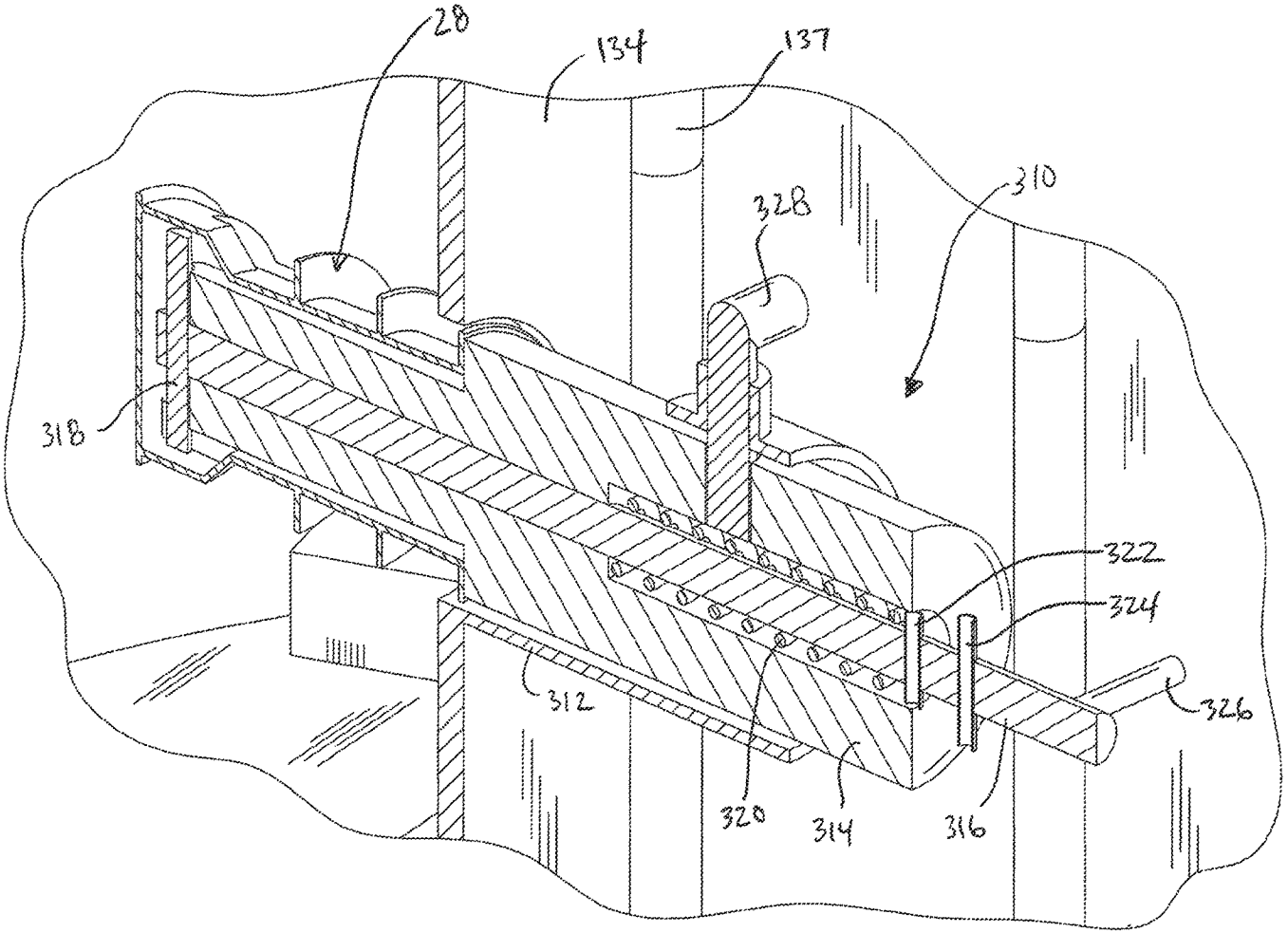
FIG. 10A is a perspective, cross-section view of an anchor fixture assembly used to support the cast-in anchor points of FIG. 10 during a concrete casting process.

In an exemplary embodiment shown in FIG. 10A, anchor points 28 are retained in desired positions during the pouring of concrete for concrete base 14 by anchor fixture assembly 310. As illustrated, e.g., in FIG. 21E, anchor fixture assembly 310 may be employed at any desired location around liner 12 in pre-casting assembly 102, such as in any of the intermediate segments 134 of the back or front wall assemblies 126, 128.

To employ anchor fixture assembly 310, a hole is placed in the desired sidewall of pre-casting assembly 102, such as in a selected intermediate segment 134 as shown in FIG. 10A. Fixture support 312 is then welded to this hole at the exterior of pre-casting assembly 102.

Anchor point 28 is fixed to anchor support 314 by sliding the smaller diameter portion of support 314 into the central bore of anchor point 28, as shown in FIG. 10A. The central bore of anchor point 28 includes a slot (not shown) to allow passage of lock pin 318 therethrough. When fully seated as shown in FIG. 10A, lock pin 318 is rotated out of registration with the slot in anchor point 28 by rotation of locking rod 316, which can be manipulated by handle 326. During such rotation, the user may push lock rod 316 against the biasing force provided by spring 320, which is held in a compressed state within anchor support 314 by spring pin 322. A stop pin 324 may be provided in lock rod 316 in order to limit how far lock rod 316 may be pushed against spring 320.

When lock pin 318 is rotated, it is positioned to engage the interior of anchor point 28 as shown in FIG. 10A. When handle 326 is then released, the biasing force of spring 320 pulls lock pin 318 against the interior of anchor point 28, pulling anchor point 28 into a secure retained position against the interior of the adjacent wall of assembly 102 (e.g., against intermediate segment 134 as shown).

A retaining pin 328 is then passed through fixture support 312 and engaged with anchor support 314, as illustrated, in order to fix anchor fixture assembly 310 to the adjacent intermediate segment 134 of the front or back wall assembly 126, 128 during the casting process. After casting, retaining pin 328 is removed, locking rod 316 and lock pin 318 are rotated back into registration with the slot of anchor point 28, and fixture assembly 310 is withdrawn from anchor point 28, leaving anchor point 28 securely fixed within the concrete material of base 14 as shown in FIG. 10.

3. Liner Lid

Figure 42:
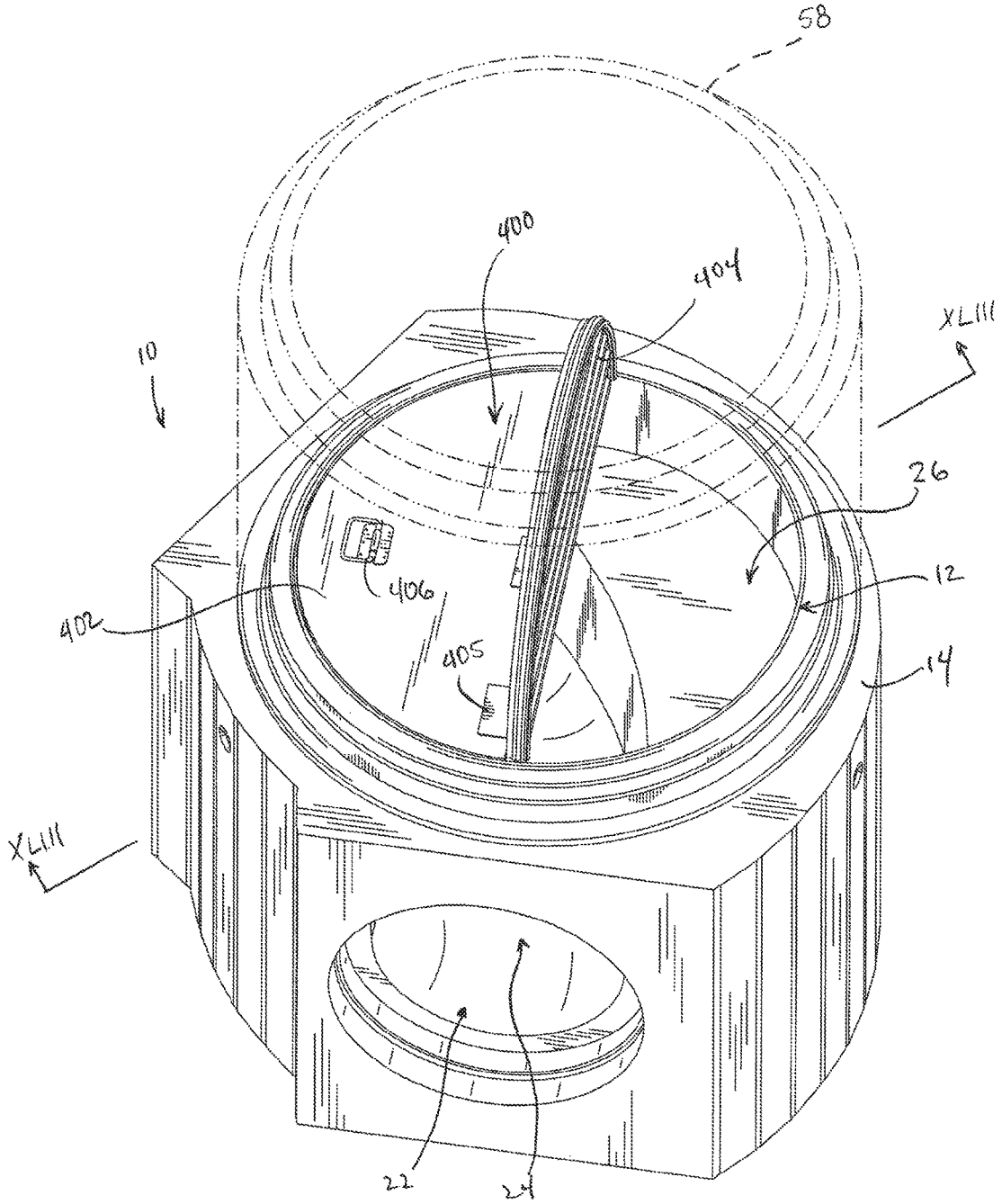
FIG. 42 is a perspective view of the manhole base assembly shown in FIG. 1, further including a liner lid assembly made in accordance with the present disclosure.

Turning now to FIG. 42, manhole base assembly 10 may include liner lid assembly 400 received in entry aperture 26 of liner 12. As described further below, lid assembly 400 is selectively sealingly engaged with a sidewall of entry aperture 26 in order to prevent gases (e.g. hydrogen sulfide) from escaping the interior of manhole base assembly 10 into adjacent unlined structure, such as riser 58.

The sealing engagement of lid 400 with liner 12 protects the material of riser 58 and any other structures above liner 12 from corrosive or other detrimental effects from gases passing through flow channel 24, thereby eliminating any need for separate lining of riser 58. Particularly in applications where riser 58 may span a substantial vertical distance, the use of lid assembly 400 may save substantial cost by preventing corrosive gases from contacting riser 58 while avoiding any necessity for a separate lining thereof. In an exemplary embodiment, lid assembly 400 may be formed from the any of the candidate materials discussed above for liner 12, such that lid assembly 400 is similarly resistant to degradation from expected service conditions. For example, first lid portion 402 and second lid portion 404 may be made from the same material as liner 12.

Figure 43:
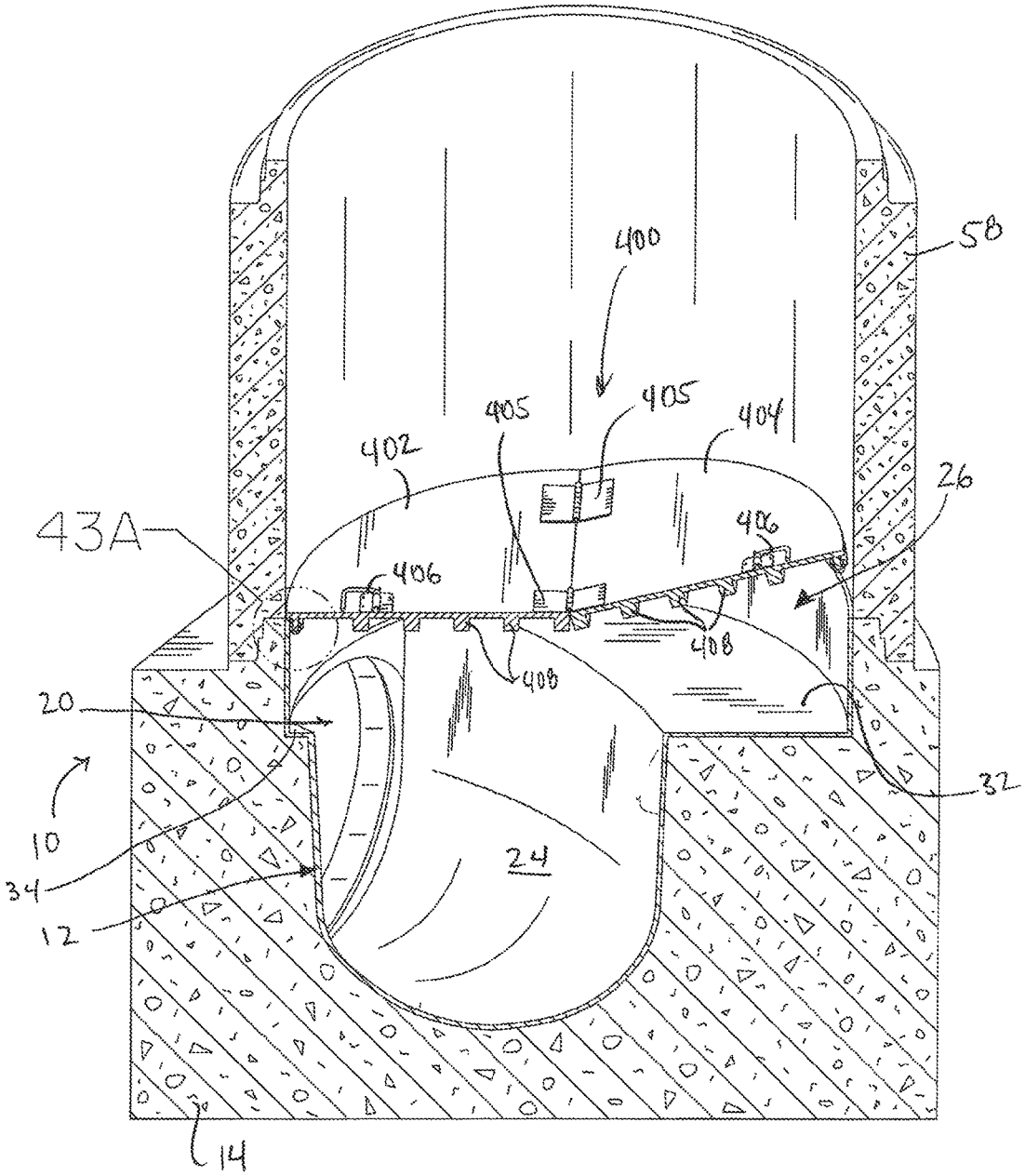
FIG. 43 is a perspective, section view of the manhole base assembly and lid assembly shown in FIG. 42, taken along the line XLIII-XLIII.

In the exemplary embodiment of FIG. 42, lid assembly 400 includes first lid portion 402 and second lid portion 404 hingedly connected to one another via one or more hinges 405 (FIG. 43). Each lid portion 402, 404 may be pivoted upwardly from a closed, sealingly engaged configuration to an open and sealingly disengaged configuration. In the closed configuration shown with respect to first lid portion 402 in FIG. 42, the respective lid portion is substantially horizontal and blocks access to the interior of liner 12 via entry aperture 26. In the open configuration shown with respect to second lid portion 404 in FIG. 42, the respective lid portion is pivoted upwardly away from its horizontal position to expose the interior of liner 12 via entry aperture 26.

In use, both lid portions 402, 404 may sealingly engage with, and be supported by, entry aperture 26 such that lid assembly 400 effectively prevents the passage of gasses from the interior of liner 12 through entry aperture 26. When needed for, e.g., inspection or maintenance, one or both of the lid portions 402, 404 may be selectively disengaged with entry aperture 26 in order to allow access to entry aperture 26 and flow channel 24. This selective accessibility allows access to liner 12 and flow channel 24 without the need for a complete removal or unseating of liner lid assembly 400 from entry aperture 26. In an exemplary embodiment, lid portions 402 and 404 may each be pivotable between open and closed configurations, and may each include a lifting handle 406 to facilitate opening and closing. However, it is contemplated that one of the two lid portions 402,404 may be fixed in a closed configuration and not pivotable, while the other lid portion retains the pivoting functionality.

As best shown in FIG. 43, lid portions 402, 404 may each include stiffeners 408, illustrated as longitudinal ribs along a bottom surface of each lid portion 402, 404. Stiffeners 408 provide structural rigidity to lid assembly 400, in order to support the weight of a worker standing thereupon, for example, and to transfer forces effectively to the adjacent support surface.

Figure 43A:
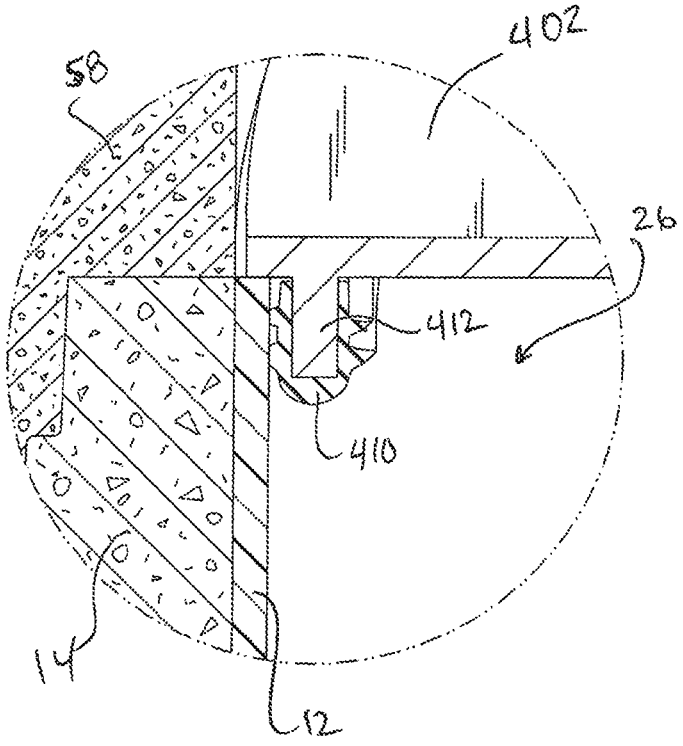
FIG. 43A is an enlarged view of a portion of FIG. 43, illustrating the interface between the lid assembly and the liner.

The outer periphery of lid assembly 400 is formed by the respective semicircular outer peripheries of first and second lid portions 402 and 404. As best shown in FIG. 43A, this outer periphery is directly supported by the upper axial end surface of liner 12 at entry aperture 26. The material of liner 12 at this location may have a thickness appropriate for this weight-bearing function, and may be set at any desired nominal thickness as appropriate for a particular application.

The outer periphery may also include the sealing engagement between the lid assembly 400 and entry aperture 26. In the illustrated embodiment, each lid portion 402, 404 may include a semicircular annular mounting rib 412 formed radially inwardly of its outer edge, and positioned to receive seal 410 such that seal 410 will sealingly engage the inner surface of the adjacent entry aperture 26 of liner 12 when the respective lid portion is in the closed configuration, as illustrated in FIG. 43A. In addition to the engagement of lid assembly 400 with entry aperture 26, seal 410 further ensures against leakage of gases into riser 58 from flow channel 24.

Figure 44:
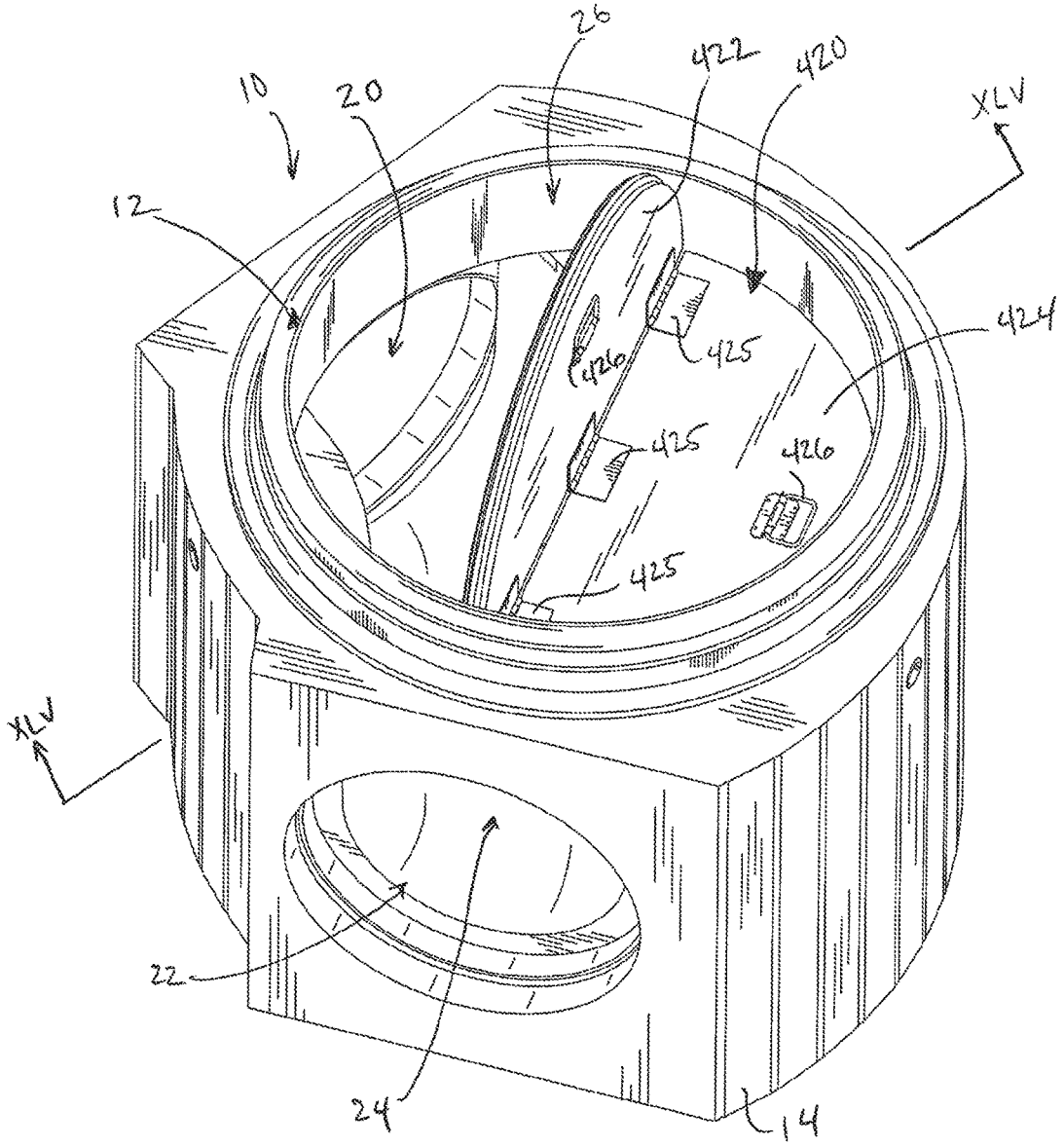
FIG. 44 is a perspective view of the manhole base assembly shown in FIG. 1, together with another liner lid assembly made in accordance with the present disclosure.

Turning now to FIG. 44, an alternative liner lid assembly 420 is shown received in entry aperture 26 of manhole base assembly 10. Lid assembly 420 functions similarly to lid assembly 400 discussed above, and has corresponding structures denoted by corresponding reference numbers, except with 20 added thereto. Lid assembly 420 has the same features and functions as lid assembly 400, except as noted herein. For example, lid assembly 420 is supported below, rather than upon, the upper axial end of entry aperture 26.

Lid assembly 420 includes first and second lid portions 422, 424 hingedly coupled to one another via hinges 425, in similar fashion to lid assembly 400 discussed above. Handles 426 may be used to toggle one or both of lid portions 402, 404 between open and closed configurations. In the closed configuration, lid portions 422, 424 are substantially horizontal and in sealed engagement with liner 12, as shown with respect to second lid portion 424 in FIG. 44. In the open configuration, lid portions 422, 424 are pivoted upwardly away from horizontal and out of such sealed engagement, as shown with respect to first lid portion 422 and FIG. 44.

Figure 45:
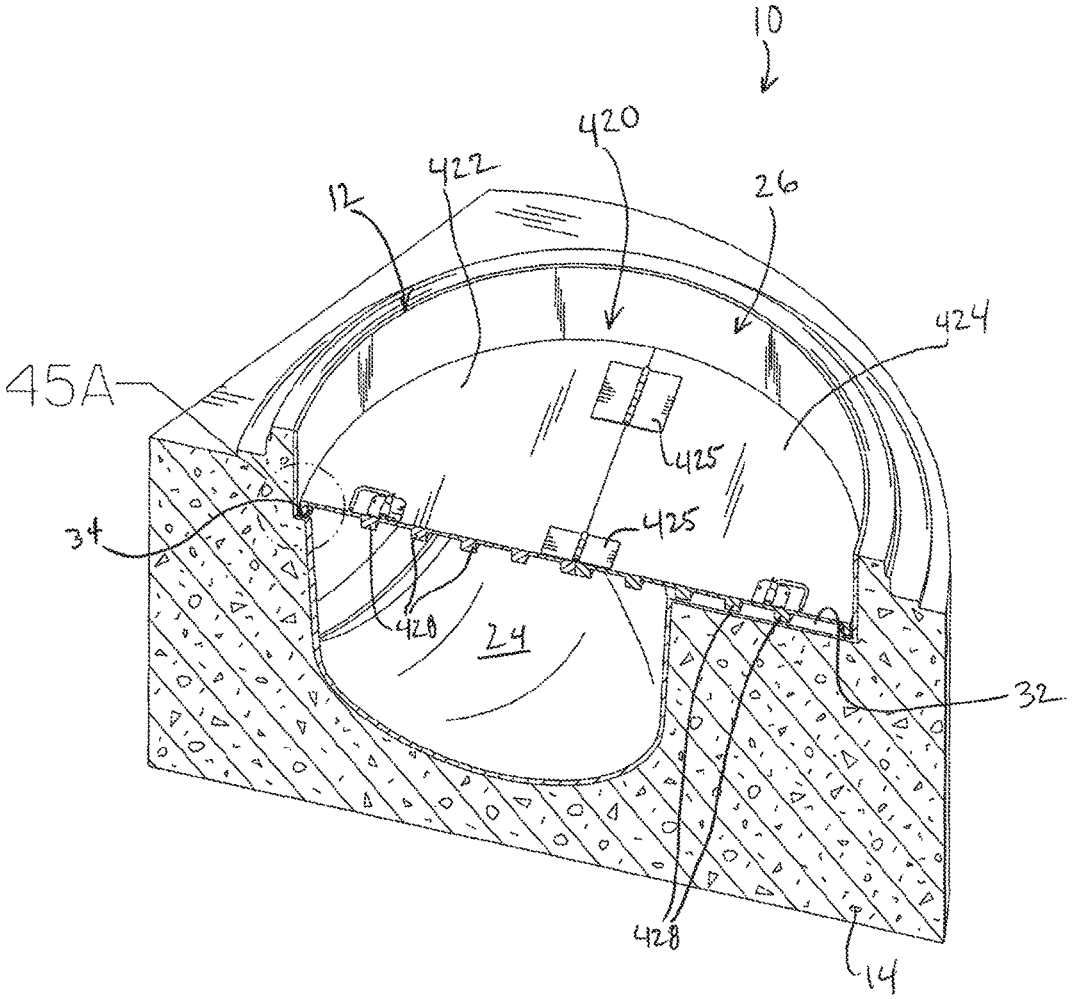
FIG. 45 is perspective, section view of the manhole base assembly and lid shown in FIG. 44, taken along the line XLV-XLV.

First and second lid portions 422, 424 are positioned below the upper axial end of entry aperture 26, and are supported by front bench 34 and rear bench 32 respectively as shown in FIG. 45. As noted above, rear and front benches 32, 34 may be substantially horizontal support surfaces, and are suitable to provide structural support to lid assembly 420 as shown. In the illustrative embodiment of FIG. 45, stiffening ribs 428 may be provided in each of lid portions 422, 424 similar to lid assembly 400 discussed above. In addition, stiffeners 428 may also provide further supportive engagement with at least rear bench 32 as shown. It is also contemplated that front bench 34 may be large enough to similarly engage one or more stiffeners 428 in some embodiments.

Figure 45A:
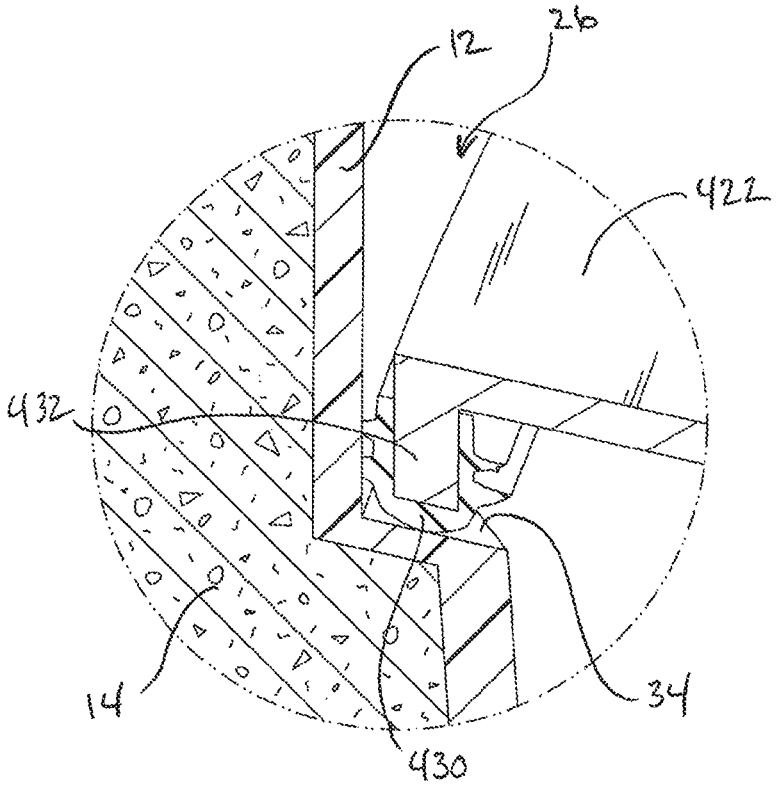
FIG. 45A is an enlarged view of a portion of FIG. 45, illustrating the interface between the lid assembly and the liner.

Turning to FIG. 45A, mounting rib 432 of lid portions 422 and 424 may be formed at the outer edge thereof, as opposed to radially inwardly of the outer edge as discussed above with respect to mounting ribs 412 of lid portions 402, 404. Mounting ribs 432 may provide structural support by resting upon benches 32, 34 at the outer periphery of lid assembly 420, while also providing a seat for seal 430. Seal 430 sealingly engages the inner surface of entry aperture 26 as illustrated, and may also engage the upper surfaces of benches 34, 32.

4. Liner Production

Turning now to FIGS. 30-33, liner form assembly 200 and various of its associated components are illustrated. As described in detail below, liner form assembly 200 is used to modularly product a core having the desired shape, size, and configuration of liner 12. Layers of material and/or fiberglass may be then be applied and cured around this core to product liner 12 with the desired geometric configuration, e.g., angle α defined by flow axes 52 and 56 (FIG. 5). After formation of liner 12 in this fashion, the various components of liner form assembly 200 may be disassembled and removed from which liner 12 and reused in the same or a different configuration.

Figure 31:
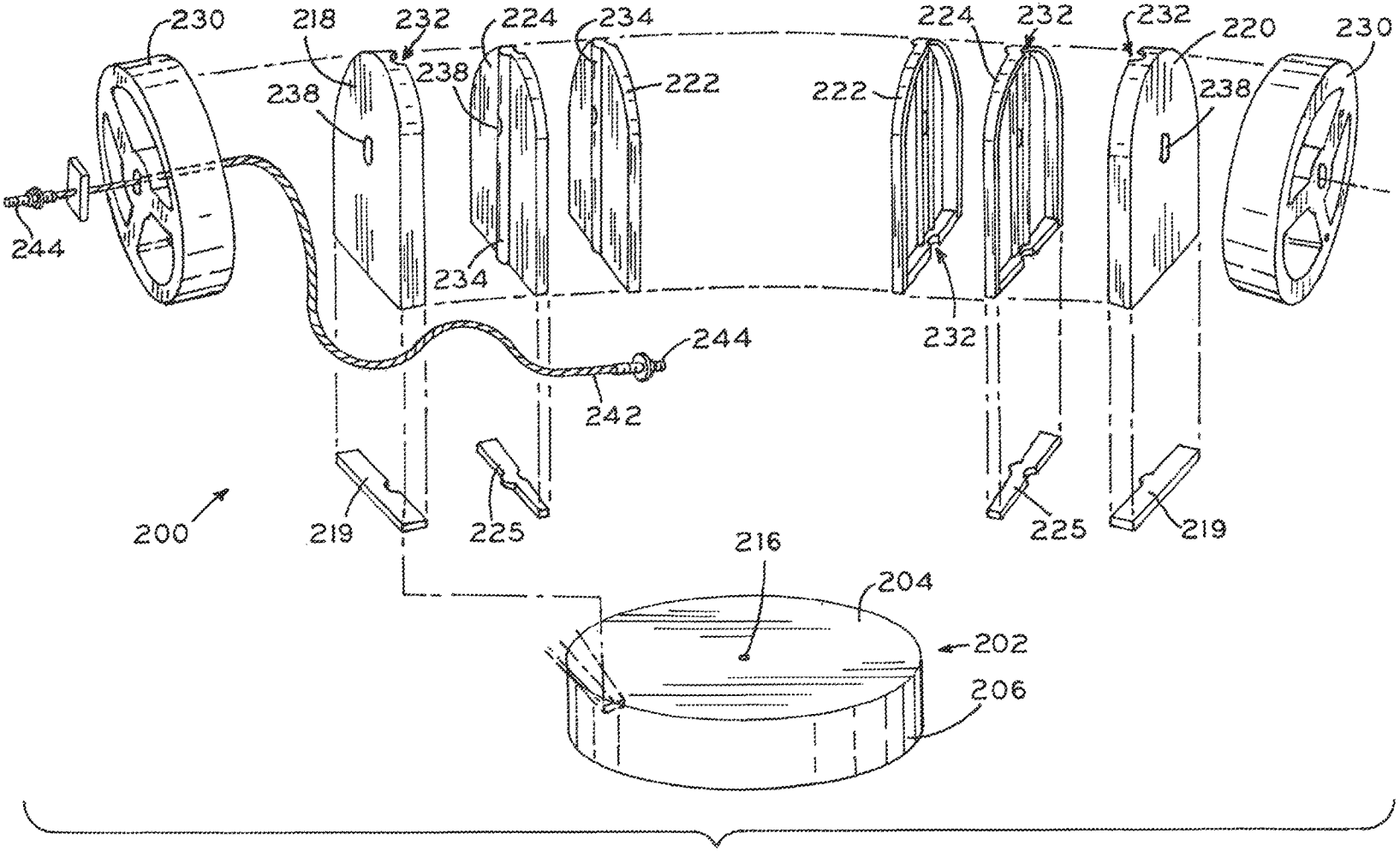
FIG. 31 is a perspective, exploded view of a liner form assembly used to form a liner in accordance with the present disclosure.

As best seen in FIG. 31, liner form assembly 200 includes entry aperture support 202, pipe aperture supports 230, and a plurality of interlocking members sized and shaped to create flow channel 24 (see, e.g., FIGS. 5, 6, 8, and 9). The interlocking members include a combination of wedge-shaped and/or straight-walled components, including end components 218, 220, intermediate components 222, 224, and center components 226 as further described below. These components are assembled into a desired flow-path configuration, and then bound together by tie cable 242, such that liner form assembly 200 can form an internal support upon which material is placed and/or deposited to form liner 12. After formation of liner 12, the components of liner form assembly 200 can be removed and re-used as further described below.

Figure 30:
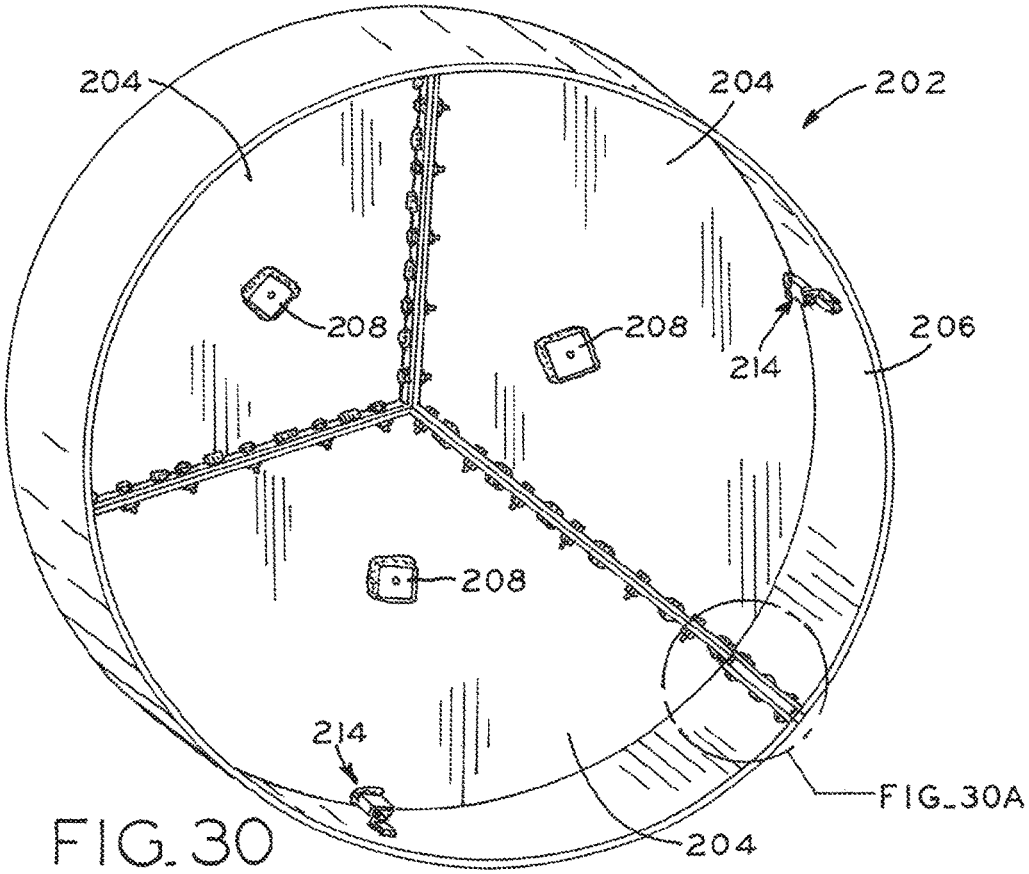
FIG. 30 is a perspective view of an entry aperture support assembly used to form a liner in accordance with the present disclosure.
Figure 30A:
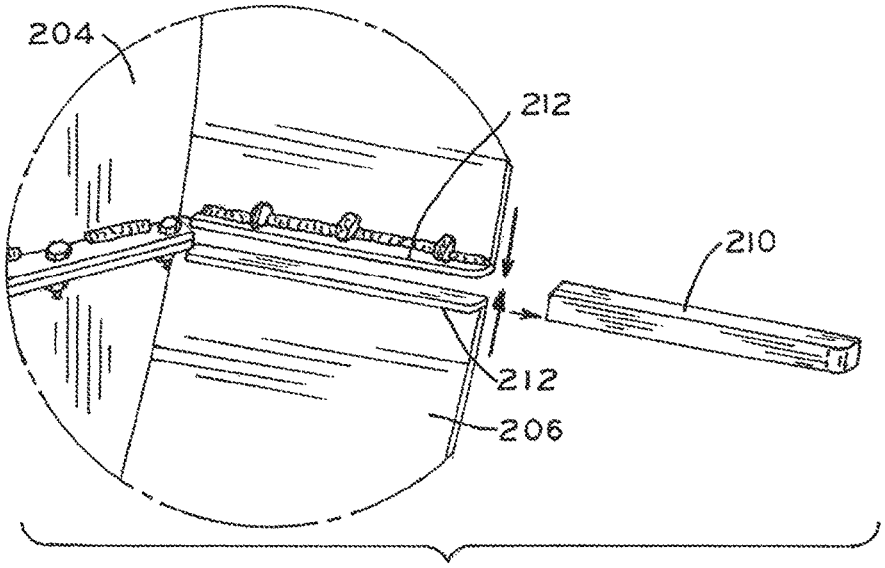
FIG. 30A is an enlarged, perspective view of a portion of FIG. 30, illustrating an expansion mechanism of the entry aperture support assembly.

Turning now to FIG. 30, a cup-shaped entry aperture support 202 is shown in detail. Support 202 includes three base plates 204 which, when joined as illustrated, cooperate to form a large circular base plate assembly. Collar plate 206 is formed as a substantially cylindrical structure and joined to each of base plates 204 by plate joiners 214. In an exemplary embodiment, plate joiners 214 may be created by affixing a first structure, such as a small piece of angle iron, to the interior surface of collar plate 206 and threading a fastener through the angle iron into a correspondingly threaded block affixed to each of the base plates 204. However, it is contemplated that any suitable fixation structures may be utilized. As best seen in FIG. 30A, collar plate 206 has two end walls 212 attached at respective opposing ends of the strip of material formed into the illustrated cylindrical configuration, with a gap formed between the end walls 212. Expansion bar 210 is removably received within this gap, and can be installed or removed to slightly expand or contract the diameter of the cylindrical collar plate 206 during the production process for liner 12. In particular, expansion bar 210 can be removed to contract the diameter of collar plate 206 to ease extraction of entry aperture support 202 from liner 12 after it is formed and cured.

In order to assemble liner form assembly 200, the cup-shaped entry aperture support 202 is positioned with its opening facing down as shown in FIG. 31. Center component 226 is then placed upon the exposed outer surface of base plates 204, with alignment bolt 228 (FIG. 32) being passed into central aperture 216 to position center component 226 at an appropriate position with respect to entry aperture support 202. Intermediate components 222 can then be engaged with either side of center component 226, in any desired number, to create the desired shape and configuration of liner form assembly 200 and thus of liner 12.

Figure 32:
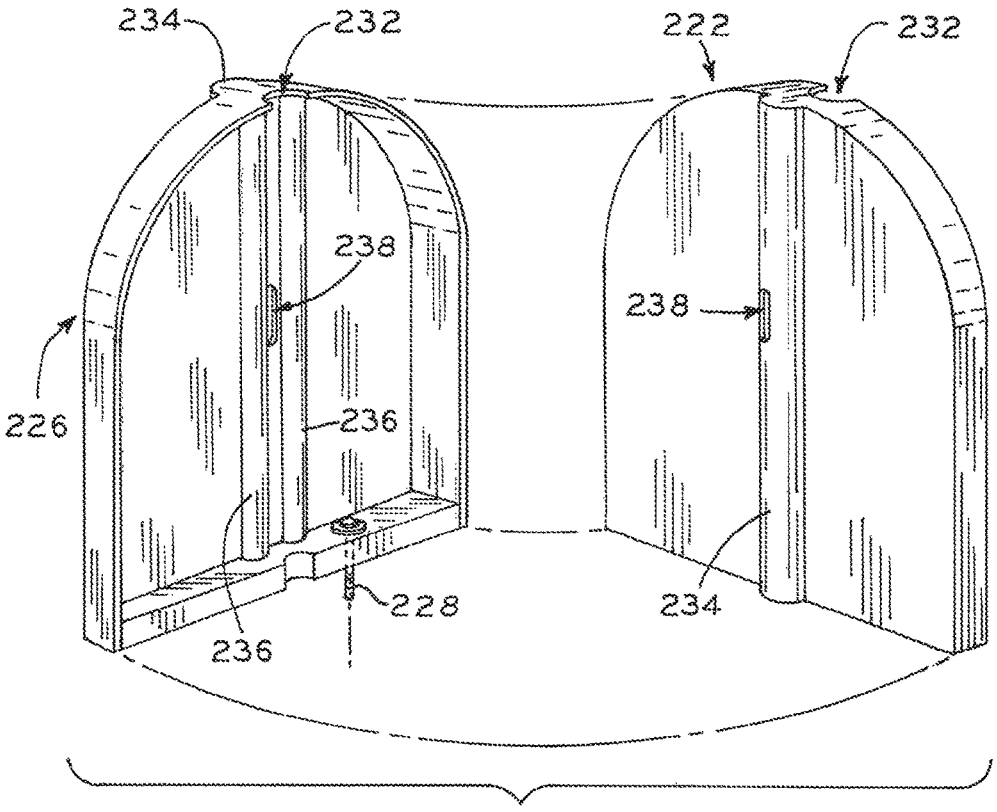
FIG. 32 is a perspective, exploded view of two components of the liner form assembly shown in FIG. 31.

As best seen in FIG. 32, center component 226 and intermediate components 222 each include recess 232 formed on one side of the component and the correspondingly shaped protrusion 234 formed on the opposite side. In the exemplary illustrated embodiment, stiffeners 236 are also provided on either side of recess 232 in order to provide stiffness and rigidity to recess 232 and protrusion 234. When intermediate component 222 is aligned with and abutted against center component 226, protrusion 234 of intermediate component 222 is received in the adjacent recess 232 of center component 226. In this way, components 222, 226 are aligned prevented from moving relative to one another. With further additions of intermediate components 222 as needed for a particular liner form assembly 200, such alignment and engagement of protrusions 234 and recesses 232 is iteratively repeated.

Assembly 200 also includes end components 218 and 220. As best seen in FIG. 31, end components 218 include a flat surface lacking either protrusion 234 or recess 232, such that end components 218, 220 are adapted to abut a correspondingly flat, planar surface of pipe aperture supports 230 as further described below. End components 218 may include recess 232 and/or protrusion 234 on the opposing side in order to interlockingly engage with the adjacent intermediate component 224 in the same fashion as described above with respect to intermediate components 222.

As noted above, each of components 218, 220, 222, 224, and 226 define either a wedge-shaped cross-section or a straight-walled, generally rectangular cross-section. In the aggregate, the wedge-shaped and straight-walled components cooperate to impart a curvature to liner form assembly 200 corresponding to the desired curvature of flow channel 24 (FIG. 5). The particular shape and number of components 218, 220, 222, 224, and 226 may be varied as required or desired to produce liner 12 in any number of sizes and geometric configurations. In the illustrated embodiment of FIGS. 31 and 33, the number and configuration of components 218, 220, 222, 224, and 226 is adapted to provide the desired angles α and Θ as shown in FIG. 5.

Figure 31B:
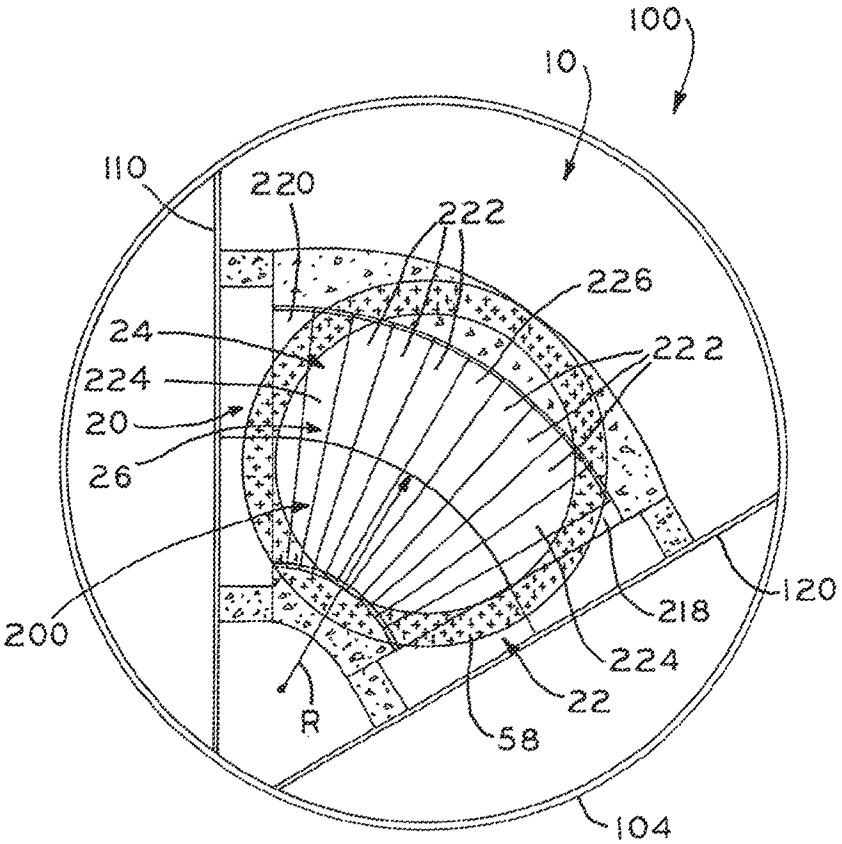
FIG. 31B is a plan view of the liner form assembly shown in FIG. 31 in a second flow configuration.
Figure 31A:
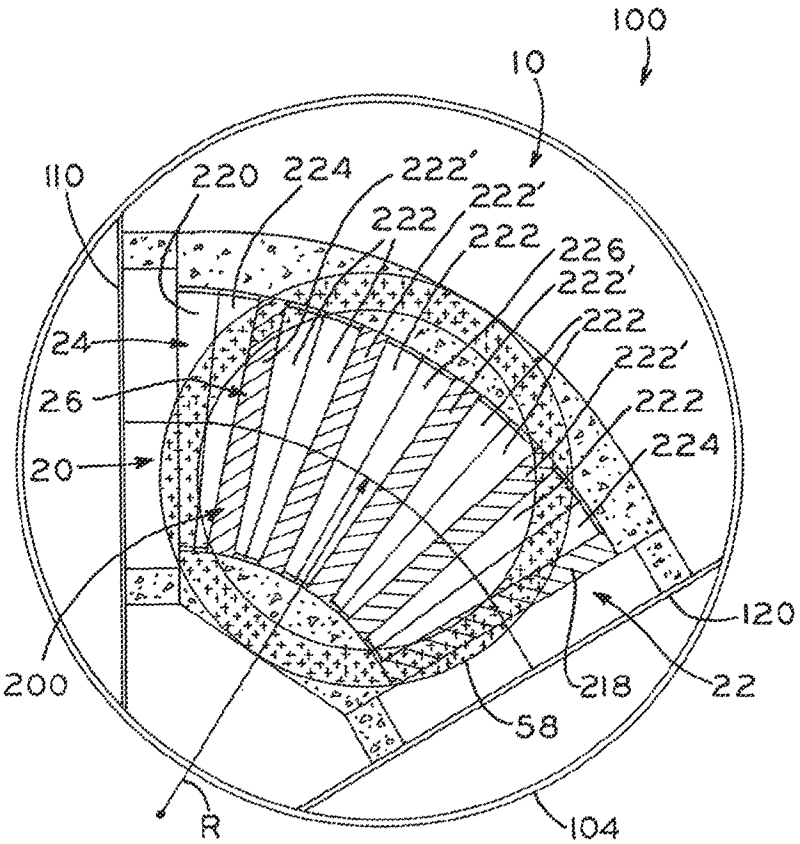
FIG. 31A is a plan view of the liner form assembly shown in FIG. 31 in a first flow configuration.

However, any arrangement and configuration of such wedge shapes may be provided to produce any desired angles α and Θ around any desired flow radius R (FIG. 4), and in any required flow diameter $D_P$. For example, FIGS. 31A and 31B show alternative arrangements of liner form assembly 200, each designed to produce a desired geometry for flow path 24 (FIG. 4) through modification of the modular components of liner form assembly 200. In the embodiment of FIG. 31A, for example, straight-walled intermediate components 222' may be interspersed between other wedge-shaped components 218, 220, 222, 224, and/or 226, which effectively increases the overall radius R defined of flow path 24 by distributing the angular change imparted by the wedge-shaped components 218, 220, 222, 224, and 226 across the longest possible flow path extent. This radius maximizing arrangement can be used where the smallest impediment to flow (and therefore, the largest flow capacity) is the design objective for liner 12 and manhole base assembly 10. Maximum flow capacity may be desirable for "trunk line" portions of a sewer system, where flow variability can be significant based on, e.g., rain storms, daily variability, and other flow-surge-creating events.

In other arrangements, such as the alternative design shown in FIG. 31B, the radius R of flow path 24 may be made intentionally smaller than the FIG. 31A arrangement by not interspersing straight-walled components 222' (FIG. 31A) between wedge-shaped components 222. This arrangement causes radius R to be reduced, making the turn "tighter" and accomplishing the same angular change as FIG. 31A across a reduced axial extent of flow path 24. Such an arrangement may be used, e.g., to minimize the overall size and footprint of liner 12 and manhole base assembly 10, such as for urban systems where space constraints are more prevalent. In the illustrated embodiments, for example, FIG. 31B shows a smaller riser 58 as compared to riser 58 used in FIG. 31A. In some embodiments, the small-radius arrangement of FIG. 31A may be used in conjunction with larger-footprint manhole base assemblies 10 (such as the larger footprint in FIG. 31A), in order to meet other design constraints where a lower flow capacity is acceptable but the larger footprint is desired.

Still other changes may be made to respective components 218, 220, 222, 224, and/or 226 in order to affect the overall geometry and function of flow path 24. For example, the overall height of components 218, 220, 222, 224, and/or 226 may be gradually increased or reduced along flow path 24 in order to create, for example, a vertical grade along the flow path through liner 12. This vertical grade may be used to create a drop from the intake side of pipe apertures 20, 22 to the outlet side thereof. In an exemplary embodiment, this drop may be set to a drop of 1-inch per 100 inches of flow path extent, though any drop may be created by simply altering the respective heights of components 218, 220, 222, 224, and/or 226.

Figure 34:
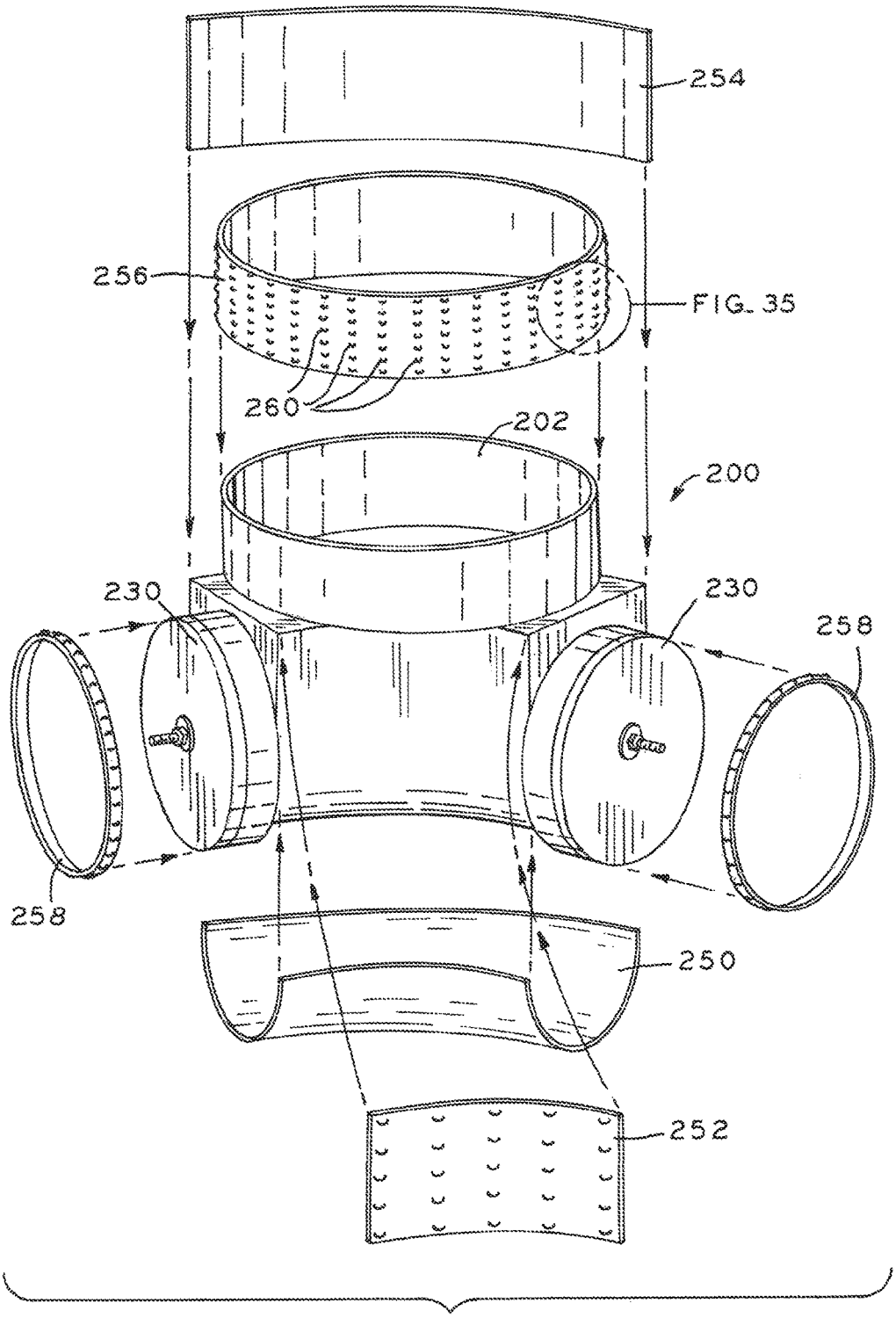
FIG. 34 is a perspective, exploded view of the assembled liner form assembly shown in FIG. 33, illustrating attachment of various sheets which cooperate to form an inner layer of a liner in accordance with the present disclosure.

As best seen in, e.g., FIG. 4, flow channel 24 extends outwardly beyond the outer diameter of entry aperture portion 26A. Top wall 69 of liner 12 encloses the upper end of flow channel 24 outside of entry aperture portion 26A, as shown in FIGS. 4 and 34, and top wall 69 may form a flat surface in certain embodiments (e.g., as shown in FIG. 34). This flat upper surface may cooperate with the other surfaces of flow channel 24 to capture intermediate components 224 and end components 218, 220 after liner 12 is fully formed and cured. In order to facilitate removal of end and intermediate components 218, 220, 224, shims 219 and 225 are provided with liner form assembly 200. Shims 219, 225 have outer peripheries which match the corresponding top end surfaces of components 218, 220 and 224 respectively, and are disposed between base plates 204 and components 218, 220 and 224 respectively. As further described below, this allows shims 219 and 225 to be removed prior to removal of components 218, 220 and 224, thereby creating a gap for dislodging components 218, 220 and 224 from flow channel 24. In order to accommodate shims 225, intermediate components 224 are truncated to define a reduced overall height as compared to intermediate components 222. End components 218, 220 have an overall height similar to intermediate components 224 to accommodate shims 219.

Turning again to FIG. 33, once components 218, 220, 222, 224, and 226 are properly positioned upon entry aperture support 202, pipe aperture supports 230 are moved into place supported by end stands 246. In particular, pipe aperture supports 230 are movably connected to end stands 246 via a plurality of support bolts or screws 248, which can be selectively fixed to supports 230 such that pipe aperture supports 230 may be moved vertically up or down in order to axially align with end components 218, 220 then locked into place by tightening bolts 248.

Figure 33:
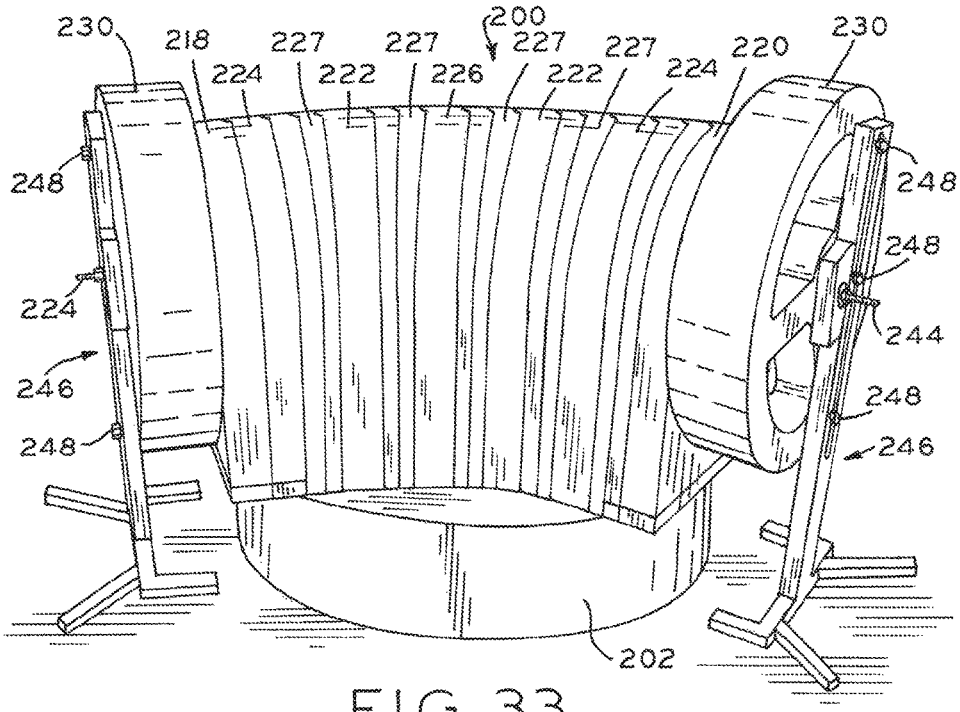
FIG. 33 is a perspective view of the liner form assembly shown in FIG. 31, with the parts fully assembled and supported by end stands.

At this point, tie cable 242 may be passed through pipe aperture supports 230 (FIG. 31) and through respective cable apertures 238 (FIG. 32) formed in each of components 218, 220, 222, 224 and 226. In this way, tie cable 242 passes through both of pipe aperture supports 230, as shown in FIG. 33, and through all of components 218, 220, 222, 224, and 226. End bolts 244 are fixed to each axial end of tie cable 242, and can be used to threadably fix cable 242 to each of the opposing pipe aperture supports 230. In the illustrated embodiment, an arrangement of nuts, washers, and blocks are engaged with end bolts 244 to hold cable 242 in place at each of pipe aperture supports 230. As the nuts engaged with end bolts 244 are tightened, tie cable 242 is tensioned to draw the components of liner form assembly 200 tight against one another. At this point, liner form assembly 200 is complete and ready to be used to form liner 12 as described below.

In one exemplary embodiment, liner form assembly 200 may include sealing tape 227 placed over each junction between adjacent neighboring components 218, 220, 222, 224 and 226, as shown in FIG. 33. A sealant material such as caulk may be applied to the various junctions throughout liner form assembly 200, such as at the interface between respective components and entry aperture support 202, and at the junctions between pipe aperture supports 230 and end components 218, 220 respectively. With such junctions sealed by the sealant material, a liquid polymer may be applied (e.g., "painted" or sprayed) to liner form assembly 200 and allowed to cure. Fiberglass may then be sprayed over the polymer paint, smoothed and cured in accordance with conventional fiberglass forming techniques. Alternatively, a polymer/fiber matrix material such as the material available from Mirteq described above may be "painted" or sprayed over liner form assembly 200 as a single monolithic layer. This type of polymer/fiber material may form a smooth inner surface of the finished liner 12 to promote efficient fluid flow through channel 24, while also having strength, rigidity and chemical resistance for use in conjunction with underground sewer systems.

Turning to FIG. 34, another exemplary embodiment of liner 12 may be formed as a composite, two-layer structure including an inner layer formed from a plurality of polymer sheets attached (e.g., adhered) to liner form assembly 200 and an outer layer formed from fiberglass. In particular, the inner layer may be formed from a plurality of individual sheets including bottom sheet 250, front sheet 252, back sheet 254, entry aperture ring 256, and a pair of pipe aperture rings 258. Each of these sheets may be formed from a flat piece of material, such that the material may be dispensed from a roll of bulk material, cut to size, shaped and applied to liner form assembly 200 as illustrated. Similar smaller sheets of material may also be used to create an inner layer on the other surfaces of liner 12, such as top surface 69 and side surfaces 64, 66 (see, e.g., FIGS. 3 and 40), as appropriate. In the case of entry aperture ring 256 and pipe aperture rings 258, a thin strip of material is cut to size, formed into a circle and connected at its ends, e.g., by adhesive or welding, to form the illustrated closed-loop configuration.

Figure 35:
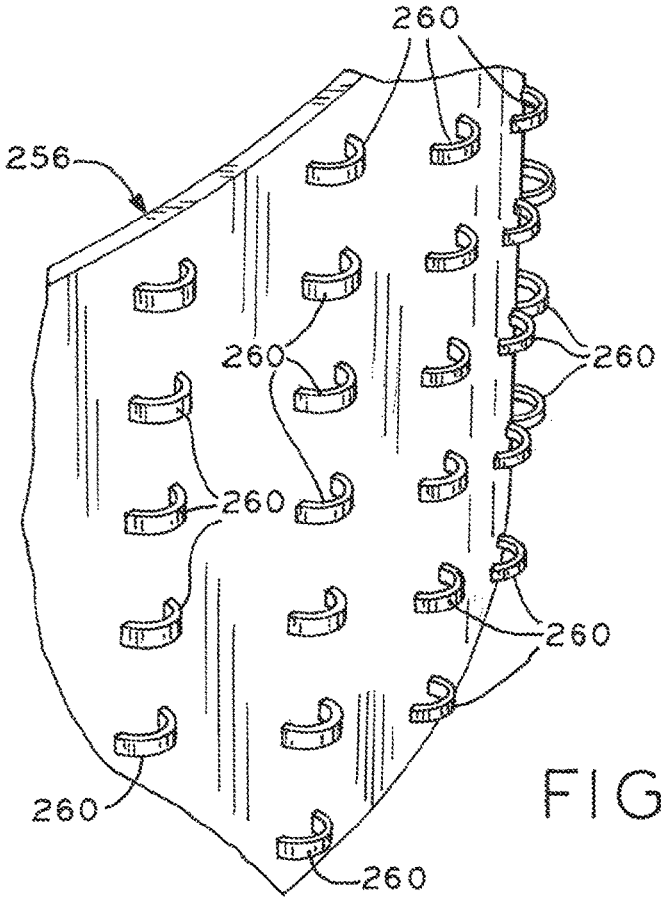
FIG. 35 is an enlarged, perspective view of a portion of FIG. 34, illustrating sheet-backed anchors formed on an inner layer sheet.

As best seen in FIG. 35, the material used to create sheets 250, 252, 254 and rings 256, 258 may include sheet-backed anchors 260 affixed at regular intervals to one side of the sheet material. Anchors 260 form a horseshoe shape such that an aperture is formed between the material of the sheet and the periphery of the ring shaped anchor 260. As described further below, these apertures may protrude outwardly from the entire outer surface of liner 12 in order to interdigitate with concrete base 14 upon final casting of manhole base assembly 10.

With sheets 250, 252, 254, and rings 256, 258 in place, each sheet may interconnected with adjacent sheets by, e.g., adhesive or welding. In this way, sheets 250, 252, 254 and rings 256, 258 cooperate to form a base layer of liner 12. In an exemplary embodiment, the inner surfaces of the respective sheets may be smooth to facilitate fluid flow through liner 12, while the outer surfaces thereof include anchors 260 as noted above. In an exemplary embodiment, sheets 250, 252, 254 and rings 256 and 258 are made from a polymer material, such as a polymer chosen for resistance to hydrogen sulfide ($H_2S$) gas in order to facilitate long-term high performance in sewage system applications.

With sheets 250, 252, 254, and rings 256, 258 assembled and interconnected to form the inner layer of liner 12, fiberglass may be sprayed over the assembly of sheets to form the outer layer of liner 12. This fiberglass material may then be smoothed and cured in a traditional manner. During the spraying process, liner/rebar anchors 262 (FIG. 36) may be placed at desired locations around the periphery of liner 12, in order to coincide with desired attachment points for reinforcement assembly 266 (as shown in FIGS. 39 and 40 and described in detail above). Fiberglass material may be sprayed over the base of anchors 262, and the fiberglass material may be cured with the base of anchors 262 partially encapsulated, such that anchors 262 are firmly and reliably fixed to the finished material of liner 12.

In another alternative, sheets 250, 252, 254 and/or rings 256, 258 may be applied to the outside surface of liner 12 after formation and curing. In this instance, liner 12 may have three layers including a smooth inner layer (made from, e.g., a polymer material "painted" over liner form assembly 200 as described above), a structural intermediate layer (e.g., a fiberglass material sprayed and cured as described above), and an outer layer adhered or otherwise affixed to the intermediate layer formed of sheets 250, 252, 254 and/or rings 256, 258. This outer layer may provide additional strength and rigidity benefits, while also providing anchors 260 for fixation of liner 12 to concrete base 14 as described herein.

Figure 12:
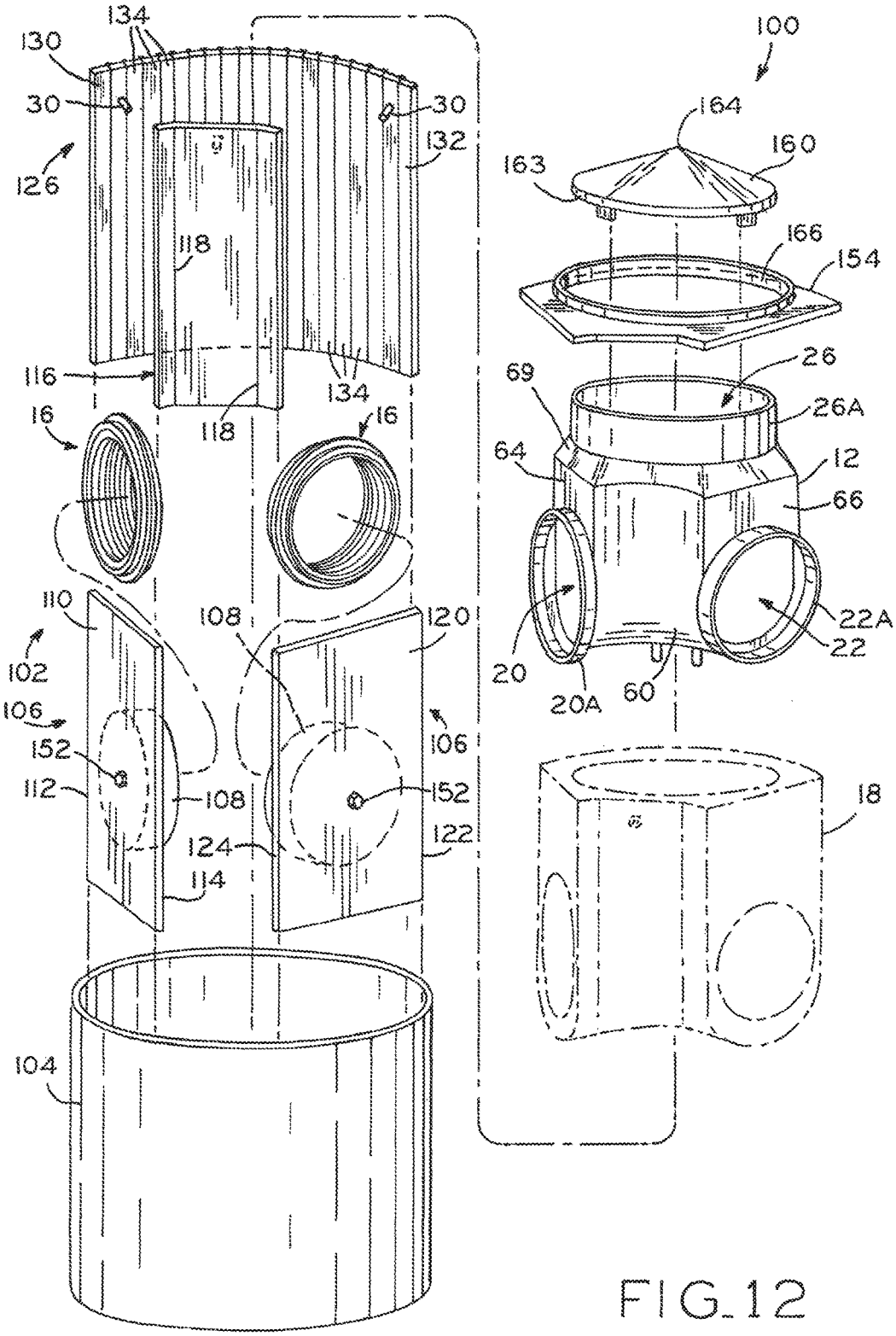
FIG. 12 is an exploded view of the manhole form assembly shown in FIG. 1, together with constituent parts of the manhole base assembly shown in FIG. 1.

After the layer of fiberglass is cured, liner 12 is fully formed and liner form assembly 200 may be removed. In particular, pipe aperture supports 230 may be withdrawn from the now-formed pipe apertures 20, 22 (FIG. 12). Similarly, entry aperture support 202 may be withdrawn from the now-formed entry aperture 26. To facilitate this withdrawal, expansion bar 210 may be removed from its position between end walls 212 (FIG. 30A) in order to allow collar plate 206 to slightly contract and disengage from the interior side wall of entry aperture portion 26A. In addition, puller plates 208 (FIG. 30) fixed to respective base plates 204 may be threadably engaged with, e.g., an eyelet in order to provide an anchor point for withdrawing entry aperture support 202 using overhead equipment such as cranes or forklifts.

Next, center component 226 and intermediate components 222 may be removed from flow channel 24 of liner 12 via entry aperture 26 of the newly formed liner 12. With center and intermediate components 226, 222 removed, intermediate component shims 225 may be pried away and removed through entry aperture 26, at which point truncated intermediate components 224 may also be removed by tilting component 224, passing it into the center of flow channel 24 withdrawing it through entry aperture 26. Finally, end component shims 219 may be pried away and end components 218 and 220 may be removed by pushing inwardly from pipe apertures 20, 22 respectively to pass end components 218, 220 toward the center of flow channel 24, and then withdrawing end components 218, 220 through entry aperture 26. At this point, liner form assembly 200 is fully withdrawn, such that liner 12 can be used in the production of manhole base assembly 10 as described in detail below.

5. Manhole Base Production

FIG. 11 illustrates manhole form assembly 100, which can be used with or without casting jacket 104 to form concrete base 14 (FIG. 1) around liner 12 to form manhole base assembly 10. In exemplary embodiments, liner 12 may be prepared and, optionally, pre-assembled with reinforcement rods 18 (e.g., reinforcement assembly 266) at a site remote from the service site, and shipped to the service site without concrete base 14. Concrete base 14 can then be formed in accordance with the disclosure below at the service site, avoiding the need to transport concrete base 14 across any significant distance while allowing large-scale manufacture of liner 12 (and optionally, reinforcement rods 18) at a centralized location.

Figure 21:
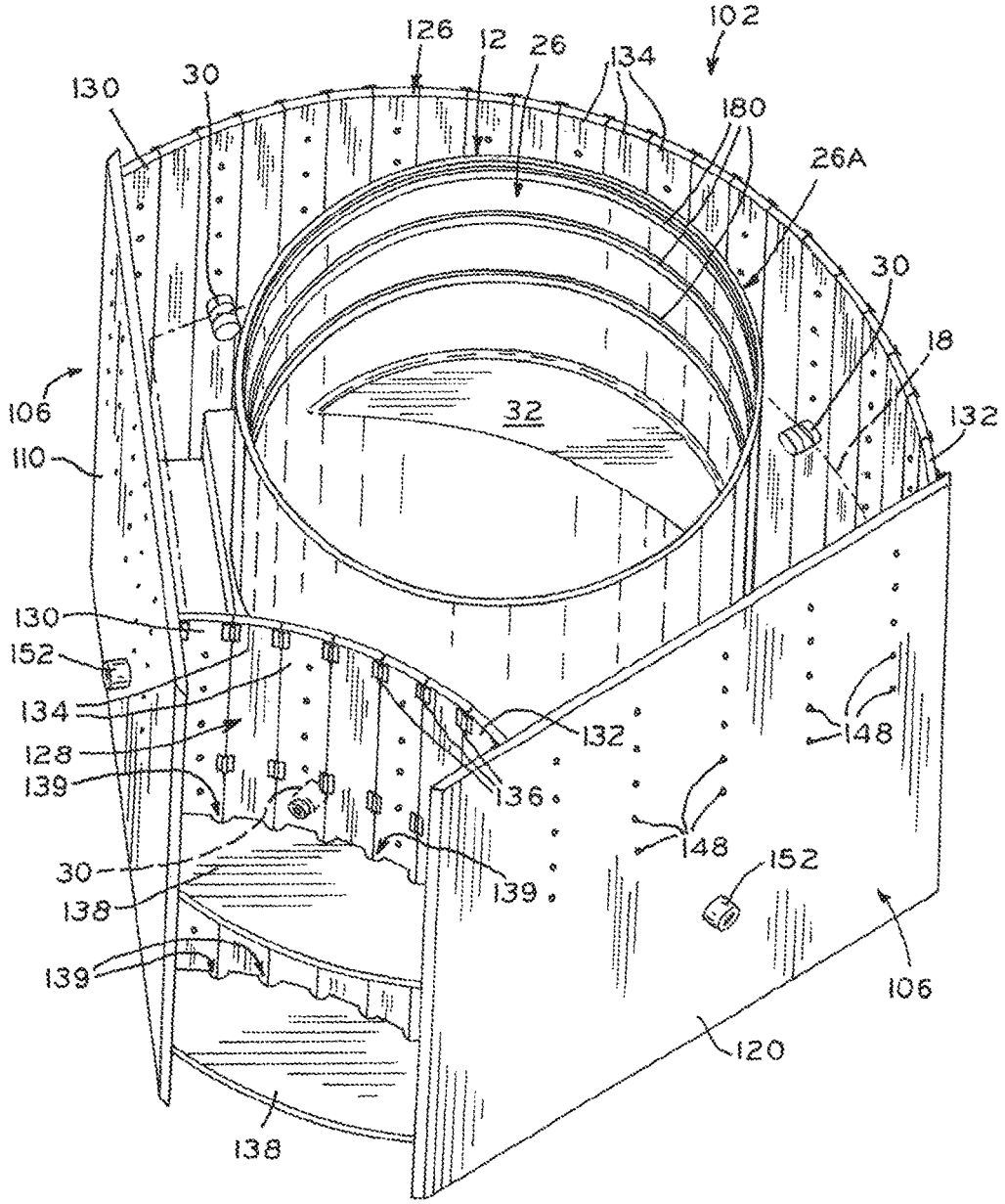
FIG. 21 is a perspective view of a pre-casting assembly of the manhole form assembly shown in FIG. 11, illustrating alternative arrangements of various components of the pre-casting assembly.

FIG. 12 is an exploded view illustrating the various components and subassemblies used in conjunction with manhole form assembly 100. As described in further detail below, support assemblies 106 are assembled to liner 12 via the first and second pipe apertures 20, 22 of liner 12. Support assemblies 106 are in turn assembled to front wall 116 and to back wall assembly 126 to form an internal cavity used as a concrete form, with a base (not shown) of casting jacket 104 forming the bottom of the form. Header 154 is also assembled to liner 12 at entry aperture 26 forming the top of the form. Pour cover 160 is received through header 154 into entry aperture 26. Alternatively, header assembly 154A may be used as further described below. Pre-casting assembly 102, also shown in FIG. 21, is assembled from some or all of the above-described components. In some applications, pre-casting assembly 102 is sized to be received in casting jacket 104, while other applications use pre-casting assembly 102 as a stand-alone casting form. Casting jacket 104 may be used to provide structural support for pre-casting assembly 102 as concrete is poured into the form cavity, such that the flowable concrete sets into the non-cylindrical concrete base 14 around liner 12 as shown in FIG. 1 and described above.

Figure 13:
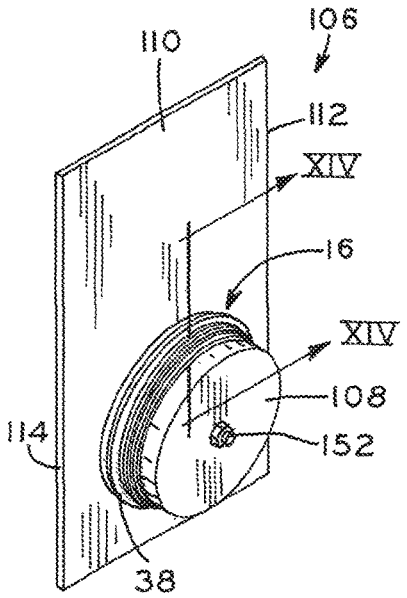
FIG. 13 is a perspective view of a forming plate assembly made in accordance with the present disclosure.
Figure 14:
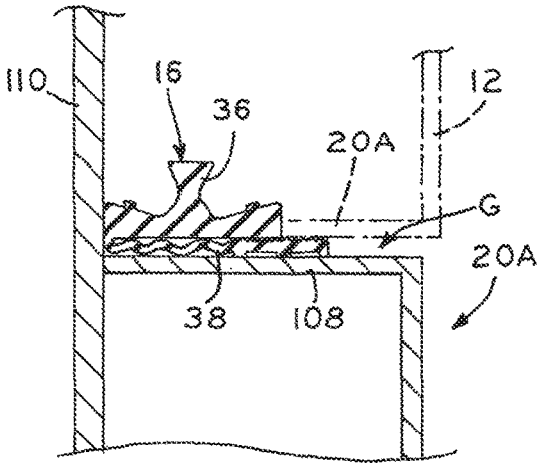
FIG. 14 is an elevation, cross-section view, taken along the line XIV-XIV of FIG. 13, illustrating a folded gasket configuration on the forming plate assembly.
Figure 15:
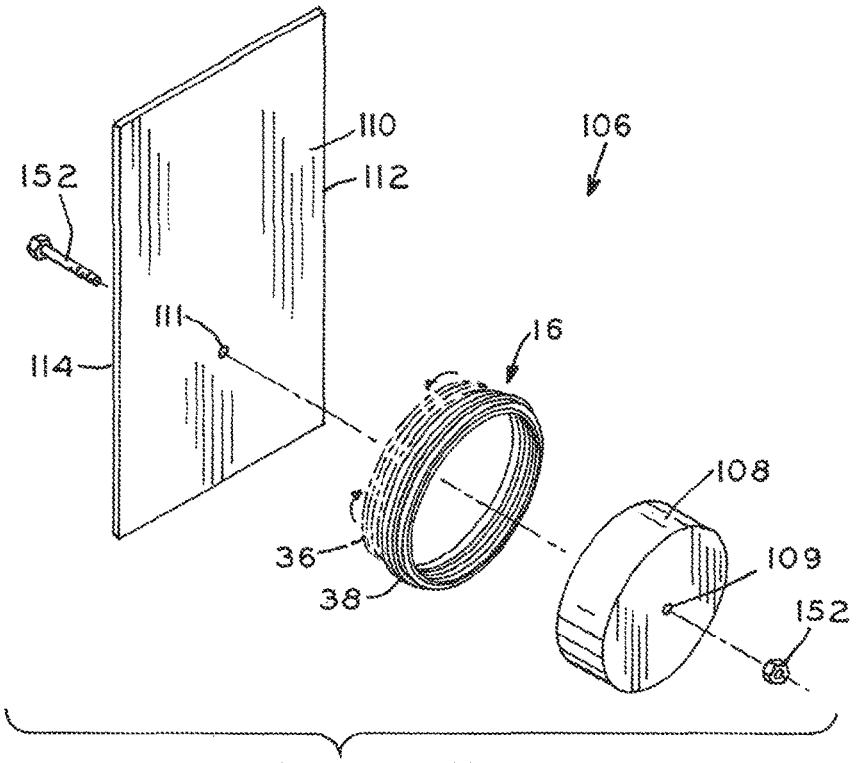
FIG. 15 is a perspective, exploded view of the forming plate assembly shown in FIG. 13.

Prior to assembly of pre-casting assembly 102, aperture support assemblies 106 are prepared as shown in FIGS. 13 and 15. Gasket 16 is received upon the cylindrical outer surface of aperture support 108, which may be a cylinder or cup-shaped component made of, e.g., hollow rotationally molded polymer or metal. As shown in FIG. 14, sealing section 38 is folded inwardly upon mounting to aperture support 108 such that sealing section 38 is disposed between anchoring portion 36 and the outer surface of aperture support 108. This configuration protects sealing section 38 from exposure to concrete flow during formation of concrete base 14. Aperture support 108 is then affixed to first forming plate 110 via fastener 152, shown as a bolt and nut in FIG. 15. When so mounted, aperture support 108 and anchoring portion 36 of gasket 16 abut the adjacent surface of first forming plate 110, as shown in FIGS. 13 and 14.

Aperture support assembly 106 is then mounted to first pipe aperture 20, as illustrated in FIGS. 14 and 21. In particular, aperture support 108 is received within aperture 20 until the axial end of anchoring section 36 opposite plate 110 abuts aperture portion 20A of liner 12. A second aperture support assembly 106 is then formed in the same manner as the first, except the second assembly 106 includes second forming plate 120 as shown in FIG. 12. In the illustrated embodiment, first and second forming plates 110, 120 are identical, in order to match the correspondingly identical first and second pipe apertures 20, 22. However, it is contemplated that the first and second aperture support assemblies 106, including forming plates 110 and 120, may be varied in order to accommodate correspondingly varied geometrical configurations for liner 12, as further described below. Similarly, aperture supports 108 and gaskets 16 may not be identical between the two aperture support assemblies 106, as required or desired for a particular application.

Figure 19:
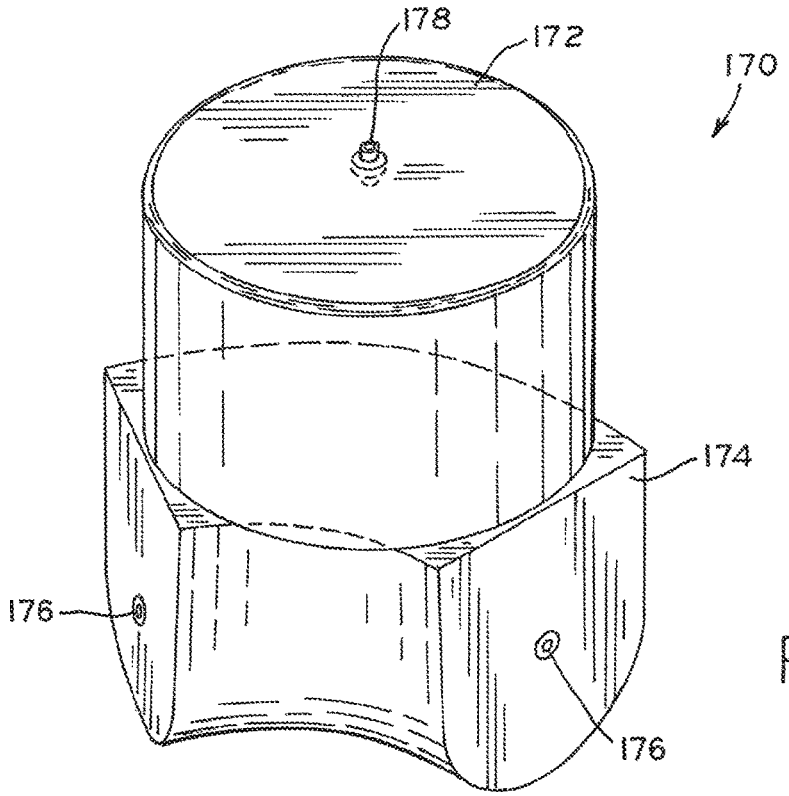
FIG. 19 is a perspective view of an inflatable liner support made in accordance with the present disclosure.
Figure 20:
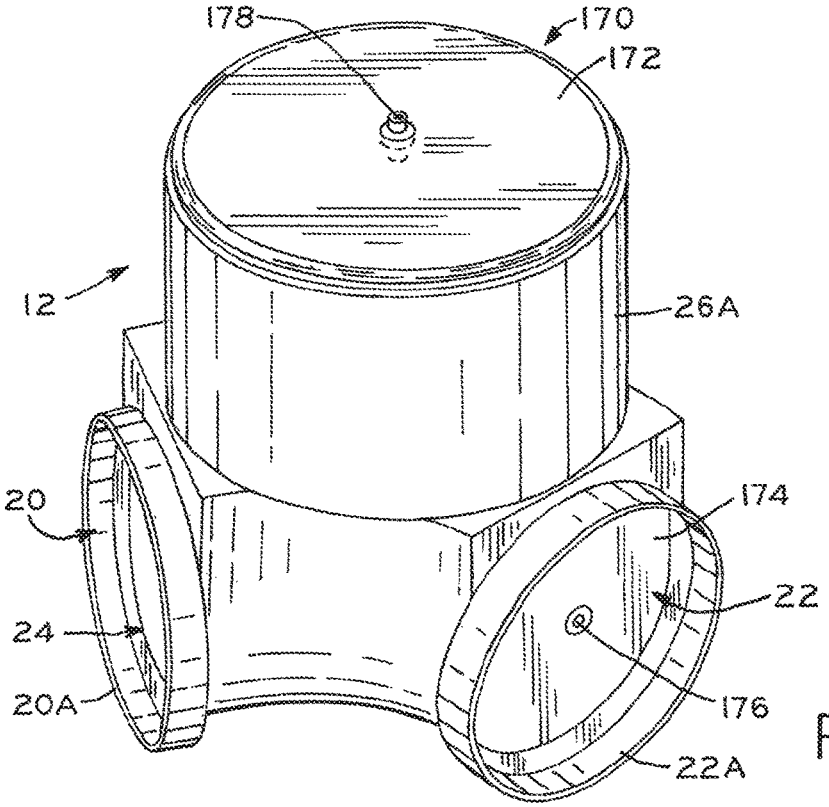
FIG. 20 is a perspective view of the liner made in accordance with the present disclosure, with the inflatable liner support of FIG. 19 received therein.

In one exemplary embodiment, aperture support assemblies 106 are simply press-fit into apertures 20 and 22. However, in some instances, it may be desirable to affix aperture support assemblies 106 in their assembled positions to ensure their proper positioning with respect to liner 12 throughout the casting process. FIG. 19 illustrates inflatable liner support 170, sized to be received within liner 12 during the casting process. Inflatable liner support 170 includes entry aperture support 172, sized to be received within an entry aperture 26 of liner 12, and flow channel support 174 sized to be received within flow channel 24 between first and second pipe apertures 20, 22 of liner 12. FIG. 20 illustrates inflatable liner support 170 received within liner 12. As illustrated in FIGS. 19 and 20, flow channel support 174 may include fastener receivers 176 at the end surfaces adjacent first and second pipe apertures 20, 22 and positioned to receive the bolt portion of fastener 152 (FIGS. 13 and 15) when plates 110, 120 are assembled to liner 12. In this manner, inflatable liner supports 170 assist in the fixation of aperture support assemblies 106 to liner 12 during the casting process.

In addition, the fluid pressure within inflatable support 170 provides mechanical reinforcing support for liner 12 to avoid bending or buckling of the polymer material of liner 12 during the casting process. In the illustrated embodiment, inflatable liner support 170 includes air valve 178. Liner support 170 may be placed and arranged within liner 12 in a deflated configuration, and then inflated via air valve 178 to the configuration shown in FIG. 20. After the casting process, air valve 178 may be used to deflate inflatable liner support 170 for removal from liner 12. In the illustrated embodiment, entry aperture support 172 and flow channel support 174 are monolithically formed as a single inflatable component, though it is contemplated that these two structures may be formed as separate components each having an air valve 178. In another embodiment, inflatable liner support 170 may be used with, or may be replaced by, one or more pre-formed structures which fit within liner 12 to confirm to the geometry of liner 12 or otherwise provide mechanical and structural support during the casting process. Such structures may optionally be collapsible.

Figure 23:
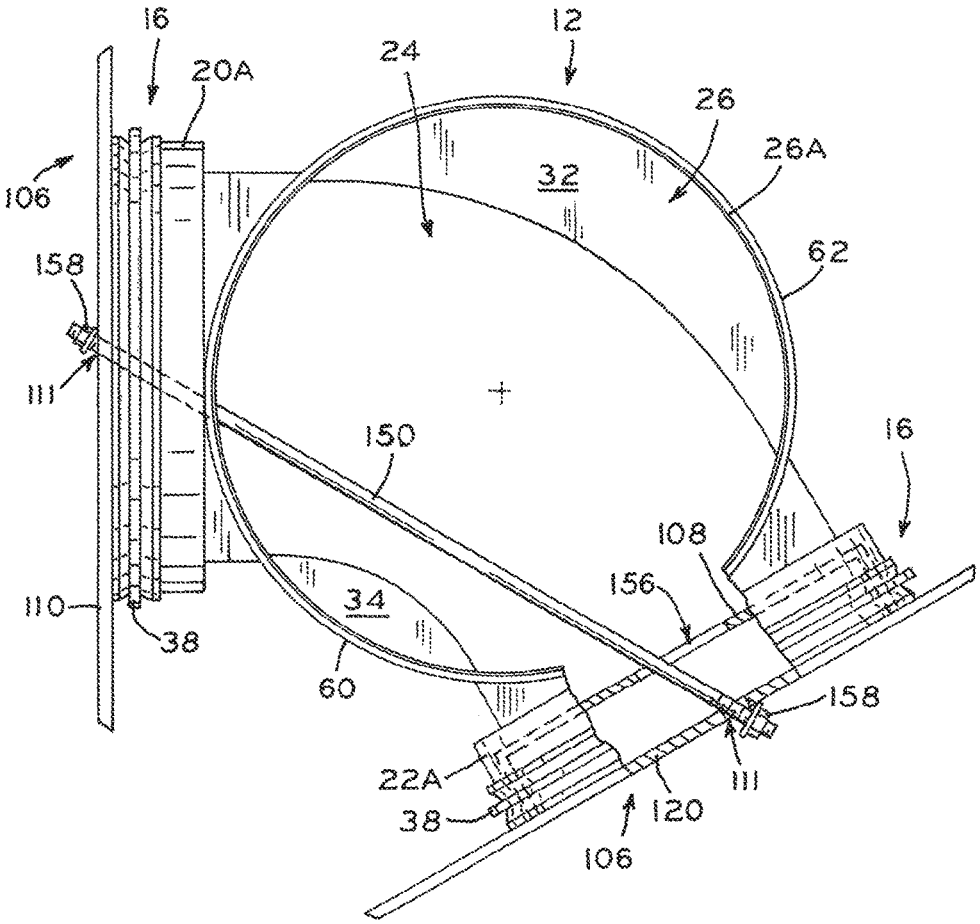
FIG. 23 is a top plan, partial-section view of a portion of the pre-casting assembly shown in FIG. 21, illustrating a tie rod for coupling two forming plate assemblies.

An alternative option for fixation of aperture support assemblies 106 to liner 12 is illustrated in FIG. 23. In this configuration, aperture support 108 includes an enlarged central aperture 156 sized to receive tie rod 150 therethrough. Upon assembly of aperture support assemblies 106 to aperture portions 20A, 22A of liner 12, tie rod 150 may be passed through fastener apertures 111 of first and second forming plates 110, 120 (FIG. 11) and through enlarged central apertures 156 of aperture supports 108, such that tie rod 150 passes through flow channel 24 of liner 12. As illustrated in FIG. 23, threaded ends of tie rod 150 may then receive nuts 158, which to draw aperture support assemblies 106 toward one another and introduce corresponding tension in tie rod 150. In this way, tie rod 150 can be used to fix aperture support assemblies 106 in desired positions relative to liner 12 during the casting process.

Figure 16:
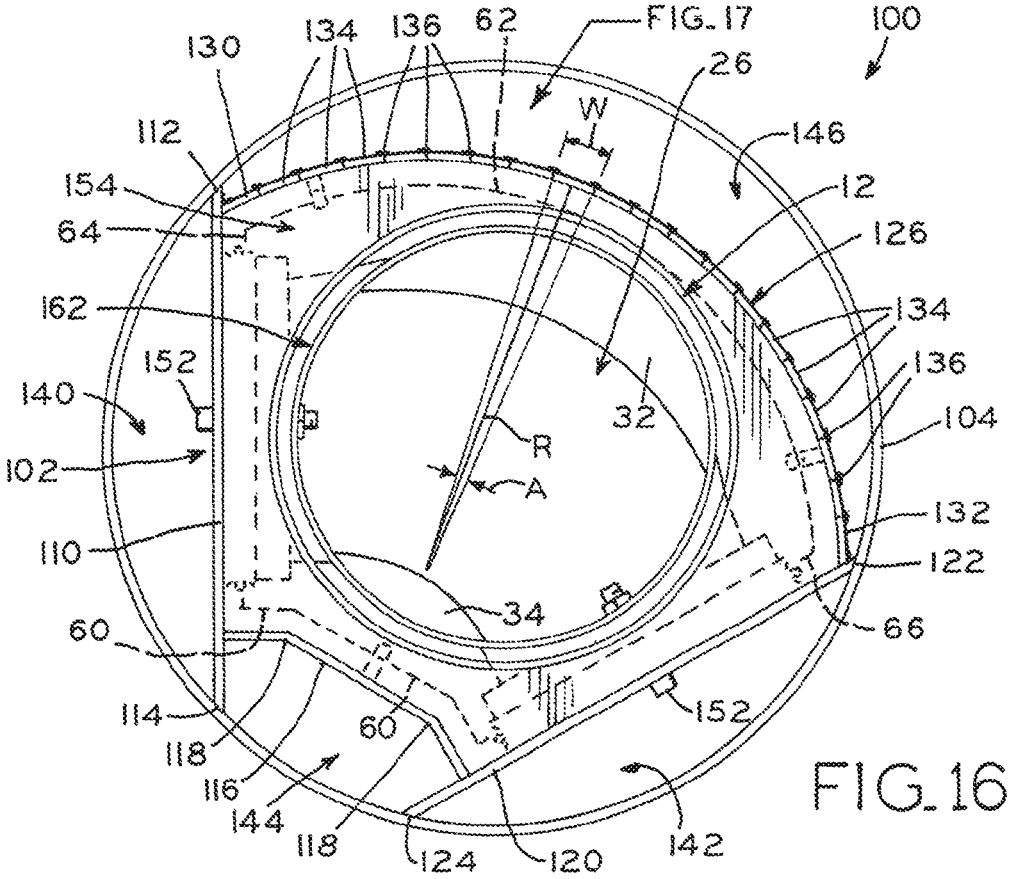
FIG. 16 is a top plan view of the manhole form assembly shown in FIG. 11.

Turning again to FIG. 12, with aperture support assemblies 106 assembled (and optionally affixed) to liner 12, front and back walls 116, 126 may be assembled to support assemblies 106 to form pre-casting assembly 102. In particular, front wall 116 is assembled to an inner surface of first forming plate 110 at a front portion near front edge 114, and to an opposing inner surface of second forming plate 120 at a front portion near front edge 124, as best seen in FIG. 16. In this way, front wall 116 spans a distance between first and second forming plates 110 and 120, and extends partially around liner 12. In the illustrated embodiment, front wall 116 includes two vertical bends 118 such that its profile as viewed from above (FIG. 16) more closely matches the adjacent corresponding profile of front wall 60 of liner 12. In particular, vertical bends 118 define an angle between the portions of wall 116 abutting first and second forming plates 110 and 120 that is commensurate with angle $\alpha$ defined by first and second pipe flow axes 52, 56 (shown in FIG. 5 and described in detail above).

Figure 25:
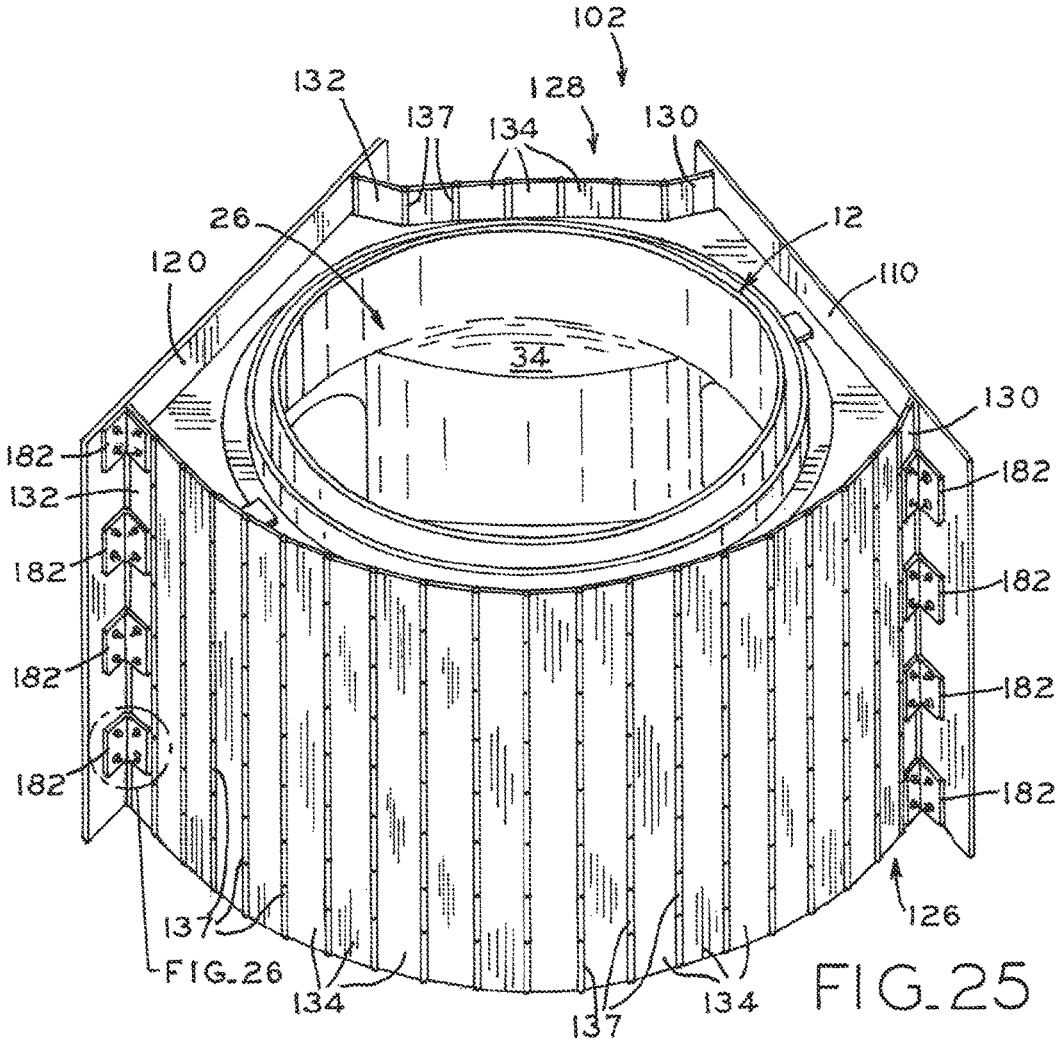
FIG. 25 is a perspective view of another pre-casting assembly of the manhole form assembly shown in FIG. 11, illustrating alternative arrangements of various components of the pre-casting assembly.
Figure 26:
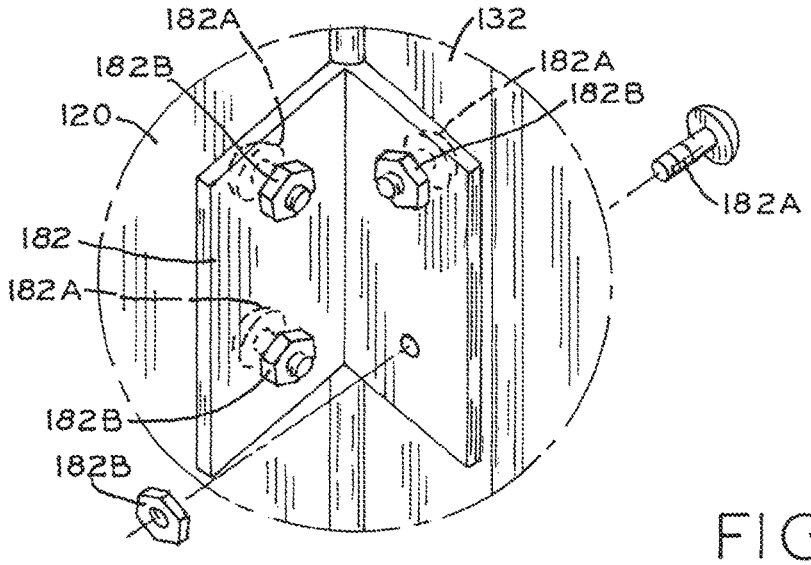
FIG. 26 is an enlarged, perspective view of a portion of FIG. 25, illustrating another connector bracket.

Hinged back wall assembly 126 is assembled to aperture support assemblies 106 in similar fashion to solid front wall 116. However, as shown in FIG. 12, hinged back wall assembly 126 includes multiple small segments, including first segment 130 abutting an inner surface of first forming plate 110 near back edge 112, last segment 132 abutting an inner surface of second forming plate 120 near back edge 122, and a plurality of intermediate segments 134 between the first and last segments 130, 132. As best seen in FIGS. 25 and 26, first segment 130 and last segment 132 are fixed to forming plates 110 and 120, respectively, by a series of connector brackets 182 via bolts 182A and nuts 182B (FIG. 26). A set of brackets 182 may be pre-formed with an appropriate angle corresponding to the desired angle between adjacent segments 130, 132 and forming plates 110, 120. Thus, for a particular angular arrangement of liner 12, an appropriate set of angles 184 is provided to ensure that back wall assembly 126 and front wall assembly 128 are firmly connected to forming plates 110 and 120.

Figure 25A:
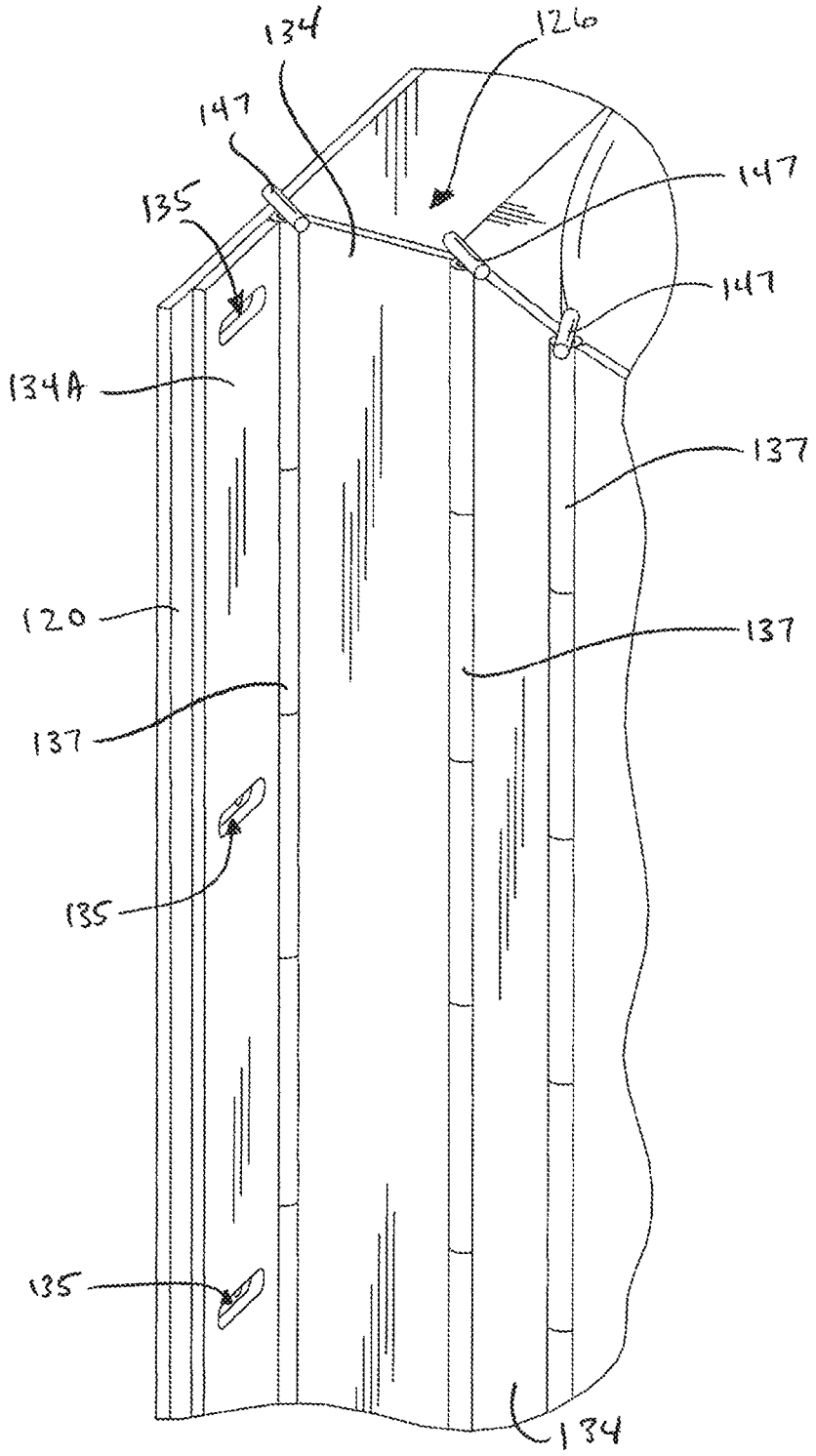
FIG. 25A is a perspective view of a portion of the pre-casting assembly shown in FIG. 25, illustrating a connector bracket.

In an alternative embodiment, first and last segments 130, 132 may be replaced with end hinge segments 134A, as shown in FIG. 25A. One end hinge segment 134A is provided at each vertical edge of back wall assembly 126, and also replaces angles 184. For example, end hinge segments 134A shown in FIG. 25A may have holes or slots 135 formed therein, and may be fixed (e.g., bolted) to forming plates 110, 120 respectively in order to fix hinged back wall assembly 126 thereto. Advantageously, such an arrangement allows for hinged back wall assembly to be modularly connected to adjacent forming plates 110, 120 with any angular arrangement. A similar system may also be used for front wall assembly 128.

Figure 17:
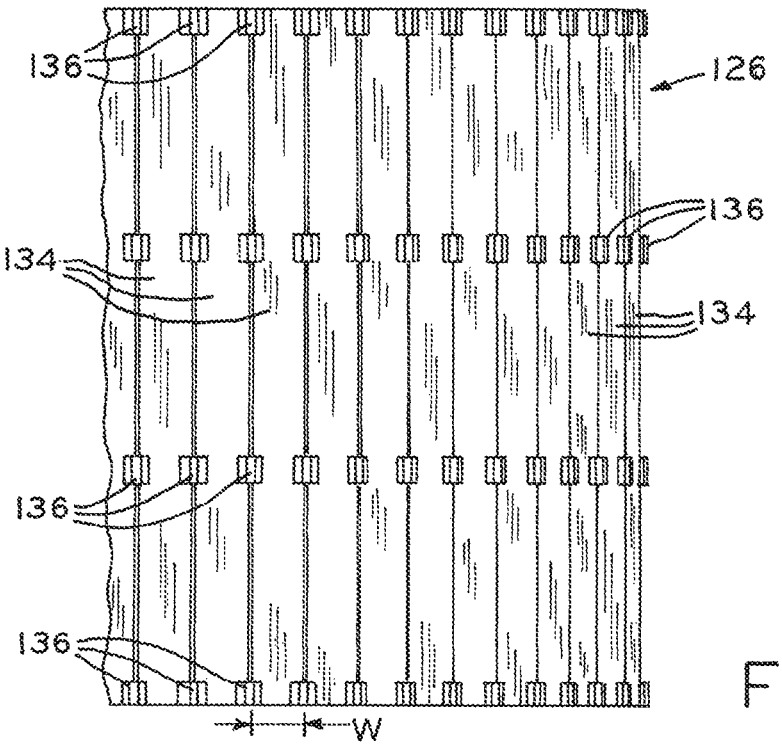
FIG. 17 is an elevation view of a back wall of the manhole form assembly shown in FIG. 16.
Figure 27:
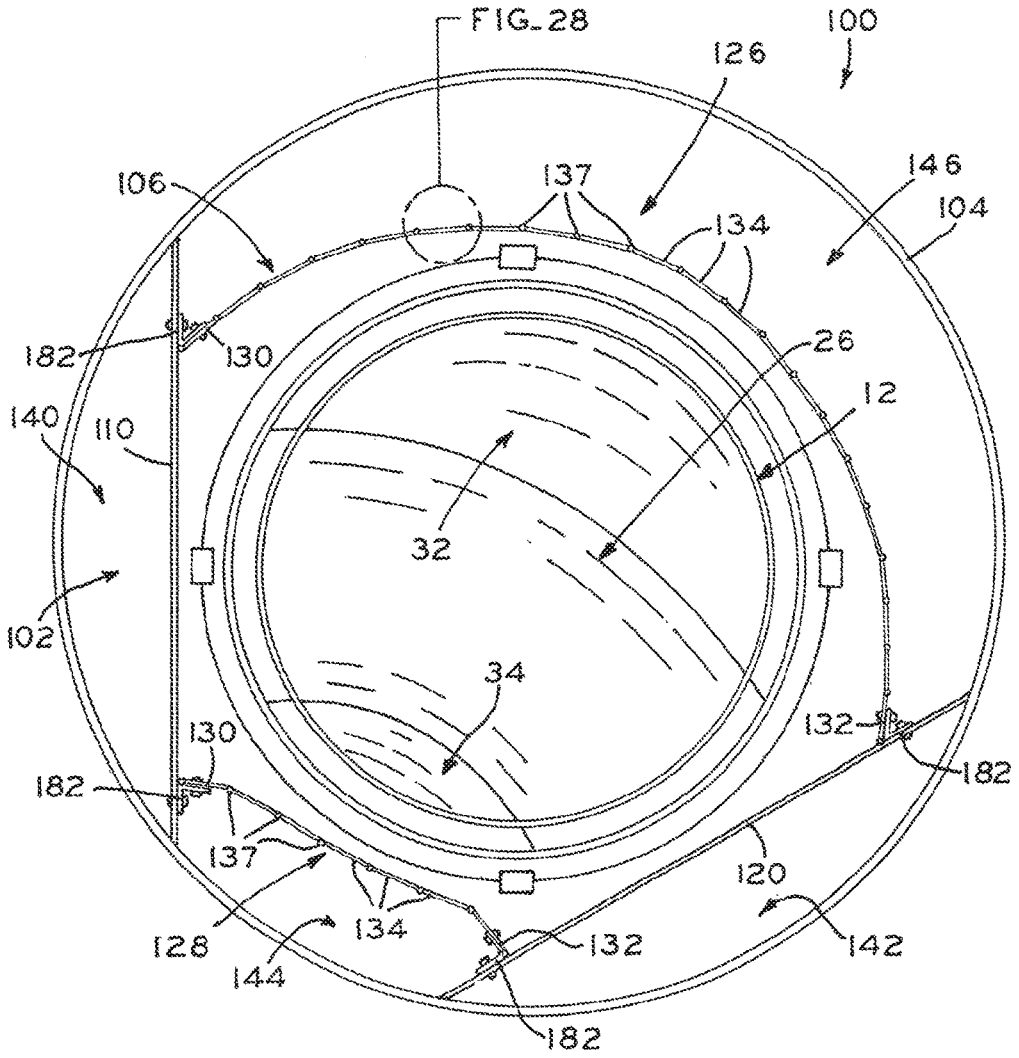
FIG. 27 is a top plan view of a manhole form assembly in accordance with the present disclosure, and including the pre-casting assembly of FIG. 25.
Figure 28:
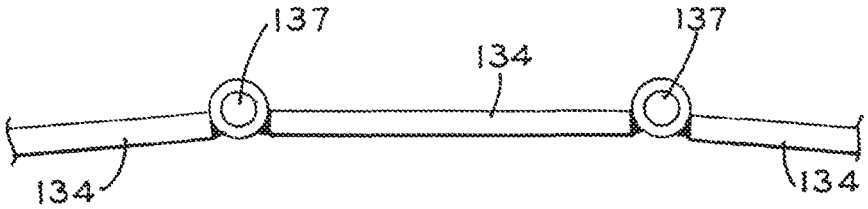
FIG. 28 is a top plan view of a portion of a FIG. 27, illustrating a piano hinge configuration.
Figure 29:
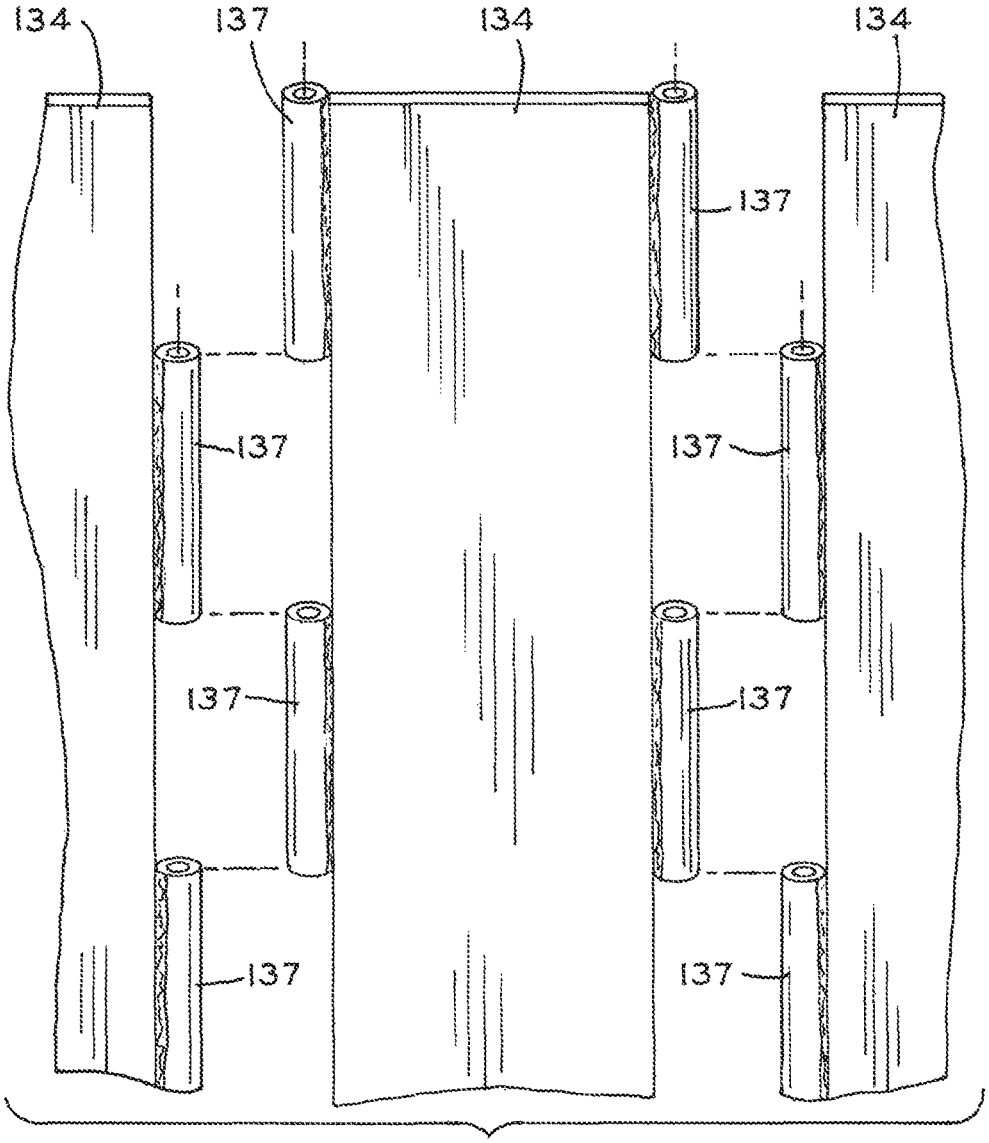
FIG. 29 is an exploded, perspective view of the piano hinge shown in FIG. 28.

As best seen in FIG. 17, segments 134 and 130, 132 or 134A are hingedly connected to one another about vertical axes via hinges 136, illustrated as a series of discrete hinges distributed along the edges of segments 130, 132 and 134. Alternatively, piano-style hinges 137 may be used, as best seen in FIGS. 27-29. Piano hinges 137 provide continuous support along the entire vertical extent of segments 130, 132 and 134, thereby mitigating or preventing any "bleeding," (i.e., leakage or seepage) of concrete during the casting process. This continuous support, in turn, allows the individual segments 130, 132 and 134 to move and flex during the casting process such that the internal pressure created by the flowing concrete naturally configures back and front wall assemblies 126 and 128 into a curvature with evenly distributed pressure. In an exemplary embodiment shown in FIG. 28, hinges 137 are offset to the outside of pre-casting assembly 102 (i.e., towards void 146 as shown in FIG. 27) such that the outer periphery of hinges 137 are substantially flush with the interior surfaces of the adjacent segments 130, 132 or 134. This flush arrangement ensures that the resulting concrete casting will have a relatively smooth outer surface without indentations resulting from the presence of hinges 137. In addition, hinges 137 are easily assembled and disassembled, by simply interleaving neighboring pairs of segments 130, 132 and 134 (FIG. 29) and passing an elongated hinge pin 147 (FIG. 25A) therethrough. In an exemplary embodiment, hinge pins 147 each have a "T" handle at the top of the pin to facilitate installation and removal of pins 147 into hinges 137.

With segments 134 hingedly connected to one another and to segments 130, 132 and/or 134A, back wall 126 forms a generally arcuate profile defining radius R, as shown in FIG. 16. This arcuate profile generally corresponds to the arcuate profile of back wall 62 of liner 12, thereby minimizing excess use of concrete and promoting uniformity in base thickness $T_B$, as described above. Moreover, the angle formed between first and last segments 130 and 132 when viewed from above (FIG. 16) is commensurate with the reflex angle θ defined by pipe flow axes 52, 56, shown in FIG. 5 and described in detail above.

Referring still to FIG. 16, each of segments 130, 132 and 134 of hinged back wall assembly 126 defines a segment width W spanning an incremental angle A for the given radius R. Due to the hinged connection between neighboring pairs of segments 130, 132, 134 and the radiused arcuate profile of back wall 126, angle A and width W cooperate to form an isosceles triangle. Thus, incremental angle A can be expressed in terms of width W and radius R as $$A = 2\tan^{1}\left(\frac{W}{2R}\right)$$

where radius R is assumed to be the arc inscribed within the multifaceted arcuate profile formed by back wall 126. If radius R is assumed to be circumscribed around this multifaceted arcuate profile, incremental angle A can be expressed in terms of width W and radius R as $$A = 2\sin^{-1}\left(\frac{W}{2R}\right).$$

As a practical matter, where A is small (e.g., 6 degrees as noted herein), taking R as circumscribed around or inscribed within the multifaceted arcuate profile of back wall 126 does not make a significant difference.

The number n of segments 130, 132, 134A and 134 can be chosen such that the total angle traversed by back wall 126 is equal to n*A, or the number of segments multiplied by the incremental angle A defined by each segment. In an exemplary embodiment, A is equal to about 6°, such that back wall 126 can be modularly assembled to sweep through any desired angle divisible by 6. Thus, in the illustrated embodiment in which obtuse angle α is 120 degrees, the number N of segments 130, 132, 134A and 134 is 120/6, or 20 segments.

Figure 22:
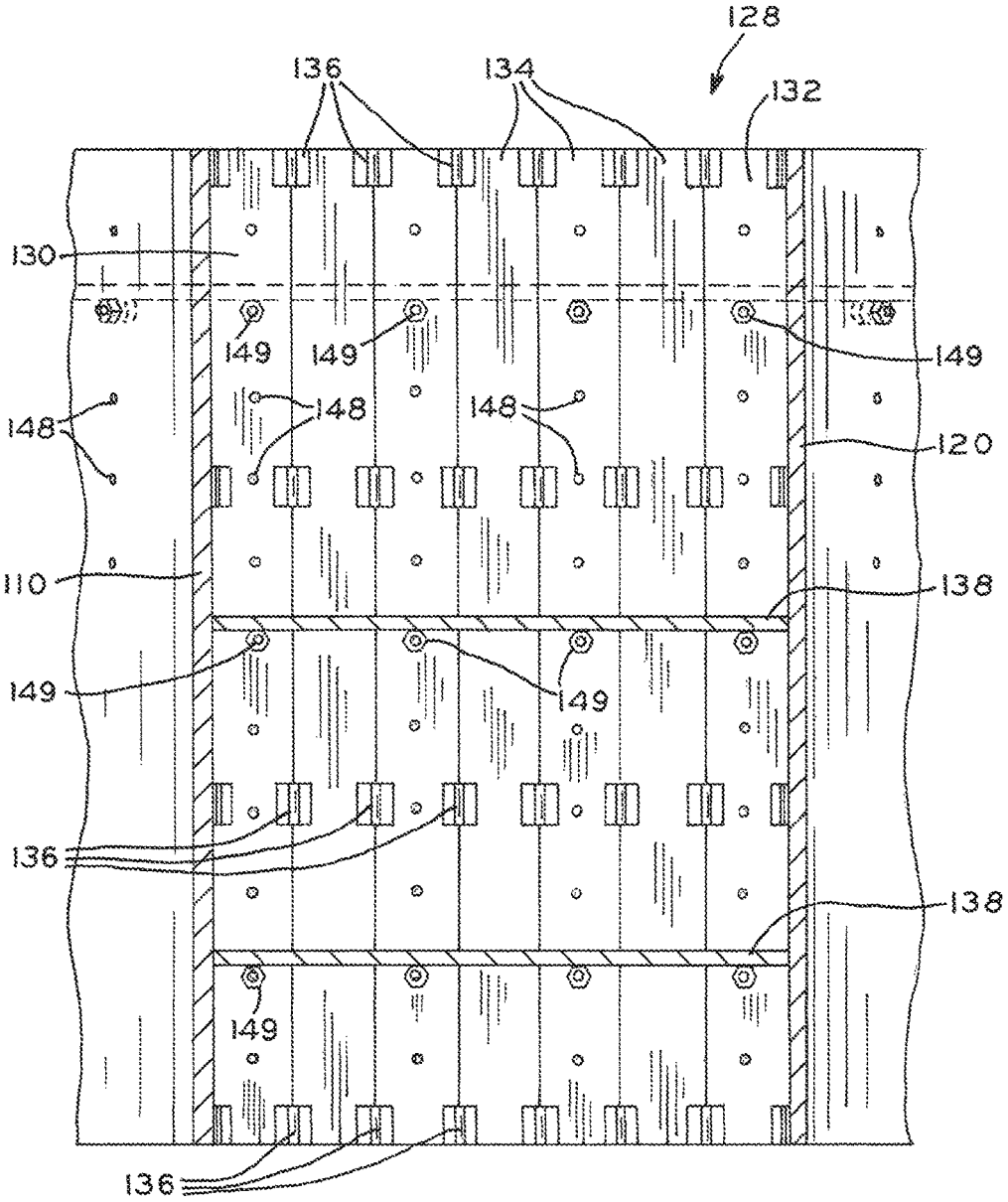
FIG. 22 is an elevation view of a portion of the pre-casting assembly shown in FIG. 21, illustrating a hinged front wall.

Referring to FIG. 21, hinged front wall assembly 128 is an alternative to the solid front wall 116 shown in FIG. 12 and described above. Hinged front wall assembly 128 is constructed similarly to hinged back wall assembly 126, and may be made from the same constituent parts (i.e., segments 130, 132, 134A, 134 and hinges 136 or 137). However, because hinged front wall assembly 128 curves inwardly toward the interior cavity of pre-casting assembly 102 (i.e., because the convex arcuate surface of front wall assembly 128 faces in), additional mechanical support is needed to prevent fluid pressure from bulging respective wall segments 130, 132, 134A or 134 outwardly. To this end, support plates 138 may be provided between first and second forming plates 110 and 120, with an arcuate interior edge abutting each of the segments 130, 132, 134A and 134. In the illustrated embodiment, support plates 138 include hinge recesses 139 to allow plates 138 to be lowered into place over hinges 136. Referring to FIG. 22, selected ones of segments 130, 132, 134A or 134 may include a plurality of support apertures 148 formed along the vertical extent thereof. Support fasteners 149 may be provided in selected apertures 148 in order to hold support plates 138 at a desired vertical position.

In some embodiments, a front wall (e.g., solid wall 116 or assembly 128) may not be needed at all. For example, for some configurations of manhole base assembly 10, front wall 70 of concrete base 14 may be formed against the interior of casting jacket 104 without a separate front wall provided in pre-casting assembly 102.

With aperture support assemblies 106 assembled to liner 12 and front and back walls 116, 126 assembled to support assemblies 106, the basic form of pre-casting assembly 102 is complete. Pre-casting assembly 102 can then used as a stand-alone casting form, or can be lowered into casting jacket 104 as a single unit in preparation for the introduction of mixed flowable concrete to form concrete base 14. Alternatively, aperture support assemblies 106 and liner 12 can be lowered into casting jacket 104 prior to assembly of front and back walls 116, 126, which can be individually lowered into casting jacket 104 to complete pre-casting assembly 102 within the cylindrical cavity of casting jacket 104.

Figure 21A:
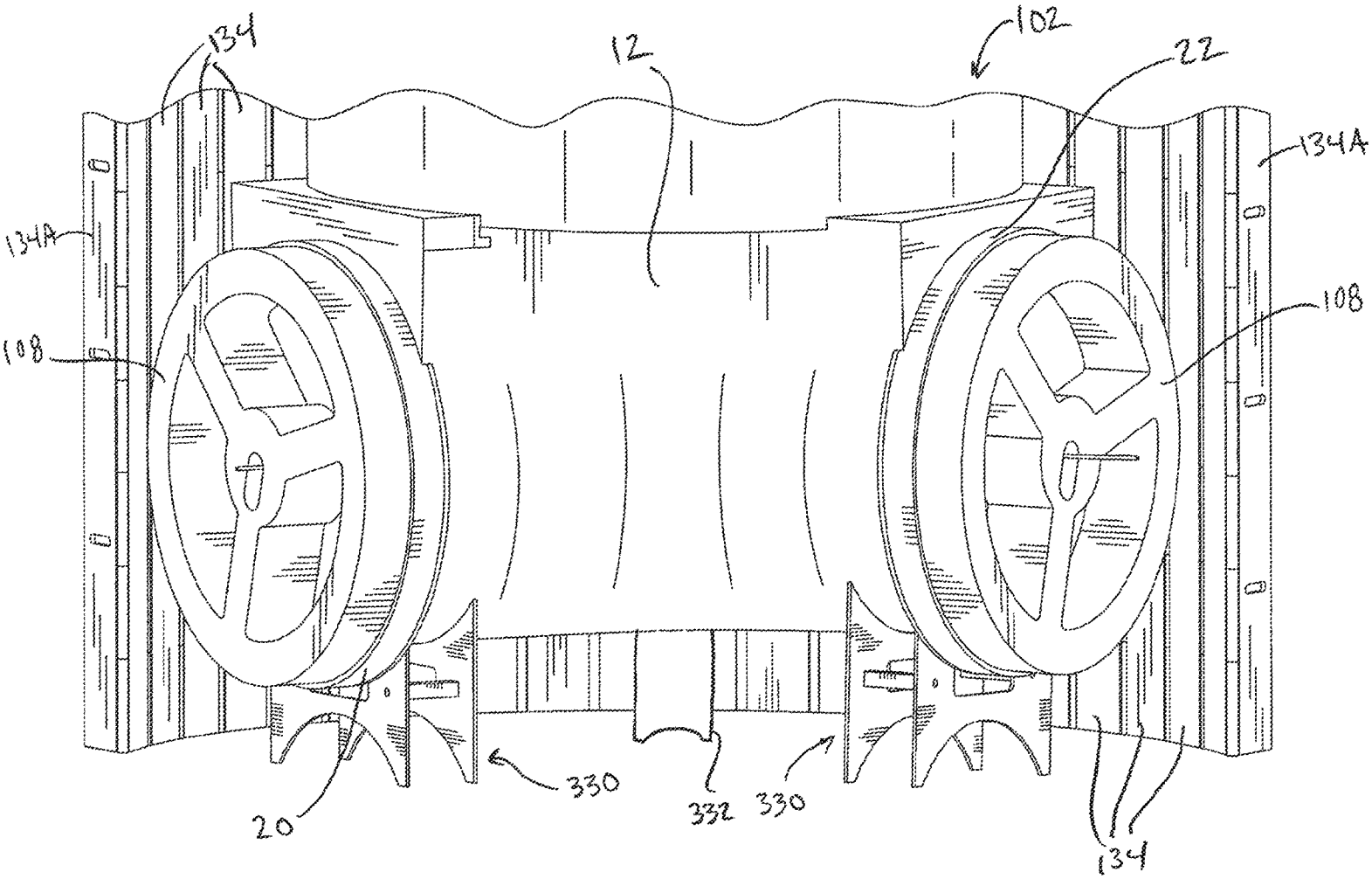
FIG. 21A is a perspective view of a portion of the pre-casting assembly shown in FIG. 21, illustrating liner supports made in accordance with the present disclosure.

Pre-casting assembly 102 may further include liner supports 330, 332 to ensure desired vertical positioning and rotational orientation of liner 12 within the casting cavity defined by pre-casting assembly 102. In particular, first and second pipe apertures 20, 22 of liner 12 may be supported by liner supports 330 prior to and during the casting process, as shown in FIG. 21A. Each liner support 330 has a rounded upper profile configured to continuously engage the correspondingly rounded outer profile of liner 12 adjacent first and second pipe apertures 20 and 22. In FIG. 21A, various portions of pre-casting assembly 102 are removed for clarity, it being understood that all portions of pre-casting assembly 102 are used in conjunction with liner supports 330. In addition, a separate liner support 332 may be placed at any location underneath liner between apertures 20 and 22 (and, therefore, between liner supports 330) in order to provide a three-point support system for liner 12.

Liner supports 330, 332 are sized to provide a desired drop within flow channel 24 (FIG. 6) from entry (which may be one of pipe apertures 20, 22) to exit (which may be the other of pipe apertures 20, 22). For example, a drop between slightly greater than 0 and 3 inches from inlet to outlet may be desirable to ensure fluid flow in the desired direction, as well as complete draining of liner 12 in the absents of incoming flow. Moreover, supports 330, 332 establish this desired low profile prior to the formation of concrete base 14 by casting, such that liner 12 is securely and properly oriented and configured within pre-casting assembly 102 when the concrete pouring operation begins.

In one embodiment, liner supports 330 and/or rear support 332 may have an adjustable height, such as with adjustable threaded footers, slidable components which adjust the overall height, and like. Thus, supports 330, 332 may be modularly adjusted on site prior to the concrete pouring operation in order to ensure the desired flow profile within flow channel 24. For manhole base assembly liners including more than two entry/exit apertures as discussed herein, additional liner supports 330 may be provided as required or desired for a particular application.

When pre-casting assembly 102 is received within the cylindrical casting jacket 104 as shown in FIG. 11, a set of four voids 140, 142, 144 and 146 are formed between the inner cylindrical surface of casting jacket 104 and the adjacent outer surfaces of forming plates 110, 120 and walls 116, 126. In particular, first void 140 is bounded by first forming plate 110 and the opposing inner surface of casting jacket 104, second void 142 is bounded by second forming plate 120 and the opposing inner surface of casting jacket 104, third void 144 is bounded by the first and second forming plates 110, 120, front wall 116 and the opposing inner surface of casting jacket 104, and the fourth and final void 146 is bounded by first and second forming plates 110, 120, back wall 126, and the opposing inner surface of casting jacket 104. In some embodiments, it is contemplated that front wall 116 and/or back wall 126 may be mated directly to front edges 114, 124 or back edges 112, 122 of forming plates 110, 120, respectively. In that configuration, the third and fourth voids 144 and 146 would be bounded only by casting jacket 104 and front or back wall 116 or 126. In yet another configuration, the edges of front and back walls 116, 126 may be spaced away from the adjacent edges of forming plates 110, 120 and directly in contact with an inner surface of casting jacket 104, in which case third and fourth voids 144 and 146 would again be bounded only by casting jacket 104 and front or back wall 116 or 126.

Figure 21B:
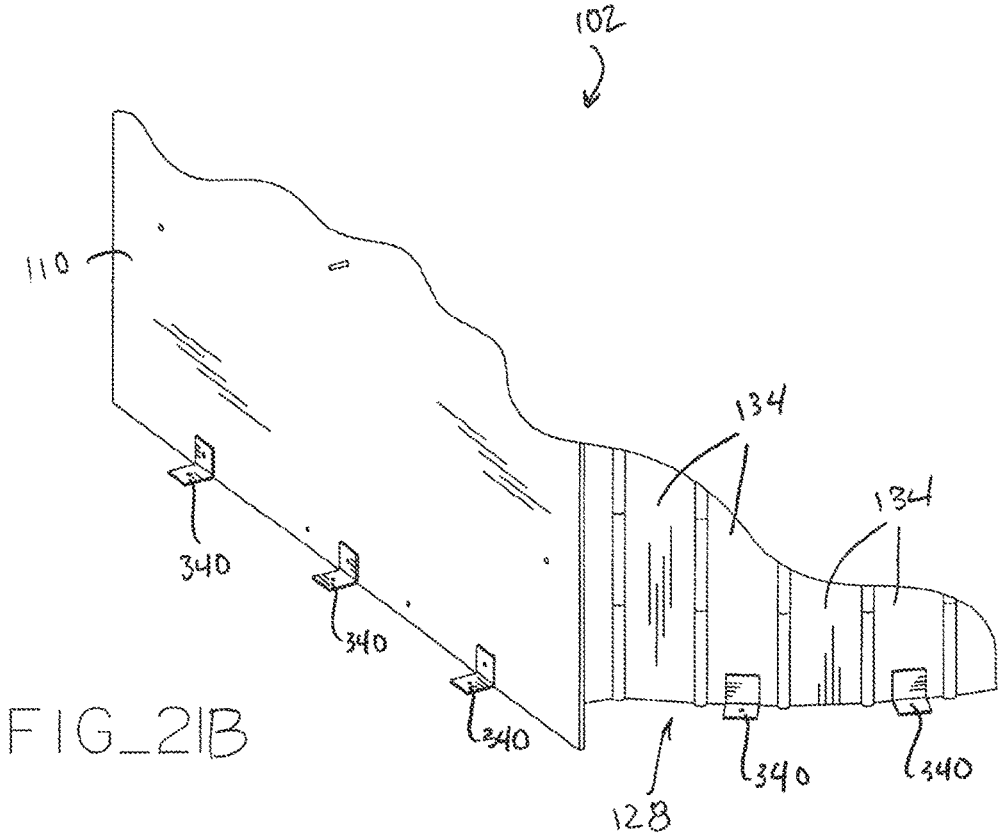
FIG. 21B is a partial perspective view of the pre-casting assembly shown in FIG. 21, illustrating pre-casting assembly anchors made in accordance with the present disclosure.

In some applications, casting jacket 104 may be eliminated such that pre-casting assembly 102 is used as a standalone unit during the concrete pour operation. Moreover, the inventors have found that forming plates 110, 120 and back and front wall assemblies 126, 128 have sufficient strength and rigidity to withstand the pressure of a concrete pour operation for many configurations of manhole base assembly 10, without the need for casting jacket 104 providing additional support. In this casting method, pre-casting assembly 102 is simply placed onto a flat surface, such as a pour plate made of steel or similar material, and anchored in place (as shown in FIG. 21B and further described below) prior to the pour operation.

Header 154 may also be included to form an upper barrier for the flow of concrete into the cavity formed by pre-casting assembly 102, corresponding with top wall 80 of concrete base 14 after the pour operation is complete. The lower barrier, corresponding with bottom wall 78 of concrete base 14, is a closed bottom end of casting jacket 104. As best seen in FIGS. 12 and 16, header 154 has an outer periphery which corresponds to the non-cylindrical peripheral boundary defined by pre-casting assembly 102, and in particular, by first and second forming plates 110, 120 and front and back walls 116, 126. Header 154 further includes an inner collar 166 defining an inner periphery sized to be received over entry aperture portion 26A of liner 12 with clearance, such that annular pour gap 162 (FIG. 16) is formed between the inner surface of collar 166 and the adjacent outer surface of entry aperture portion 26A.

In an alternative embodiment, forming plates 110, 120 and/or front and back walls 116, 126 can formed as wedge-shaped structures sized to substantially completely fill one of voids 140, 142, 144 or 146. For example, forming plate 110 may be a wedge shape with a flat inner surface and a curved, arcuate outer surface shaped to engage the adjacent inner surface of casting jacket 104. In this configuration, the wedge-shaped forming plate 110 can provide consistent mechanical support for formation of concrete base 14 with a reduced tendency to bend or bow under pressure. Such wedge-shaped structures may be formed in a similar fashion to concrete displacement wedge 276.

Figure 12A:
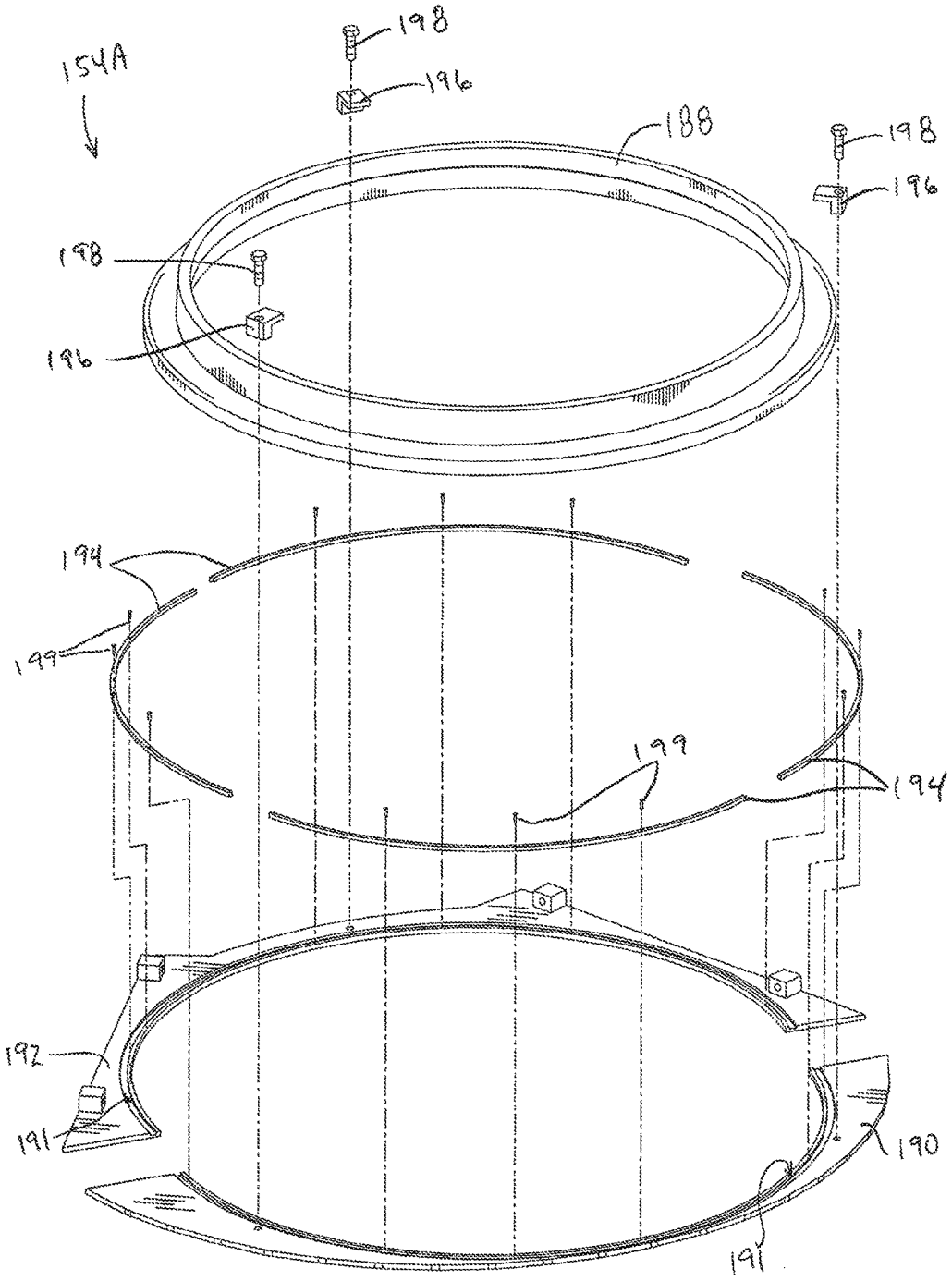
FIG. 12A is a perspective, exploded view of a header assembly used in conjunction with the pre-casting assembly shown in FIGS. 11 and 12.
Figure 12B:
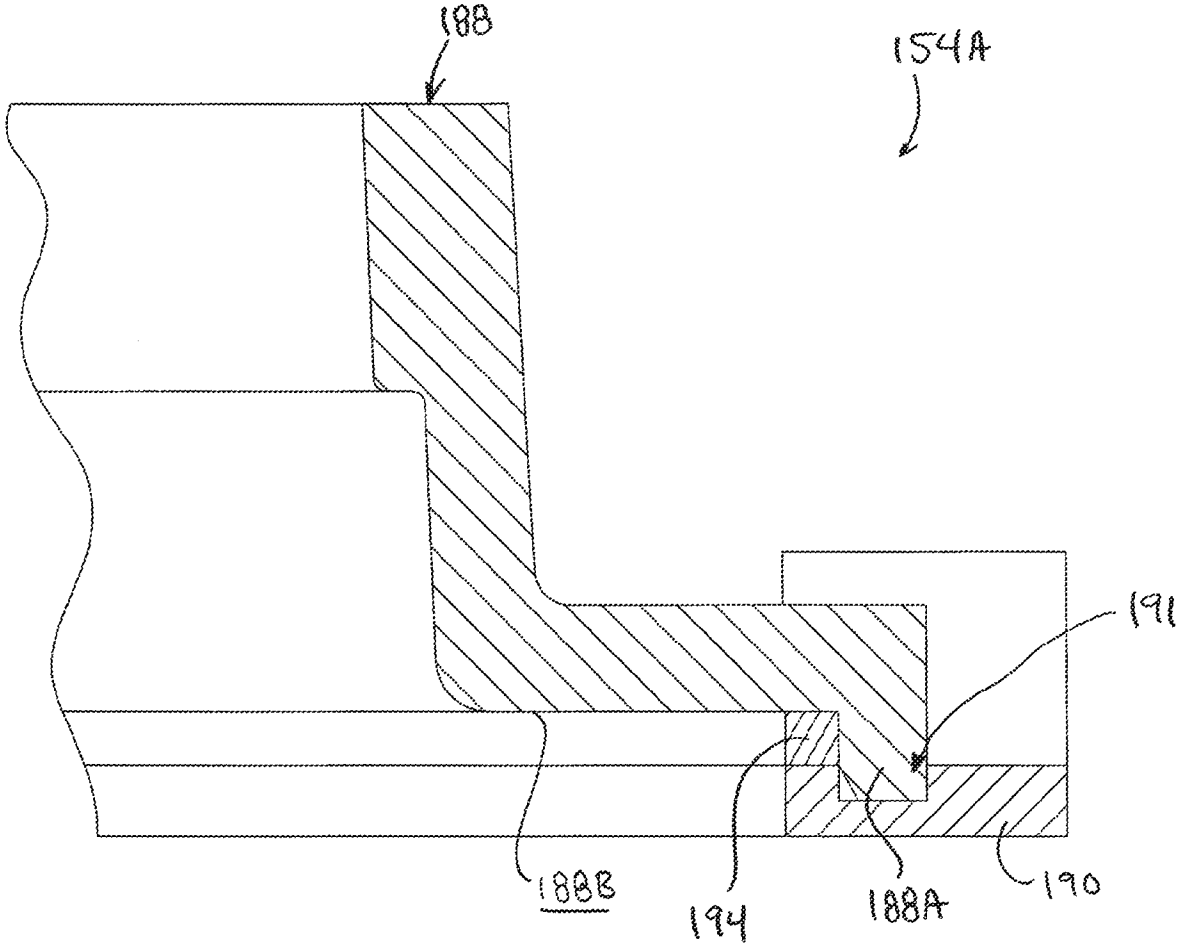
FIG. 12B is a partial perspective, cross-section view of the header assembly shown in FIG. 12A, after assembly.

FIGS. 12A and 12B illustrate header assembly 154A, which may be used interchangeably with header 154. Header assembly 154A includes header 188 mounted to first and second header plates 190 and 192, optionally including spacers 194 disposed therebetween as needed, all of which are fastened together using fastening clips 196 which engage header 188 and are threadably connected by bolts 198 to header plates 190, 192. In addition, screws 199 may be used to fasten spacers 194, where used, to plates 192, 190 (or to header 188).

As shown in FIG. 12B, plates 190, 192 (only one of which is shown in the cross section of FIG. 12B) includes a circumferential trough 191 sized to receive a correspondingly sized flange 188A of header 188. This engagement ensures a concentric and tight tolerance coaxial alignment between header 188 and the circular profile of plates 190, 192. Depending on the thickness of plates 190, 192, spacers 194 may be provided to occupy the internal radial space that may exist between the upper surface of header plates 190, 192 and the adjacent lower surface of header 188. When concrete fills the space up to the lower surface 188B of header 188 during the concrete pour operation, spacers 194 prevent plates 190, 192 from becoming cast into the concrete, such that plates 190, 192 remain removable after the concrete has set.

In an exemplary embodiment, plates 190, 192 are joined together (e.g., by welding) to form a substantially circular header plate engageable with header 188. These plates 190, 192 may be produced in any size and configuration as required for various sizes and configurations of manhole base assembly 10 as described herein. Meanwhile, a common header 188, which may be used across various other sizes and configurations of manhole base assembly 10, may modularly engage the various sizes of plates 190, 192, such that a customer-specific or otherwise predetermined specification for header 188 may be modularly attached to pre-casting assembly 102 via plates 190, 192 for any desired size and or shape of manhole base assembly 10. This multi-piece arrangement saves cost and simplifies production by avoiding the need for a monolithic custom part including both header 188 and forming plates 190, 192. Moreover, because header 188 is typically a high-tolerance machined component, the avoidance of producing multiple headers by modularly engaging existing headers 188 with the rest of header assembly 154A avoids the substantial cost associated with producing individual header/forming plate combinations for every configuration of manhole base assembly 10.

Figure 18:
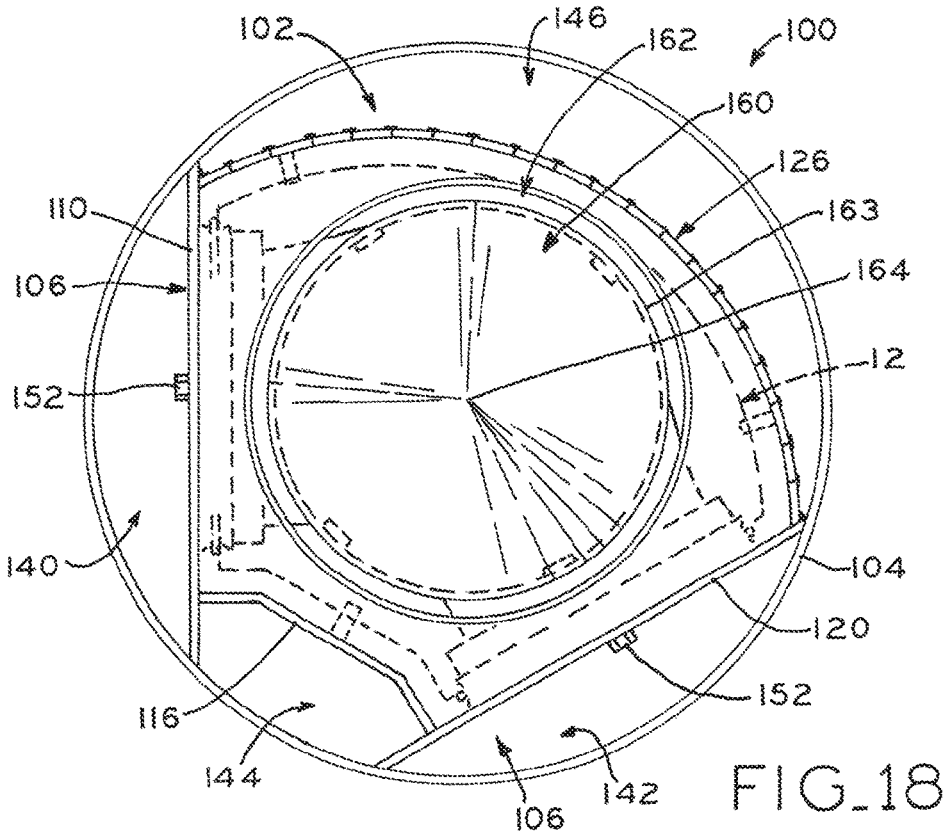
FIG. 18 is a top plan view of the manhole form assembly shown in FIG. 11, illustrated with a pour cover mounted thereon.

Pour cover 160 may be lowered through collar 166 of header 154 (or through header 188, where header assembly 154A is used) and seated upon entry aperture portion 26A to close entry aperture 26, as shown in FIGS. 12 and 18. Pour cover 160 includes a base portion 163 which blocks access to entry aperture 26 from above but is spaced away from the inner periphery of collar 166 of header 154 (or header 188)

to define gap 162, and peak portion 164 above the base portion 163. A tapered flow surface extends from peak 164 to base 163 such that cement mix can be poured over peak 164 and flow downwardly over the tapered surface toward base 163, and then through pour gap 162. This flowable cement then drops into pre-casting assembly 102 to fill the void bounded by forming plates 110, 120 and walls 116, 126. In this way, manhole base assembly can be cast in a "right side up" configuration while preventing concrete from infiltrating the inner cavity of liner 12 via entry aperture 26. In an exemplary embodiment, pour cover 160 is a conical structure in order to evenly distribute over the exterior surface of liner 12 to efficiently and accurately form concrete base 14.

As concrete pours into pre-casting assembly 102, the void within pre-casting assembly 102 begins to fill. Concrete is prevented from flowing into the interior of liner 12 by aperture support assemblies 106 at pipe apertures 20, 22, and by pour cover 160 at entry aperture 26 as noted above. Thus, during the period when the concrete in pre-casting assembly 102 remains flowable (i.e., before the concrete sets), liner 12 becomes buoyant. In order to maintain liner 12 in the desired position, anchor bar 48 shown in FIG. 2 may be fixed to the adjacent mesh of reinforcement rods 18, and reinforcement rods 18 may in turn be sized to substantially fill the inner cavity of pre-casting assembly 102, as shown in FIG. 12. In addition, header 154 or plates 190, 192 of header assembly 154A may be adjusted down to constrain any upward motion of reinforcement rods 18 during the initial pouring operation. In particular, as shown in FIG. 21, support apertures 148 may be formed in first and second forming plates 110, 120, as well as in selected ones of segments 130, 132 or 134 of back wall assembly 126 and/or hinged front wall assembly 128, where used. Fasteners received through support apertures 148 may define the vertical limit of motion for header 154 as it is lowered into pre-casting assembly 102. In this way, header 154 or header assembly 154A may initially constrain vertical motion of liner 12 while also ultimately defining the desired overall height of concrete base 14 by providing an upper casting surface of pre-casting assembly 102.

Figure 21C:
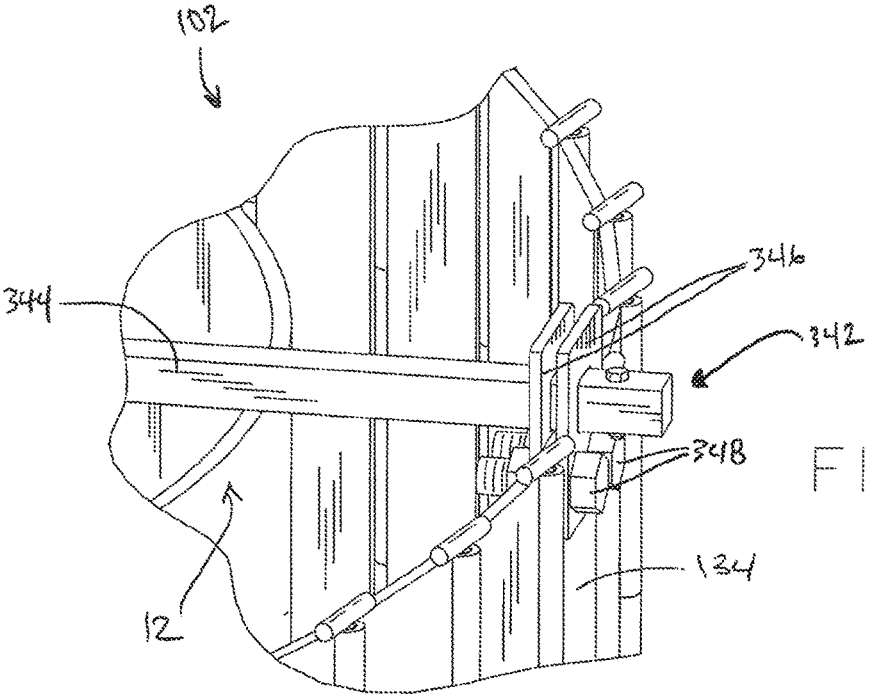
FIG. 21C is a partial perspective view of the pre-casting assembly shown in FIG. 21, illustrating a portion of a liner hold-down bar assembly made in accordance with the present disclosure.
Figure 21D:
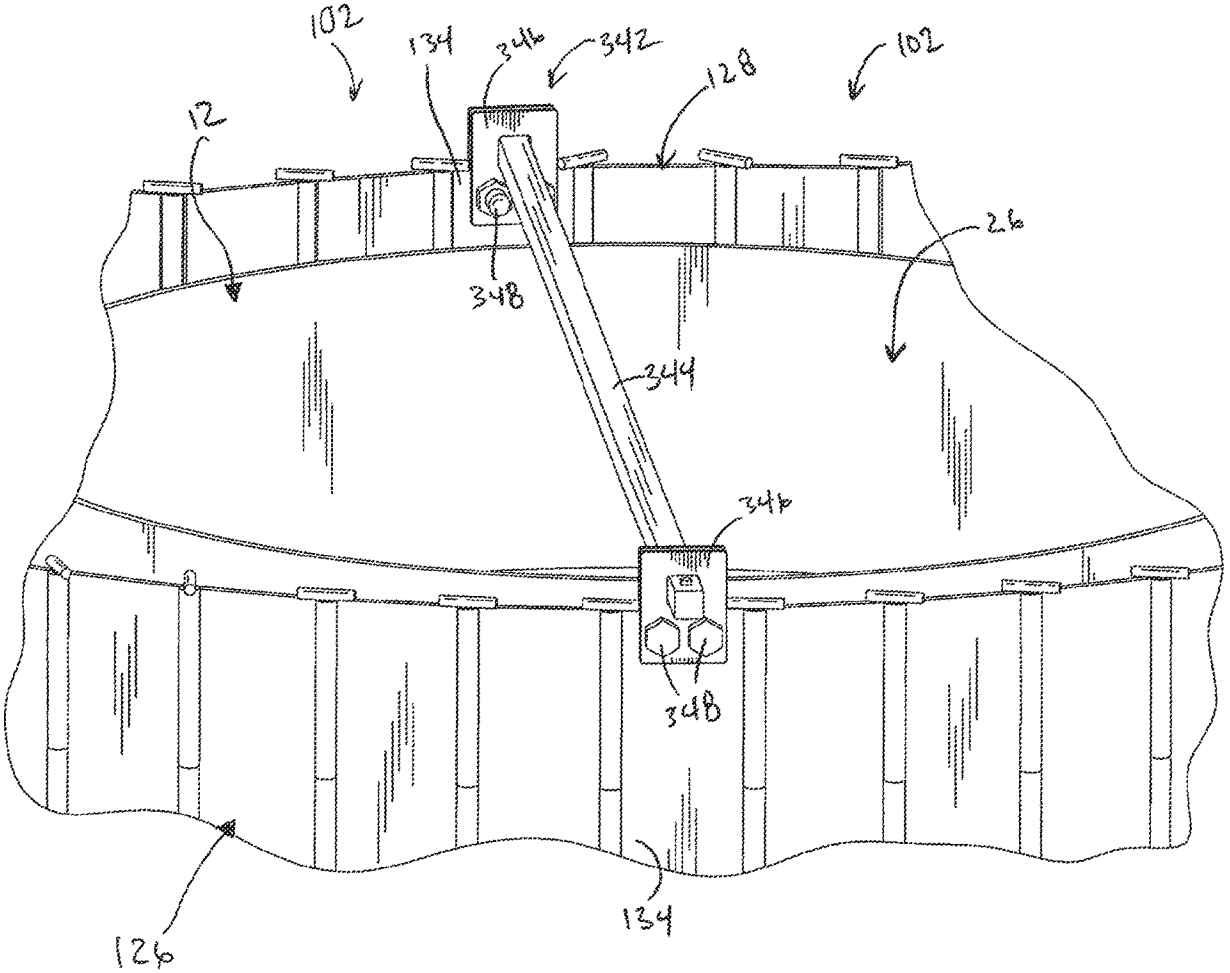
FIG. 21D is another partial perspective view of the pre-casting assembly of FIG. 21, illustrating the liner hold-down bar assembly of FIG. 21C.

In one exemplary embodiment shown in FIGS. 21B-21D, pre-casting assembly anchors 340 may be fixed to pre-casting assembly 102 at forming plates 110, 120, it being understood that fixation to plate 120 is the same as plate 110 illustrated. Additional anchors 340 may also be fixed to various individual intermediate segments 134 of back and front wall assemblies 126, 128, it being understood that fixation to back wall assembly 126 is the same as to front wall assembly 128 as illustrated. Each anchor 340 may be fixed to the respective adjacent plate by any suitable method, such as by bolting or may be welding, for example. Anchors 340 are similarly fixed to the underlying support surface, which may be a flat steel pour plate. When the pour operation begins, anchors 340 prevent the components of pre-casting assembly 102 from being urged upwardly by the pressure of the concrete within the concrete cavity of pre-casting assembly 102.

FIGS. 21C and 21D further illustrate liner hold-down bar assembly 342, which fixes liner 12 within pre-casting assembly 102 to prevent flotation thereof during the pour operation. In particular, assembly 342 includes hold-down bar 344 which spans entry aperture 26 (FIG. 21D) and is fixed to individual intermediate segments 134 of back and front wall assemblies 126, respectively. Hold-down bar 344 is received through hold-down brackets 346, best shown in FIG. 21C, which in turn are bolted to the adjacent intermediate segment 134 by bolts 348. As noted above, where pour cover 160 (FIG. 12) is employed, hold-down bar 344 may extend over pour cover 160.

Accordingly, manhole base assembly 10 can be cast in a "right side up" configuration. After concrete base 14 has set following the pour operation, manhole base assembly 10 may be withdrawn from the pre-casting assembly 102 and/or casting jacket 104 in the orientation in which it is intended to be installed for service. There is no need for manhole base assembly 10 to be rotated or inverted from an "upside-down" configuration to a "right side up" configuration after this type of casting operation is completed.

It is also contemplated that pre-casting assembly 102 can be configured for stand-alone casting, and/or lowered into casting jacket 104, in an "upside-down" or inverted configuration. In the inverted configuration, entry aperture 26 opens downwardly toward the support surface, such as the pour plate or closed lower end of casting jacket 104. In this case, concrete may be poured directly into the void of pre-casting assembly 102 over bottom wall 68 of liner 12 (FIG. 2), without the use of pour cover 160. In this method of production, manhole base assembly 10 would need to be withdrawn from casting jacket 104 in its upside-down configuration after the concrete of base 14 has set, and then rotated 180 degrees to a right side up configuration before installation.

Figure 21E:
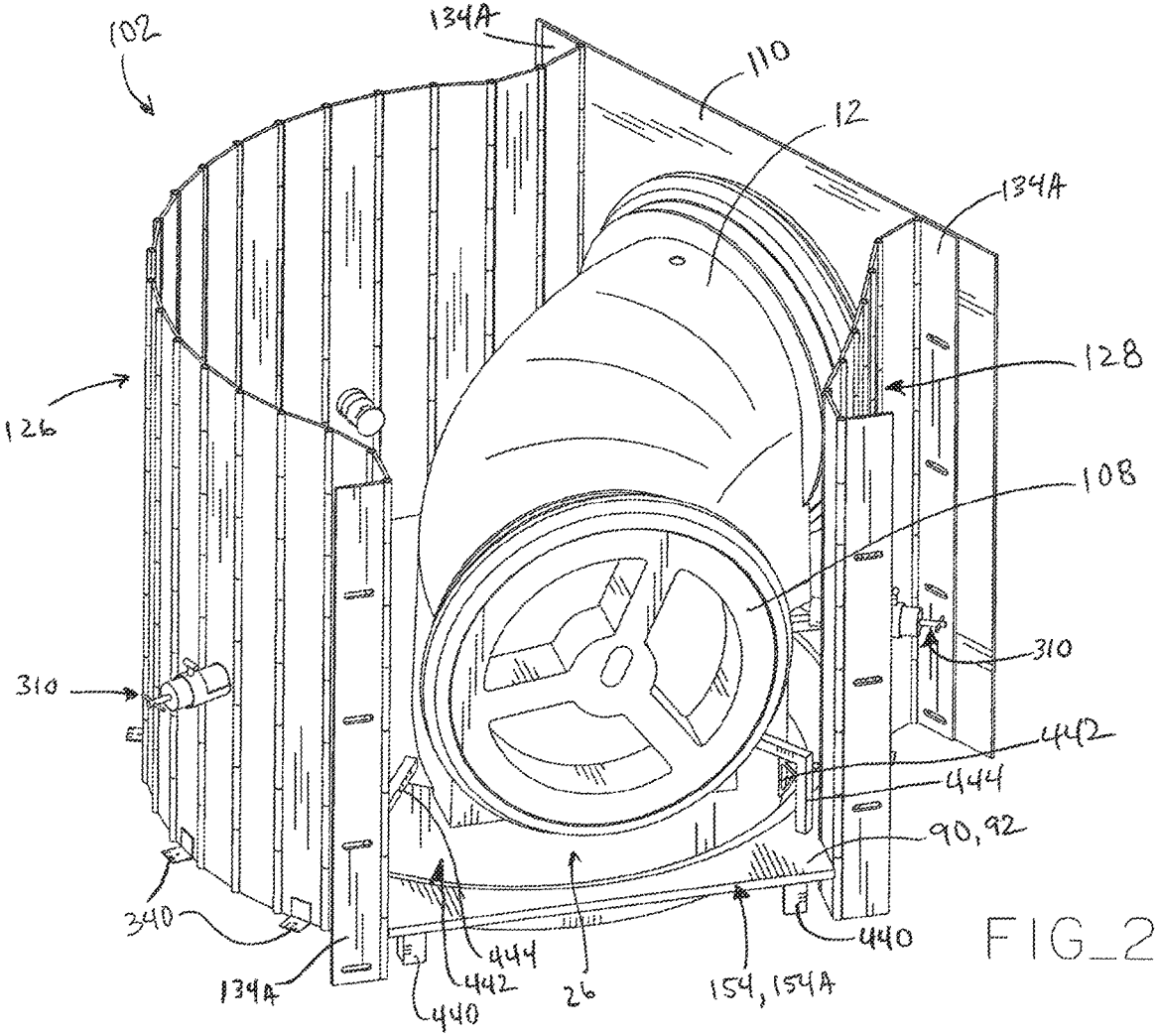
FIG. 21E is a perspective view of the pre-casting assembly shown in FIG. 21, illustrating an assembly configuration for an upside down casting process.
Figure 21F:
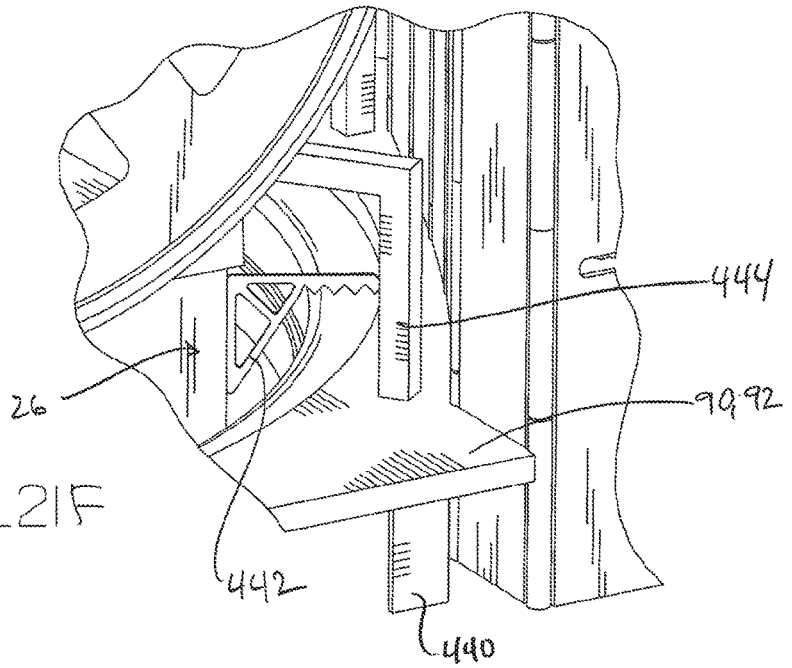
FIG. 21F is an enlarged, perspective view of a portion of FIG. 21E, illustrating components used for the upside down casting process.
Figure 21G:
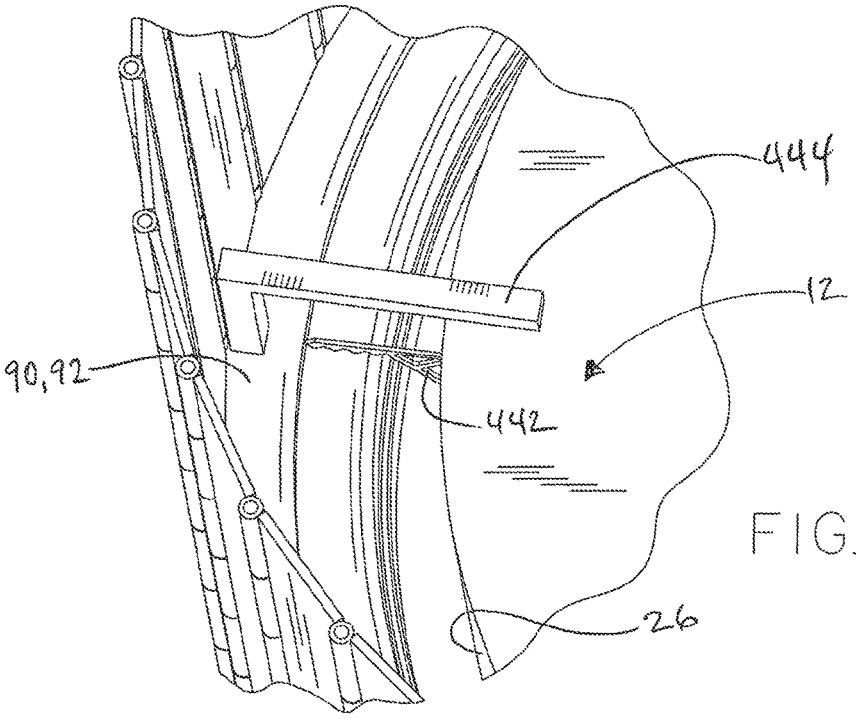
FIG. 21G is another enlarged perspective view of the components shown in FIG. 21F.

FIGS. 21E-21G illustrate an exemplary embodiment in which pre-casting assembly 102 is arranged with liner 12 in an "upside down" orientation. The pour operation to create concrete base 14 is similar in the inverted and non-inverted configurations, except that pre-casting assembly 102 includes some additional structures to facilitate the upside down casting operation. In particular, header 154 or header assembly 154A is supported and oriented relative to the underlying support surface (e.g., a pour plate) and liner 12 in order to maintain the proper spatial orientation therebetween during the pour operation.

Header plate supports 440 are disposed between header plates 190, 192 of header assembly 154A (or the corresponding portions of header 154), and the underlying support surface such as a pour plate. Supports 440 are sized to maintain the proper vertical spacing therebetween. In an exemplary embodiment, supports 440 are provided at various locations around header 154 or header assembly 154A to maintain proper spacing all around entry aperture 26.

As best shown in FIG. 21F, entry aperture spacers 442 are also provided between the outer wall of entry aperture 26 of liner 12 and the inner wall of the adjacent plate 90 or 92 of header assembly 154A (or the corresponding plate of the monolithic header 154). Spacers 442 maintain the appropriate concentricity between header 154 or header assembly 154A and entry aperture 26 during the pour operation. In an exemplary embodiment, a plurality of entry aperture spacers 442, such as at least three spacers 442, are positioned evenly spaced around the periphery of entry aperture 26.

Further, liner hold down clamps 444 provide a mechanical link between header 154 or header assembly 154A and liner 12. In particular, as best shown in FIG. 21G, clamps 444 are fixed to plates 90 or 92 and extend over the planar lower surface of liner 12 at entry aperture 26, i.e., the lower surface whose opposite side forms one of rear bench 32 or front bench 34 (FIG. 23). Clamps 444 therefore hold liner 12 to header assembly 154A (or header 154) to prevent liner 12 from floating or otherwise vertically shifting relative to header assembly 154A or header 154 during the pour operation. In an exemplary embodiment, a plurality of liner hold down clamps 444, such as at least three clamps 444, are positioned around the periphery of entry aperture 26 at various points adjacent to benches 32 and 34.

Advantageously, the upside down casting methodology facilitated by the configuration of pre-casting assembly 102 shown in FIGS. 21E-21G establishes the axial upper end surface of entry aperture 26 as a datum or reference plane for liner 12 with respect to the remaining components of assembly 102. In an exemplary embodiment, this axial upper surface of entry aperture 26 may be machined or otherwise produced with a high-accuracy tolerance, such that it forms a planar datum which can be relied upon to create the desired spatial orientation of the remaining features of liner 12 within concrete base 14 after formation of manhole base assembly 10.

Turning now to FIG. 21, anchor points 30 are illustrated as a part of pre-casting assembly 102 and are cast into the material of concrete base 14 during the concrete pour operation, such that anchor points 30 are retained within the concrete after it sets (FIG. 10). In order to hold anchor points 30 at the desired position during the pour operation, and to provide strength and resilience for later-attached anchors 42, anchor points 30 are fixed to reinforcement rods 18 as shown in FIG. 21. In addition, the outer surfaces of anchor points 30 (i.e., the surface which receives connecting portion 44 of anchors 42) abut the adjacent inner surfaces of wall 116/128 or 126, as shown in FIG. 21. This abutting configuration prevents concrete flow into the threaded aperture of anchor points 30, preserving this aperture for its eventual use as a point of attachment for anchors 42. In addition, in order to further constrain movement of reinforcement rods 18 during the pour operation, and therefore to further prevent any movement of liner 12 due to its buoyancy as noted above, fasteners may be received into anchor points 30 through one of walls 116, 126 or 128 when pre-casting assembly 102 is prepared, thereby anchoring reinforcement rods 18 to the adjacent wall structures.

As noted above with respect to FIG. 34, liner 12 may also be provided as a composite two-layer structure including a plurality of sheet-backed anchors 260 distributed about the outer surface thereof. While sheet-backed anchors 260 may be partially encapsulated by the outer fiberglass layer of liner 12, a portion of anchors 260 remains exposed including respective apertures formed by anchors 260 as described above. When concrete base 14 is formed by the pouring of concrete into pre-casting assembly 102, the flowable concrete material may interdigitate with each of the anchors 260 and flow into and through the apertures formed therein. When the concrete of base 14 cures, this interdigitation prevents significant separation of liner 12 from concrete base 14 due to, e.g., shrinkage of the concrete material during curing. Anchors 260 also reinforce the firm fixation between liner 12 and concrete base 14, in concert with reinforcement rods 18 and/or reinforcement assembly 266 as described herein.

Referring still to FIG. 21, a relatively tall entry aperture portion 26A is illustrated. In an exemplary embodiment, liner 12 may be initially molded with such a tall entry aperture portion 26A in order to accommodate varying finished heights of concrete base 14. As noted above, these varying finished heights may be defined by vertical adjustment of header 154 prior to the pour operation. In order to provide structural support for the polymer material of liner 12 during the pour operation, inflatable liner support 170, shown in FIGS. 19 and 20, may be used as described above. Alternatively, as shown in FIG. 21, one or more expansion band assemblies 180 may be abutted to the interior surface of entry aperture portion 26A to provide support. Exemplary expansion band assemblies are described in U.S. Pat. No. 7,146,689, issued Dec. 12, 2006 and entitled "Expansion Ring Assembly," the entire disclosure of which is hereby expressly incorporated herein by reference.

Any number of expansion band assemblies 180 may be used to support entry aperture portion 26A, depending on its overall axial length and the amount of mechanical support required. Where an entry aperture portion 26A is desired to be shorter than its as-molded condition after production of liner 12, excess material may be trimmed away. In an exemplary embodiment, header 154 may be placed at a desired height, and inner collar 166 may then serve as a cutting guide for entry aperture portion 26A.

When it is desired to form a manhole base assembly 10 with a first angle $\alpha$ and reflex angle $\Theta$ different from the illustrated 120-degree configuration, an alternative liner 12 is first produced or obtained with the desired geometry. As noted above, many of the components used in creating liner forming assembly 200 can be used to create other, alternative geometries including various angles $\alpha$ and $\Theta$. Moreover, similar parts and varying arrangements of such parts can be used to form any desired liner configuration.

Advantageously, many of the same components used for pre-casting assembly 102 as described above can again be used in a reconfigured pre-casting assembly 102 compatible with the alternative geometry. For example, a number of intermediate segments 134 may be added to or removed from hinged back wall assembly 126 and hinged front wall assembly 128 in order to accommodate the alternative angular arrangement. Aperture support assemblies 106 may still be used in conjunction with such reconfigured back and front wall assemblies 126, 128. Where the size of first pipe aperture 20 and/or second pipe aperture 22 is changed, only aperture supports 108 of aperture support assemblies 106 (FIG. 15) and gaskets 16 need to be changed to accommodate the new aperture size. Similarly, if the elevation of one or both of apertures 20, 22 is changed in the alternative liner 12, only first and/or second forming plates 110, 120 need be changed in order to accommodate this variation. Alternatively, forming plates 110, 120 may have multiple fastener apertures 111 formed at different elevations to accommodate differing elevations of the corresponding apertures 20, 22. Unused fastener apertures 111 can be plugged using a fastener for a stopper.

For example, a user desiring the creation of concrete base 14 may assemble pre-casting assembly 102 as shown and described above. Using the same components of pre-casting assembly 102 (e.g., intermediate segments 134, forming plates 110, 120, and other components as described in detail above), the user may then reconfigure the pre-casting assembly into another configuration. In one method of operation, angles $\alpha$ and $\Theta$ may be altered by removing or adding intermediate segments 134 from front wall assembly 128 and/or back wall assembly 126. For example, where angle $\alpha$ of pre-casting assembly 102 is desired to be increased for a concrete base having the same overall size as concrete base 14, segments 134 may be removed from back wall assembly 126 and added to front wall assembly 128.

In addition, further forming plates may be used for the formation of concrete bases having more than two apertures (i.e., having more than one inlet and/or more than one outlet). Thus, forming plates similar to plates 110 and 120 are used in addition to plates 110 and 120, with additional sets of intermediate segments 134 interconnecting the various forming plates in a similar fashion to assembly 102 described above. In this way, a user may use the components of pre-casting assembly 102 to modularly configure a new pre-casting assembly with three or more inlet/outlet openings.

Still another modular option for the components of pre-casting assembly 102 is to vary the overall size of the concrete based formed within the assembly. For example, forming plates 110, 120 may be exchanged for alternative forming plates with larger or smaller apertures and/or overall sizes. Back and front wall assemblies 126, 128 may be expanded or reduced in size by the addition or removal of intermediate segments 134, respectively, and/or segments 134 may be exchanged for alternative segments with different sizes and/or configurations.

Moreover, the various components of pre-casting assembly 102 can be configured in a variety of ways for compatibility with a chosen geometry of liner 12, and all of these configurations may be receivable within the same industry-standard casting jacket 104, such as a cylindrical jacket having an 86 inch inside diameter. This allows established casting operations to utilize standard casting jackets 104 and other tooling, while still realizing the benefits of reduced concrete consumption, modular geometry and cast-in gaskets as described above.

In yet another embodiment, a pre-casting assembly made in accordance with the present disclosure, such as pre-casting assembly 102 may be used to cast a concrete base (e.g., concrete base 14) without a liner (e.g., liner 12). Instead, the pre-casting assembly may receive a sacrificial core to define the internal flow pathways, such as entry aperture 26, flow channel 24, and the various other internal pathways and features described in detail above, e.g., with respect to liner 12. In one exemplary embodiment, liner 12 may be replaced with a foam construct having the desired shape, size and configuration within pre-casting assembly 102 prior to the concrete pour operation. The concrete is then poured within pre-casting assembly 102 and around the foam construct in a similar fashion to the concrete pour operation described above. After the concrete has set to form a concrete base (e.g., concrete base 14), the foam construct is removed from the interior of the concrete base. After this removal, an unlined concrete base remains in which the internal flow pathways (e.g., entry aperture and flow channel 24) are bounded by exposed concrete rather than a liner material.

In the illustrated embodiment, manhole base assembly 10 may be sized and configured to be used in lieu of a traditional 86-inch diameter cylindrical concrete base assembly. Thus, casting jacket 104 with an 86-inch diameter may be originally designed to produce, e.g., a 72-inch cylindrical manhole base with a 7-inch thick wall. ASTM 478 and ASTM C76, the entire disclosures of which are hereby incorporated herein by reference, specify relevant concrete wall thicknesses for pipes and manholes.

Figure 24:
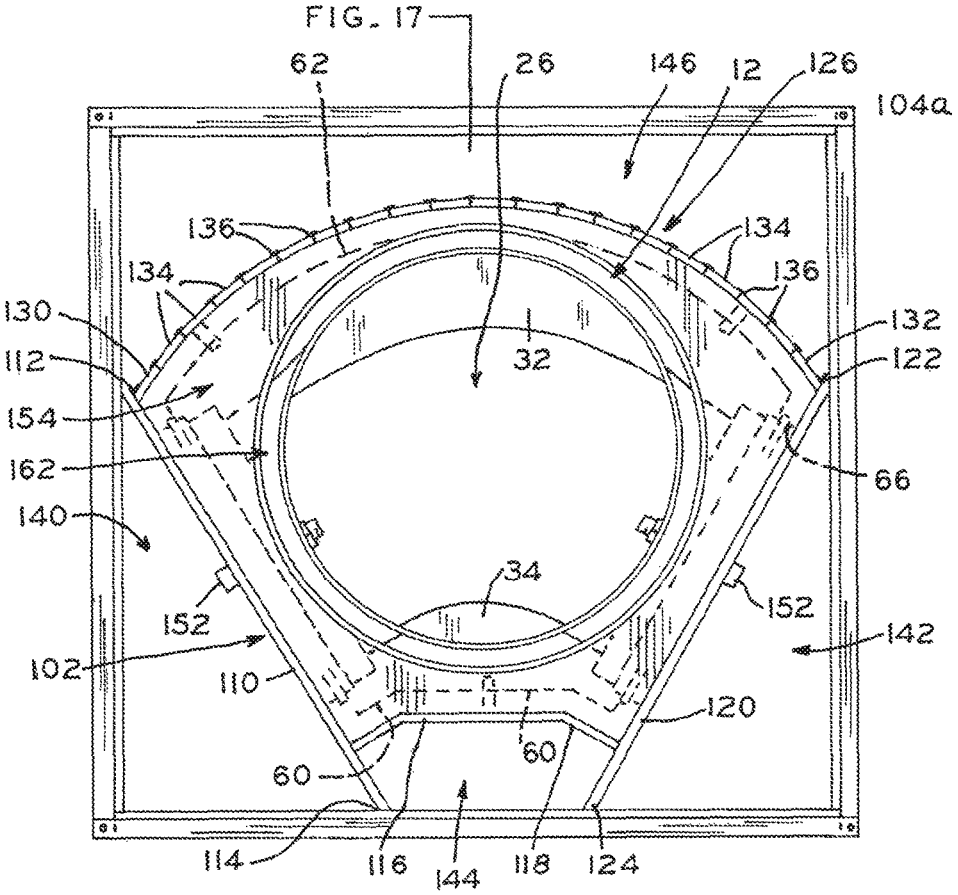
FIG. 24 is a top plan view of a manhole form assembly according to another embodiment.

Referring to FIG. 24, in another embodiment, the form structure optionally used to encase base assembly 10 prior to casting need not be circular, but may have a differing, alternative geometry. For example, a rectangular or square casting jacket 104*a* is shown in FIG. 24, together with the other form components discussed in detail above.

However, it is contemplated that manhole base 10 may be produced in a variety of sizes and configurations to be used in lieu of a corresponding variety of standard cylindrical manhole bases, or in custom sizes. For example, manhole base assembly 10 may be sized for use with pipes 50, 54 having inside diameters ranging from 18 inches to 120 inches. Similarly, manhole base assembly 10 may be sized for use with risers 58 having an inner diameter between 24 inches and 140 inches. In particular exemplary embodiments of the type illustrated in the figures, pipes 50, 54 may have inside diameters between 18 inches and 60 inches, with risers 58 having inside diameters between 30 inches and 120 inches.

Moreover, the non-cylindrical outside profile of manhole base assembly 10 and corresponding reduction in concrete use for concrete base 14 cooperates with the design of liner 12 to enable some flexibility and modularity in the use and implementation of base assembly 10. For example, more than one size and of liner 12 can be used in conjunction with a single size of form 100. A particular size of liner 12 may be chosen based on the sizes and configuration of pipes 50 and 54. The chosen size and one or two other neighboring liner size options may all fit within a given form 100, with the only difference among liner sizes being the thickness of concrete base 14 and associated differences in affected structures (e.g., rods 18 and associated spacers, anchors, etc.). Moreover, provided that entry aperture 26 (which is sized to match a particular riser 58) and the overall outer profile of concrete base 14 are compatible with a chosen form 100, any size and configuration of liner 12 can be used in form 100.

In addition, the non-cylindrical outer profile of manhole base assembly 10 enables assembly 10 to carry large volumes of fluid through fluid channel 24 while occupying a smaller overall footprint than a traditional cylindrical manhole base assembly. This smaller footprint may in turn enable the use with smaller riser structures (e.g., risers 58 and other riser structures) for a given fluid capacity, thereby enabling cost savings.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A pre-casting assembly for production of a manhole base assembly having a cast base, the pre-casting assembly comprising:

a liner comprising:

an entry aperture defining an entry aperture diameter;

a first side wall having a first pipe aperture sized and positioned to be aligned with a first side opening of the cast base;

a second side wall having a second pipe aperture sized and positioned to be aligned with a second side opening of the cast base;

a liner top wall disposed radially outwardly of said entry aperture diameter and extending between said entry aperture and said first side wall; and a flow channel extending between said first and second pipe apertures and in fluid communication with the entry aperture;

a plurality of aperture supports sized to fit in the first pipe aperture and the second pipe aperture respectively;

a first forming plate secured to one of the plurality of aperture supports and adjacent to the first pipe aperture, the first forming plate having a back edge and an opposing front edge;

a second forming plate secured to another one of the plurality of aperture supports and adjacent to the second pipe aperture, the second forming plate having a back edge and an opposing front edge;

a back wall extending partially around the liner from the back edge of the first forming plate to the back edge of the second forming plate; and a front wall extending partially around the liner from the front edge of the first forming plate to the front edge of the second forming plate, the first forming plate, the second forming plate, the back wall, the front wall and the liner forming a concrete forming cavity, the liner received in the concrete forming cavity with the entry aperture forming an open upper end of the pre-casting assembly.

2. The pre-casting assembly of claim 1, further comprising:

a plurality of liner supports each having an upper profile configured to engage a corresponding outer profile of the first and second pipe apertures respectively, the liner supports received between an underlying support surface of the concrete forming cavity and the respective pipe apertures; and an additional liner support placed at a location between the underlying support surface and the liner and positioned between the plurality of liner supports to provide a three-point support system for the liner.

3. The pre-casting assembly of claim 1, further comprising a header assembly comprising:

a header plate sized to be received in the concrete forming cavity around the entry aperture; and a header mounted to the header plate.

4. The pre-casting assembly of claim 3, wherein the header plate comprises a first header plate and a second header plate joined together.

5. The pre-casting assembly of claim 1, wherein the back wall comprises a hinged wall comprising:

a first segment coupled to the first forming plate;

a last segment coupled to the second forming plate; and at least one intermediate segment between the first segment and the last segment, the first, last and intermediate segments hingedly connected to one another about respective vertical axes.

6. A pre-casting assembly for production of a manhole base assembly having a cast base, the pre-casting assembly comprising:

a liner comprising:

an entry aperture defining an entry aperture diameter;

a first side wall having a first pipe aperture sized and positioned to be aligned with a first side opening of the cast base;

a second side wall having a second pipe aperture sized and positioned to be aligned with a second side opening of the cast base;

a liner top wall disposed radially outwardly of said entry aperture diameter and extending between said entry aperture and said first side wall; and a flow channel extending between said first and second pipe apertures and in fluid communication with the entry aperture;

a plurality of aperture supports sized to fit in the first pipe aperture and the second pipe aperture respectively;

a first forming plate secured to one of the plurality of aperture supports and adjacent to the first pipe aperture, the first forming plate having a back edge and an opposing front edge;

a second forming plate secured to another one of the plurality of aperture supports and adjacent to the second pipe aperture, the second forming plate having a back edge and an opposing front edge;

a back wall extending partially around the liner from the back edge of the first forming plate to the back edge of the second forming plate; and a front wall extending partially around the liner from the front edge of the first forming plate to the front edge of the second forming plate, the first forming plate, the second forming plate, the back wall, the front wall and the liner forming a concrete forming cavity, the liner received in the concrete forming cavity with the entry aperture opening downwardly toward an underlying support surface.

7. The pre-casting assembly of claim 6, further comprising:

a header sized to be received in the concrete forming cavity around the entry aperture; and a plurality of header supports disposed between the header and the underlying support surface, the header supports sized to maintain a desired vertical spacing between the header and the underlying support surface.

8. The pre-casting assembly of claim 7, further comprising a plurality of entry aperture spacers disposed between an outer wall of the entry aperture and an adjacent inner wall of the header, the entry aperture spacers sized to maintain substantial concentricity between the entry aperture and the header.

9. The pre-casting assembly of claim 8, further comprising a plurality of liner hold down clamps fixed to the header and extend over the a lower surface of the liner, such that the liner hold down clamps prevent vertical motion of the liner relative to the header.

* * * * *